US005753411A

United States Patent [19]

Makuta

[11] Patent Number: 5,753,411

[45] Date of Patent: May 19, 1998

[54] SILVER HALIDE COLOR PHOTOGRAPHIC LIGHT SENSITIVE MATERIAL

[75] Inventor: Toshiyuki Makuta, Minami Ashigara, Japan

[73] Assignee: Fuji Photo Film Co., Ltd., Kanagawa, Japan

[21] Appl. No.: 757,821

[22] Filed: Nov. 27, 1996

[30] Foreign Application Priority Data

Nov. 30, 1995 [JP] Japan ..... 7-334191

[51] Int. Cl.[6] ..... G03C 1/06

[52] U.S. Cl. ..... 430/264; 430/598; 430/543; 430/607; 430/609; 430/531; 430/536; 430/627

[58] Field of Search ..... 430/264, 598, 430/607, 609, 531, 536, 627, 543

[56] References Cited

U.S. PATENT DOCUMENTS

| | | | |
|---|---|---|---|
| 4,060,418 | 11/1977 | Waxman et al. | 96/29 |
| 5,204,214 | 4/1993 | Okamura et al. | 430/598 |
| 5,244,773 | 9/1993 | Muramatsu et al. | 430/598 |
| 5,374,498 | 12/1994 | Fujita et al. | 430/264 |
| 5,447,835 | 9/1995 | Sakai et al. | 430/264 |

FOREIGN PATENT DOCUMENTS

| | | |
|---|---|---|
| 0 545 491 A1 | 6/1993 | European Pat. Off. . |
| 0 565 165 A1 | 10/1993 | European Pat. Off. . |

*Primary Examiner*—Geraldine Letscher
*Attorney, Agent, or Firm*—Birch, Stewart, Kolasch & Birch, LLP

[57] ABSTRACT

A silver halide color photographic light-sensitive material is disclosed, comprising a support having thereon at least one photographic constituent layer, wherein any one of the photographic constituent layer contains at least one reducing agent for color formation represented by formula (I), at least one dye forming coupler and at least one water-insoluble polymer.

20 Claims, No Drawings

SILVER HALIDE COLOR PHOTOGRAPHIC LIGHT SENSITIVE MATERIAL

FIELD OF THE INVENTION

The present invention relates to a color photographic technology, more specifically, the present invention relates to a silver halide color photographic material capable of coping with environmental conservation and simple and rapid processing, and further having good color forming property, storage stability and color hue, and a color image forming method thereof.

BACKGROUND OF THE INVENTION

In general, color photographic materials are color developed after exposure and thereby the oxidized p-phenylenediamine derivative reacts with a coupler to form an image. In this method, color reproduction is effected by a subtractive color process and in order to reproduce blue, green and red colors, yellow, magenta and cyan color images which are in a complementary relation, respectively, are formed.

The color development is achieved by dipping an exposed color photographic light-sensitive material in an alkali aqueous solution having dissolved therein a p-phenylenediamine derivative (color developer). However, the p-phenylenediamine derivative formed into an alkali aqueous solution is unstable and readily subjected to aging deterioration and in order to maintain stable development capacity, a problem is present that the color developer needs be frequently replenished. Further, disposal of the used color developer containing a p-phenylenediamine derivative requires cumbersome processes, and combining with the above-described frequent replenishment, the disposal of the used color developer discharged in a large amount raises a serious problem. Thus, low replenishment and low discharge of the color developer are keenly demanded.

One effective means for solving the issue of low replenishment and low discharge of the color developer is a method of incorporating an aromatic primary amine or a precursor thereof into a hydrophilic colloid layer and examples of the aromatic primary amine developing agent capable of incorporation and the precursor thereof include the compounds described in U.S. Pat. No. 4,060,418. However, since these aromatic primary amines and precursors thereof are unstable, stains are disadvantageously generated during a long-term storage of an unprocessed light-sensitive material or upon color development. Another effective means is a method of incorporating a sulfonylhydrazine-type compound described, for example, in EP-A-0545491 and EP-A-565165, into a hydrophilic colloid layer. However, the sulfonylhydrazine-type compounds described in these patent publications are not sufficiently stable and stains due to high temperature/high humidity or light during a long-term storage after the processing still lies on a problematic level. Further, the sulfonylhydrazine-type compound is bound to a problem that when a 2-equivalent coupler is used, almost no color formation is achieved. The 2-equivalent coupler is advantageous as compared to the 4-equivalent coupler in that stains ascribable to the coupler can be reduced, activity of the coupler is easy to control and various functions can be imparted to the splitting-off group.

To overcome the above-described problems, a technique for increasing the coloring property and a technique for allowing the use of a 2-equivalent coupler has been demanded to be developed.

SUMMARY OF THE INVENTION

The object of the present invention is to provide a light-sensitive material capable of low replenishment and low discharge, exhibiting a good color forming property and further reduced in stains due to high temperature/high humidity or light during a long-term storage of the light-sensitive material.

The object of the present invention can be achieved by the following constitution:

(1) A silver halide color photographic light-sensitive material comprising a support having thereon at least one photographic constituent layer, wherein any one of the photographic constituent layer contains at least one reducing agent for color formation represented by formula (I):

$$R^{11}—NHNH—X—R^{12} \quad (I)$$

wherein $R^{11}$ represents an aryl group or a heterocyclic group, $R^{12}$ represents an alkyl group, an alkenyl group, an alkynyl group, an aryl group or a heterocyclic group, and X represents —$SO_2$—, —CO—, —COCO—, —CO—O—, —CON($R^{13}$)—, —COCO—O—, —CCO—N($R^{13}$)— or —$SO_2$—N($R^{13}$)—, wherein $R^{13}$ represents a hydrogen atom or a group described for $R^{12}$, at least one dye forming coupler and at least one water-insoluble polymer;

(2) the silver halide color photographic light-sensitive material as described in item (1), wherein the compound represented by formula (I) is represented by formula (II) or (III):

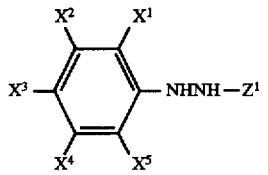

(II)

$$R^3—NHNH—Z^2 \quad (III)$$

wherein $Z^1$ represents an acyl group, a carbamoyl group, an alkoxycarbonyl group or an aryloxycarbonyl group, $Z^2$ represents a carbamoyl group, an alkoxycarbonyl group or an aryloxycarbonyl group, $X^1$, $X^2$, $X^3$, $X^4$ and X each represents a hydrogen atom or a substituent, provided that the sum of the Hammett's substituent constant $\sigma_p$ values of $X^1$, $X^3$ and $X^5$ and the Hammett's substituent constant $\sigma_m$ values of $X^2$ and $X^4$ is from 0.80 to 3.80, and $R^3$ represents a heterocyclic group;

(3) the silver halide color photographic light-sensitive material as described in item (2), wherein the compounds represented by formulae (II) and (III) are represented by formulae (IV) and (V), respectively:

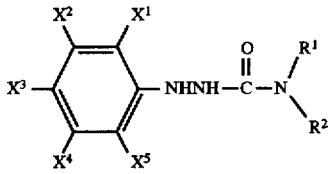

(IV)

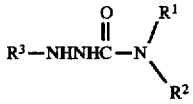

(V)

wherein $R^1$ and $R^2$ each represents a hydrogen atom or a substituent, $X^1$, $X^2$, $X^3$, $X^4$ and $X^5$ each represents a hydrogen atom or a substituent, provided that the sum of the Hammett's substituent constant $\sigma_p$ values of $X^1$, $X^3$ and $X^5$ and the Hammett's substituent constant $\sigma_m$ values of $X^2$ and $X^4$ is from 0.80 to 3.80, and $R^3$ represents a heterocyclic group;

(4) the silver halide color photographic light-sensitive material as described in item (3), wherein the compounds represented by formulae (IV) and (V) are represented by formulae (VI) and (VII), respectively:

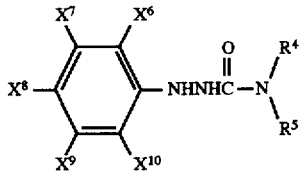

(VI)

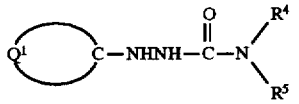

(VII)

wherein $R^4$ and $R^5$ each represents a hydrogen atom or a substituent, $X^6$, $X^7$, $X^8$, $X^9$ and $X^{10}$ each represents a hydrogen atom, a cyano group, a sulfonyl group, a sulfinyl group, a sulfamoyl group, a carbamoyl group, an alkoxycarbonyl group, an aryloxycarbonyl group, an acyl group, a trifluoromethyl group, a halogen atom, an acyloxy group, an acylthio group or a heterocyclic group, provided that the sum of the Hammett's substituent constant $\sigma_p$ values of $X^6$, $x^8$ and $X^{10}$ and the Hammett's substituent constant $\sigma_m$ values of $X^7$ and $X^9$ is from 1.20 to 3.80, and $Q^1$ represents a nonmetallic atom group necessary for forming a nitrogen-containing 5-, 6-, 7- or 8-membered heterocyclic ring together with C;

(5) the silver halide color photographic light-sensitive material as described in any one of items (1) to (4), wherein the total coated silver amount of all coated layers is, in terms of silver, from 0.003 to 0.3 g/m$^2$; and (6) the silver halide color photographic light-sensitive material as described in any one of items (1) to (5), which is scan exposed for an exposure time of from $10^{-8}$ to $10^{-4}$ second per one pixel.

The reducing agent for color formation for use in the present invention is dispersed in the same layer with or a different layer from the water-insoluble polymer, whereby high coloring property can be attained in forming a dye with a coupler and further, stains during a long-term storage of an unexposed light-sensitive material can be reduced (improvement of storability). In particular, the reducing agent for color formation represented by formula (IV) or (V) is dispersed together with the water-insoluble polymer, whereby further good effects are provided on the above-described coloring property or storability and not only a 4-equivalent coupler but also a 2-equivalent coupler can make a satisfactory oxidation coupling reaction to form a dye having a high color density.

When the reducing agent for color formation represented by formula (VI) or (VII) is used, the effect resulting from the use with the water-insoluble polymer according to the present invention is particularly outstanding.

In a preferred embodiment of the present invention, at least one of the reducing agent for color formation and at least one of the coupler is dispersed as an oil droplet obtained by dissolving it together with the water-insoluble polymer in an organic solvent. In a further preferred embodiment, the reducing agent for color formation, the coupler and the water-insoluble polymer are dispersed as an oil droplet obtained by dissolving them in an organic solvent.

Further, the present invention is suitable for environmental conservation because a good image can be obtained even with a low silver light-sensitive material having a coated silver amount of from 0.003 to 0.3 g/m$^2$, and also suitable for digital processing because when an image is formed by scan exposure, the image obtained can have a high density and be reduced in stains after storage.

DETAILED DESCRIPTION OF THE INVENTION

The specific constitution of the present invention is described in detail below.

The reducing agent for color formation used in the present invention is described in detail below.

The reducing agent for color formation represented by formula (I) used in the present invention is a compound which, in an alkali solution, directly reacts with exposed silver halide and thereby is oxidized or causes oxidation-reduction reaction with an auxiliary developing agent oxidized by exposed silver halide and thereby is oxidized, and the oxidation product obtained reacts with a dye-forming coupler to form a dye.

The structure of the reducing agent for color formation represented by formula (I) is described in detail below.

In formula (I), $R^{11}$ represents an aryl or heterocyclic group which may have a substituent. The aryl group of $R^{11}$ is preferably an aryl group having from 6 to 14 carbon atoms and examples thereof include phenyl and naphthyl. The heterocyclic group of $R^{11}$ is preferably a saturated or unsaturated, 5-, 6 -or 7-membered ring containing at least one of nitrogen, oxygen, sulfur and selenium. The ring may be further condensed with a benzene ring or a heterocyclic ring. Examples of the heterocyclic group represented by $R^{11}$ include furanyl, thienyl, oxazolyl, thiazolyl, imidazolyl, triazolyl, pyrrolidinyl, benzoxazolyl, benzothiazolyl, pyridyl, pyridazyl, pyrimidinyl, pyrazinyl, triazinyl, quinolinyl, isoquinolinyl, phthalazinyl, quinoxalinyl, quinazolinyl, purinyl, ptenilidinyl, azepinyl and benzoxepinyl.

Examples of the substituent of $R^{11}$ include an alkyl group, an alkenyl group, an alkynyl group, an aryl group, a heterocyclic group, an alkoxy group, an aryloxy group, a heterocyclic oxy group, an alkylthio group, an arylthio group, a heterocyclic thio group, an acyloxy group, an acylthio group, an alkoxycarbonyloxy group, an aryloxycarbonyloxy group, a carbamoyloxy group, an alkylsulfonyloxy group, an arylsulfonyloxy group, an amino group, an alkylamino group, an arylamino group, an amido group, an alkoxycarbonylamino group, an aryloxycarbonylamino group, a ureido group, a sulfonamido group, a sulfamoylamino group, an acyl group, an alkoxycarbonyl group, an aryloxycarbonyl group, a carbamoyl group, an acylcarbamoyl group, a carbamoylcarbamoyl group, a sulfonylcarbamoyl group, a sulfamoylcarbamoyl group, an alkylsulfonyl group, an arylsulfonyl group, an alkylsulfinyl group, an arylsulfinyl group, an alkoxysulfonyl group, an aryloxysulfonyl group, a sulfamoyl group, an acylsulfamoyl group, a carbamoylsulfamoyl group, a halogen atom, a nitro group, a cyano group, a carboxyl group, a sulfo group, a phosphono group, a hydroxyl group, a mercapto group, an imido group and an azo group.

$R^{12}$ represents an alkyl, alkenyl, alkynyl, aryl or heterocyclic group which may have a substituent.

The alkyl group of $R^{12}$ is preferably a linear, branched or cyclic alkyl group having from 1 to 16 carbon atoms and examples thereof include methyl, ethyl, hexyl, dodecyl, 2-octyl, t-butyl, cyclopentyl and cyclooctyl. The alkenyl group of $R^{12}$ is preferably a chained or cyclic alkenyl group having from 2 to 16 carbon atoms and examples thereof include vinyl, 1-octenyl and cyclohexenyl.

The alkynyl group of $R^{12}$ is preferably an alkynyl group having from 2 to 16 carbon atoms and examples thereof include 1-butynyl and phenylethynyl. The aryl group and the heterocyclic group of $R^{12}$ include those described for $R^{11}$. Examples of the substituent of $R^{12}$ include those described as the substituent of $R^{11}$.

X represents —$SO_2$—, —CO—, —COCO—, —CO—O—, —CON($R^{13}$)—, —COCO—O—, —COCO—N($R^{13}$)— or —$SO_2$—N($R^{13}$)— (wherein $R^{13}$ represents a hydrogen atom or a group described for $R^{12}$).

Among these groups, —CO—, —CON($R^{13}$)— and —CO—O— are preferred, and —CON($R^{13}$)— is more preferred because of the particularly excellent coloring property.

Among the compounds represented by formula (I), the compounds represented by formula (II) or (III) are preferred, the compounds represented by formula (IV) or (V) are more preferred, and the compounds represented by formula (VI) or (VII) are still more preferred.

The compounds represented by formula (II), (III), (IV), (V), (VI) or (VII) are described in detail below.

In formulae (II) and (III), $Z^1$ represents an acyl group, a carbamoyl group, an alkoxycarbonyl group or an aryloxycarbonyl group, $Z^2$ represents a carbamoyl group, an alkoxycarbonyl group or an aryloxycarbonyl group. The acyl group is preferably an acyl group having from 1 to 50, more preferably from 2 to 40 carbon atoms. Specific examples thereof include an acetyl group, a 2-methylpropanoyl group, a cyclohexylcarbonyl group, an n-octanoyl group, a 2-hexyldecanoyl group, a dodecanoyl group, a chloroacetyl group, a trifluoroacetyl group, a benzoyl group, a 4-dodecyloxybenzoyl group, a 2-hydroxymethylbenzoyl group and a 3-(N-hydroxy-N-methylaminocarbonyl) propanoyl group.

The case when $Z^1$ and $Z^2$ each is a carbamoyl group, is described in detail with respect to formulae (VI) and (VII).

The alkoxycarbonyl or aryloxycarbonyl group of $Z^1$ or $Z^2$ is preferably an alkoxycarbonyl or aryloxycarbonyl group having from 2 to 50, more preferably from 2 to 40 carbon atoms. Specific examples thereof include a methoxycarbonyl group, an ethoxycarbonyl group, an isobutyloxycarbonyl group, a cyclohexyloxycarbonyl group, a dodecyloxycarbonyl group, a benzyloxycarbonyl group, a phenoxycarbonyl group, a 4-octyloxyphenoxycarbonyl group, a 2-hydroxymethylphenoxycarbonyl group and a 2-dodecyloxyphenoxycarbonyl group.

$X^1$, $X^2$, $X^3$, $X^4$ and $X^5$ each represents a hydrogen atom or a substituent. Examples of the substituent include a linear or branched, chained or cyclic alkyl group having from 1 to 50 carbon atoms (e.g., trifluoromethyl, methyl, ethyl propyl, heptafluoropropyl, isopropyl, butyl, t-butyl, t-pentyl, cyclopentyl, cyclohexyl, octyl, 2-ethylhexyl, dodecyl), a linear or branched, chained or cyclic alkenyl group having from 2 to 50 carbon atoms (e.g., vinyl, 1-methylvinyl, cyclohexen-1-yl), an alkynyl group having a total carbon number of from 2 to 50 (e.g., ethynyl, 1-propynyl), an aryl group having from 6 to 50 carbon atoms (e.g., phenyl, naphthyl, anthryl), an acyloxy group having from 1 to 50 carbon atoms (e.g., acetoxy, tetradecanoyloxy, benzoyloxy), a carbamoyloxy group having from 1 to 50 carbon atoms (e.g., N,N-dimethylcarbamoyloxy), a carbonamido group having from 1 to 50 carbon atoms (e.g., formamido, N-methylacetamido, acetamido, N-methylformamido, benzamido), a sulfonamido group having from 1 to 50 carbon atoms (e.g., methanesulfonamido, dodecanesulfonamido, benzenesulfonamido, p-toluenesulfonamido), a carbamoyl group having from 1 to 50 carbon atoms (e.g., N-methylcarbamoyl, N,N-diethylcarbamoyl, N-mesylcarbamoyl), a sulfamoyl group having from 0 to 50 carbon atoms (e.g., N-butylsulfamoyl, N,N-diethylsulfamoyl, N-methyl-N-(4-methoxyphenyl) sulfamoyl), an alkoxy group having from 1 to 50 carbon atoms (e.g., methoxy, propoxy, isopropoxy, octyloxy, t-octyloxy, dodecyloxy, 2-(2,4-di-t-pentylphenoxy)ethoxy), an aryloxy group having from 6 to 50 carbon atoms (e.g., phenoxy, 4-methoxyphenoxy, naphthoxy), an aryloxycarbonyl group having from 7 to 50 carbon atoms (e.g., phenoxycarbonyl, naphthoxycarbonyl), an alkoxycarbonyl group having from 2 to 50 carbon atoms (e.g., methoxycarbonyl, t-butoxycarbonyl), an N-acylsulfamoyl group having from 1 to 50 carbon atoms (e.g., N-tetradecanoylsulfamoyl, N-benzoylsulfamoyl), an alkylsulfonyl group having from 1 to 50 carbon atoms (e.g., methanesulfonyl, octylsulfonyl, 2-methoxyethylsulfonyl, 2-hexyldecylsulfonyl), an arylsulfonyl group having from 6 to 50 carbon atoms (e.g., benzenesulfonyl, p-toluenesulfonyl, 4-phenylsulfonylphenylsulfonyl), an alkoxycarbonylamino group having from 2 to 50 carbon atoms (e.g., ethoxycarbonylamino), an aryloxycarbonylamino group having from 7 to 50 carbon atoms (e.g., phenoxycarbonylamino, naphthoxycarbonylamino), an amino group having from 0 to 50 carbon atoms (e.g., amino, methylamino, diethylamino, diisopropylamino, anilino, morpholino), a cyano group, a nitro group, a carboxyl group, a hydroxy group, a sulfo group, a mercapto group, an alkylsulfinyl group having from 1 to 50 carbon atoms (e.g., methanesulfinyl, octanesulfinyl), an arylsulfinyl group having from 6 to 50 carbon atoms (e.g., benzenesulfinyl, 4-chlorophenylsulfinyl, p-toluenesulfinyl), an alkylthio group having from 1 to 50 carbon atoms (e.g., methylthio, octylthio, cyclohexylthio), an arylthio group having from 6 to 50 carbon atoms (e.g., phenylthio, naphthylthio), a ureido group having 1 to 50 carbon atoms (e.g., 3-methylureido, 3,3-dimethylureido, 1,3-diphenylureido), a heterocyclic group having from 2 to 50 carbon atoms (a 3-, 4-, 5-, 6-, 7-, 8-, 9-, 10-, 11- or 12-membered monocyclic or condensed ring containing as a hetero atom at least one of, for example, nitrogen, oxygen and sulfur, e.g., 2-furyl, 2-pyranyl, 2-pyridyl, 2-thienyl, 2-imidazolyl, morpholino, 2-quinolyl, 2-benzimidazolyl, 2-benzothiazolyl, 2-benzoxazolyl), an acyl group having from 1 to 50 carbon atoms (e.g., acetyl, benzoyl, trifluoroacetyl), a sulfamoylamino group having from 0 to 50 carbon atoms (e.g., N-butylsulfamoylamino, N-phenylsulfamoylamino), a silyl group having from 3 to 50 carbon atoms (e.g., trimethylsilyl, dimethyl-t-butylsilyl, triphenylsilyl) and a halogen atom (e.g., fluorine, chlorine, bromine). These substituents each may further have a substituent and examples of the substituent include the substituents described above. $X^1$, $X^2$, $X^3$, $X^4$ or $X^5$ may be combined with each other to form a condensed ring. The condensed ring is preferably a 5-, 6- or 7- membered ring, more preferably a 5- or 6-membered ring.

The substituent preferably has 50 or less carbon atoms, more preferably 42 or less carbon atoms, most preferably 34 or less carbon atoms, and preferably has 1 or more carbon atoms.

With respect to $X^1$, $X^2$, $X^3$, $X^4$ and $X^5$, the sum of the Hammett's substituent constant $\sigma_p$ values of $X^1$, $X^3$ and $X^5$ and the Hammett's substituent constant $\sigma_m$ values of $X^2$ and $X^4$ is from 0.80 to 3.80. In formula (VI), $X^6$, $X^7$, $X^8$, $X^9$ and $X^{10}$ each represents a hydrogen atom, a cyano group, a sulfonyl group, a sulfinyl group, a sulfamoyl group, a carbamoyl group, an alkoxycarbonyl group, an acryloxycarbonyl group, an acyl group, a trifluoromethyl group, a halogen atom, an acyloxy group, an acylthio group or a heterocyclic group, and these groups each may have a substituent or may be combined with each other to form a condensed ring. Specific examples thereof are the same as those described for $X^1$, $X^2$, $X^3$, $X^4$ and $X^5$. However, in formula (VI), the sum of the Hammett's substituent constant $\sigma_p$ values of $X^6$, $X^8$ and $X^{10}$ and the Hammett's substituent constant $\sigma_m$ values of $X^7$ and $X^9$ is from 1.20 to 3.80, preferably from 1.50 to 3.80, more preferably from 1.70 to 3.80.

If the sum of the $\sigma_p$ values and the $\sigma_m$ values is less than 0.80, the coloring property is insufficient, whereas if it exceeds 3.80, the compound itself is hard to synthesize and difficultly available.

The Hammett's substituent constants $\sigma_p$ and $\sigma_m$ are described in detail in publications, for example, in Naoki Inamoto, *Hammett Soku -Kozo to Han'no Sei-* (Hammett's Rule -Structure and Reactivity-), Maruzen; *Shin Jikken Kagaku Koza* 14, *Yuki Kaqobutsu no Gosei to Han'no V* (New Experiment and Chemistry Lecture 14, Synthesis and Reaction of Organic Compound V), page 2605, Nippon Kagaku Kai (compiler), Maruzen; Tadao Nakaya, *Riron Yuki Kagaku Kaisetsu* (Theoretical Organic Chemistry Exposition), page 217, Tokyo Kagaku Dojin; and *Chemical Review*, Vol. 91, pages 165 to 195 (1991).

$R^1$ and $R^2$ in formulae (IV) and (V) and $R^4$ and $R^5$ in formulae (VI) and (VII) each represents a hydrogen atom or a substituent and examples of the substituent include the same groups as described for $X^1$, $X^2$, $X^3$, $X^4$ and $X^5$. $R^1$ and $R^2$ in formulae (IV) and (V) and $R^4$ and $R^5$ in formulae (VI) and (VII) each is preferably a hydrogen atom, a substituted or unsubstituted alkyl group having from 1 to 50 carbon atoms, a substituted or unsubstituted aryl group having from 6 to 50 carbon atoms, a substituted or unsubstituted heterocyclic group having from 1 to 50 carbon atoms, and more preferably, at least one of $R^1$ and $R^2$ or at least one of $R^4$ and $R^5$ is a hydrogen atom.

In formulae (III) and (V), $R^3$ represents a heterocyclic group. The heterocyclic group is preferably a heterocyclic group having from 1 to 50 carbon atoms, which is a 3-, 4-, 5-, 6-, 7-, 8-, 9-, 10-, 11- or 12-membered (preferably, 3-, 4-, 5-, 6-, 7- or 8-membered) monocyclic or condensed ring containing as a hetero atom at least one of, for example, nitrogen, oxygen and sulfur, and specific examples of the heterocyclic ring include furan, pyran, pyridine, thiophene, imidazole, quinoline, benzimidazole, benzothiazole, benzoxazole, pyrimidine, pyrazine, 1,2,4-thiadiazole, pyrrole, oxazole, thiazole, quinazoline, isothiazole, pyridazine, indole, pyrazole, triazole and quinoxaline. These heterocyclic groups each may have a substituent and preferably one or more electron-withdrawing groups. The term "electron-withdrawing group" as used herein means a group having a positive Hammett's $\sigma_p$ value.

In incorporating the reducing agent for color formation according to the present invention into a light-sensitive material, at least one group of $Z^1$, $Z^2$, $R^1$ to $R^5$ and $X^1$ to $X^{10}$ preferably has a ballast group.

Examples of the heterocyclic ring completed by $Q_1$ are specifically shown in Compounds I-16 to I-74.

Specific examples of the novel reducing agent for color formation used in the present invention are set forth below, however, the present invention is by no means limited to these specific examples.

I-1

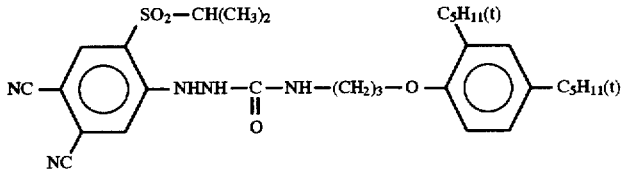

I-2

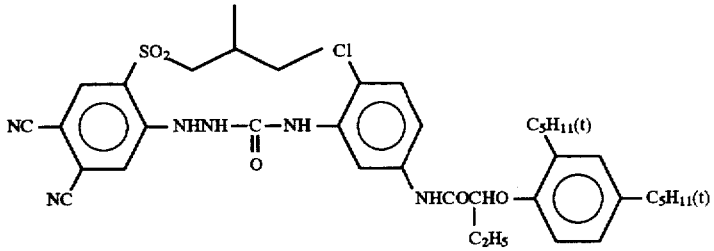

I-3

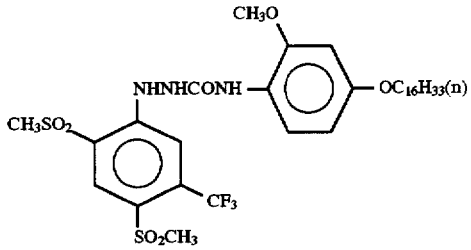

-continued
I-4
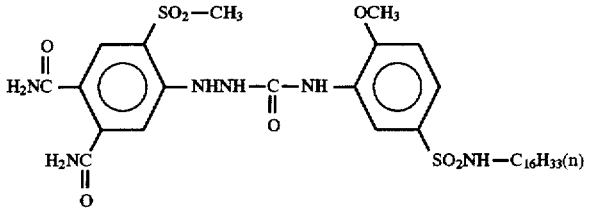
I-5
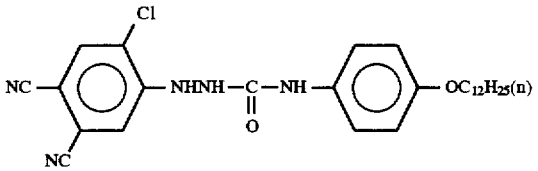
I-6
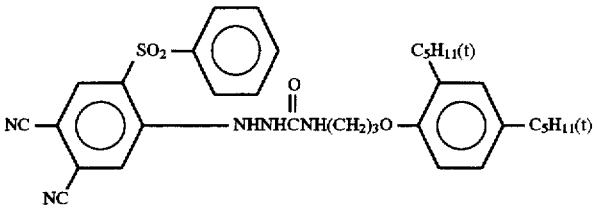
I-7
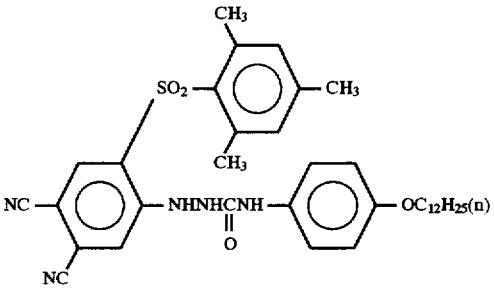
I-8
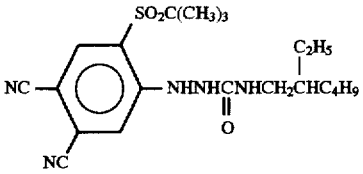
I-9
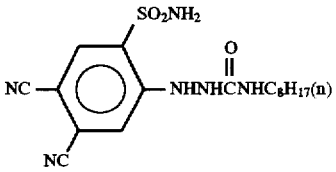
I-10
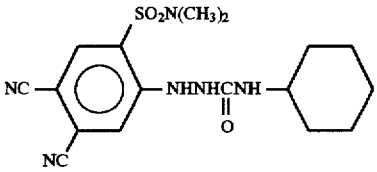
I-12
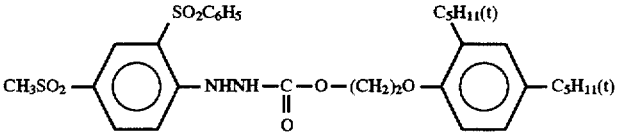
I-13
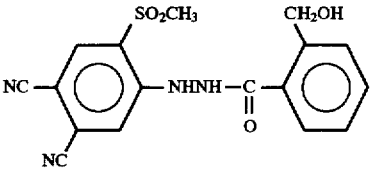
I-14
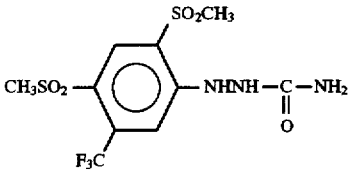

-continued
I-15
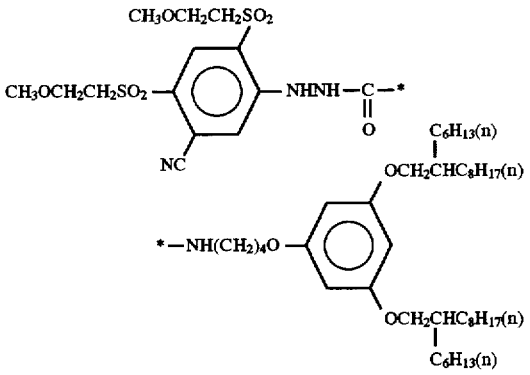
I-16
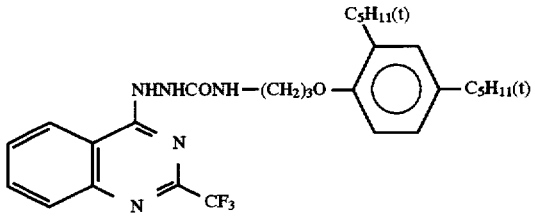
I-17
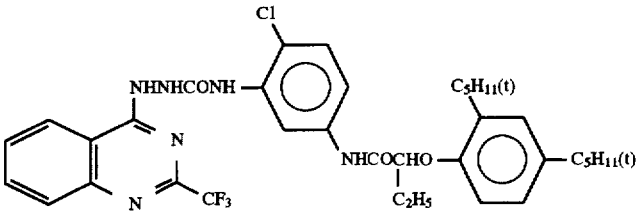
I-18
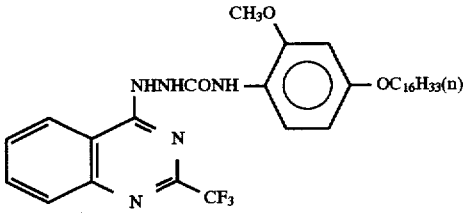
I-19
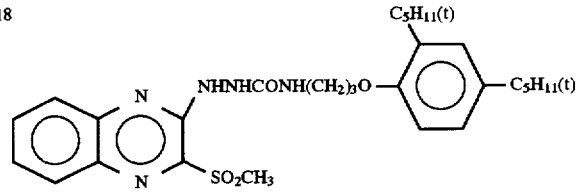
I-20
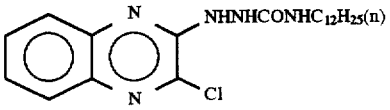
I-21
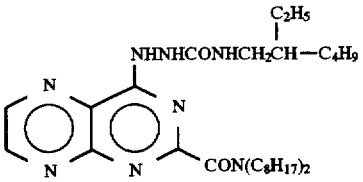
I-22
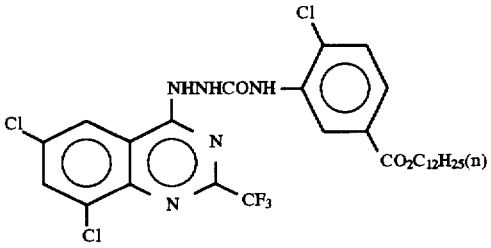
I-23
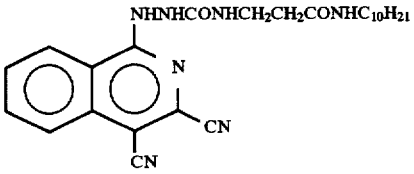
I-24
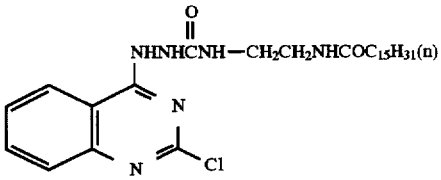
I-25
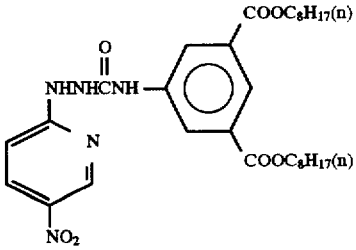

-continued
I-26
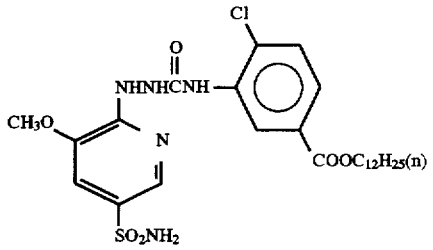
I-27
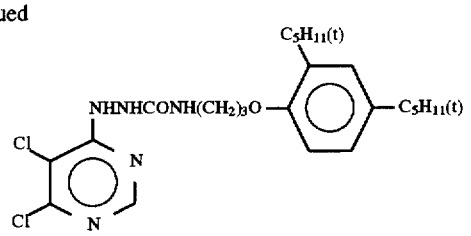
I-28
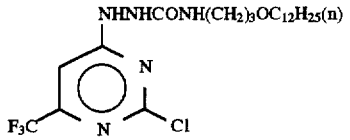
I-29
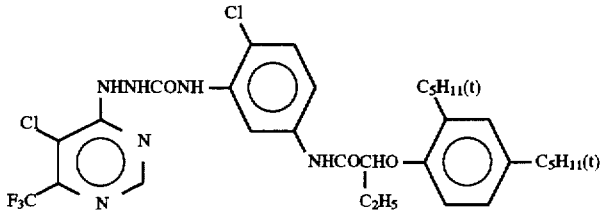
I-30
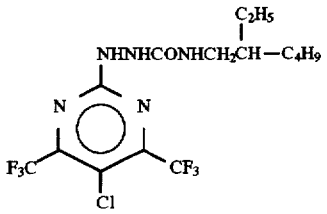
I-31
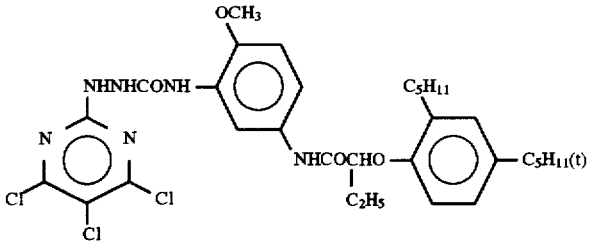
I-32
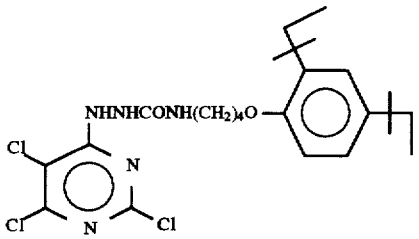
I-33
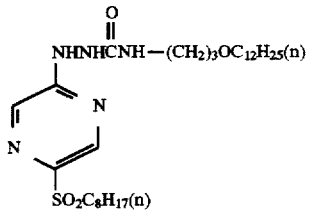
I-34
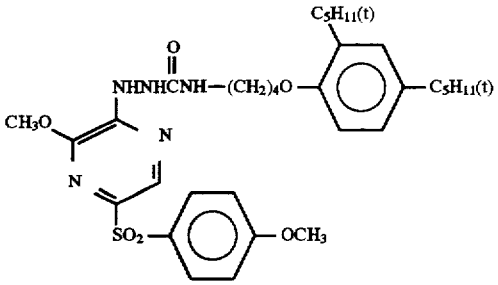
I-35
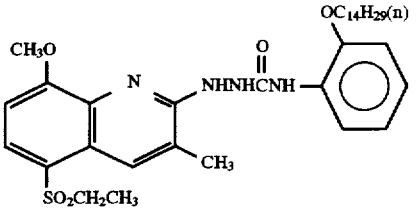

-continued
I-36
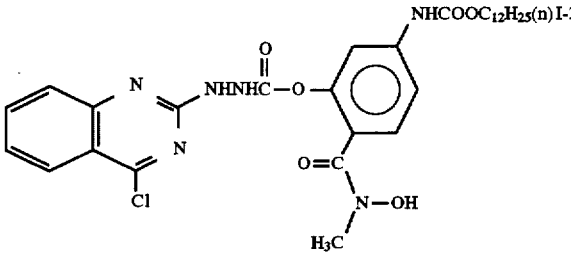
I-37
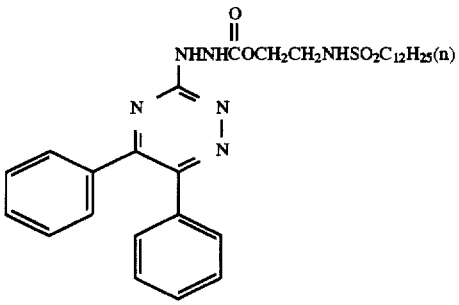
I-38
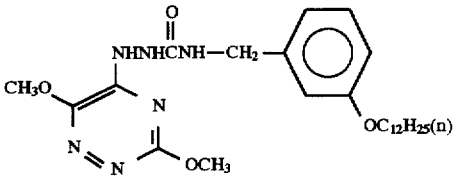
I-39
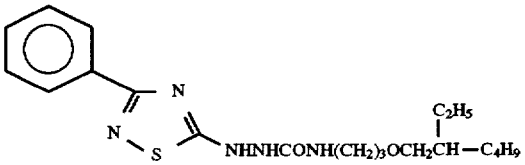
I-40
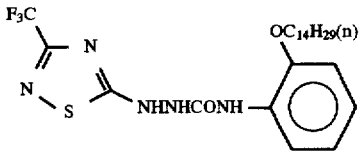
I-41
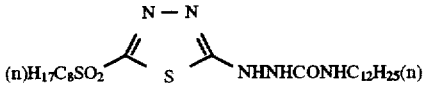
I-42
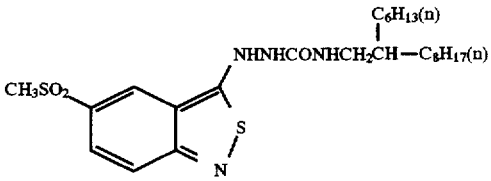
I-43
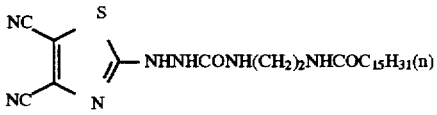
I-44
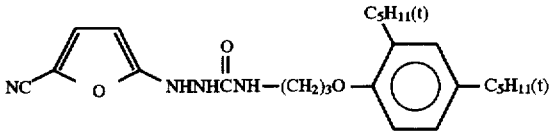
I-45
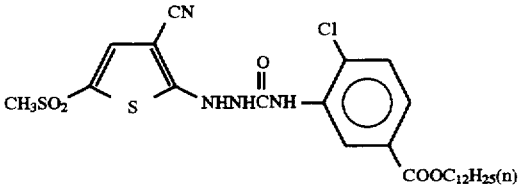
I-46
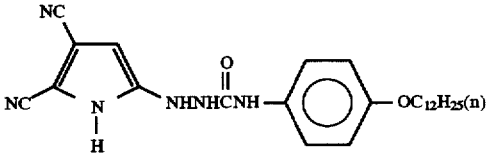
I-47
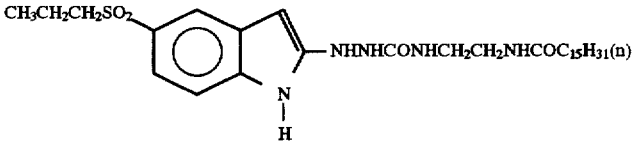
I-48
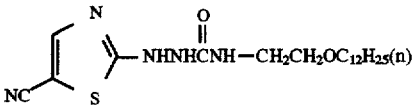
I-49
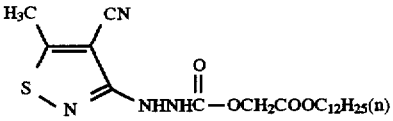

-continued
I-50
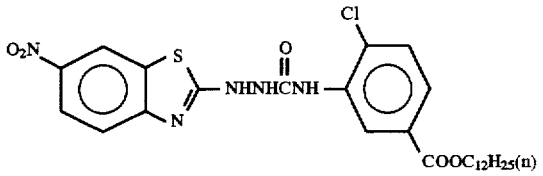
I-51
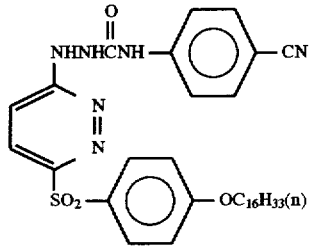
I-52
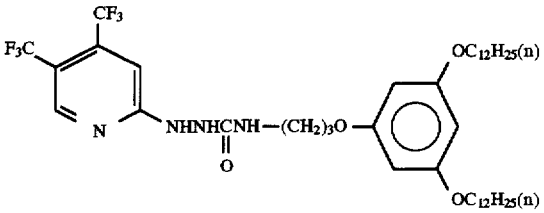
I-53
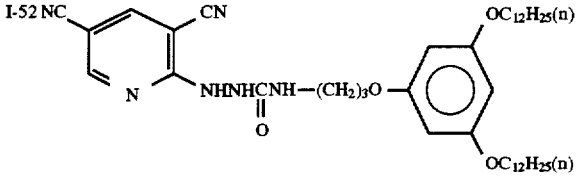
I-54
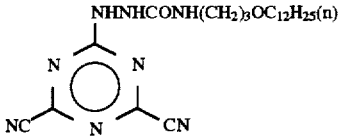
I-55
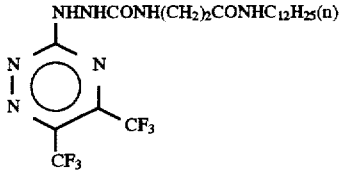
I-56
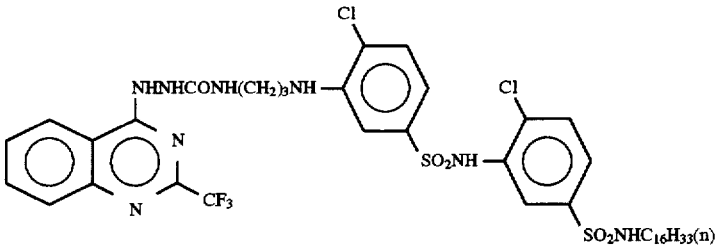
I-57
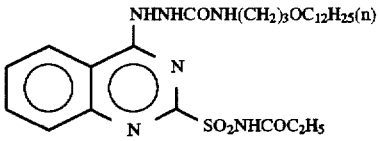
I-58
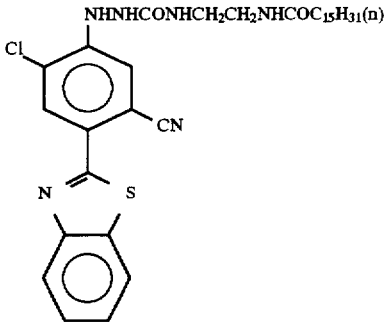
I-59
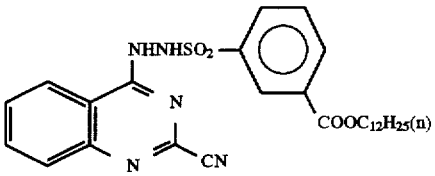
I-60
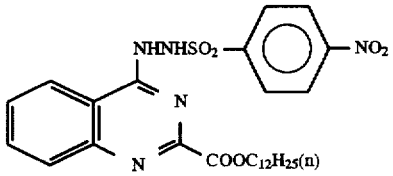
I-61
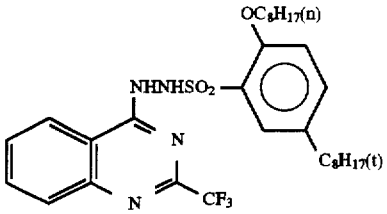
I-62
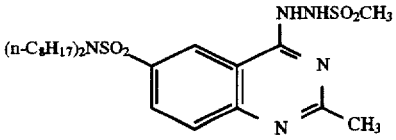

-continued
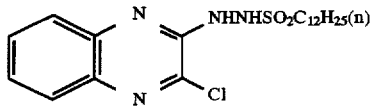
I-63
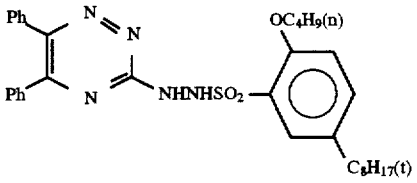
I-64
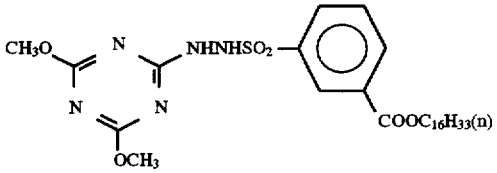
I-65
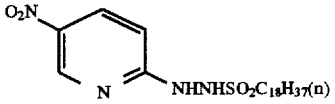
I-66
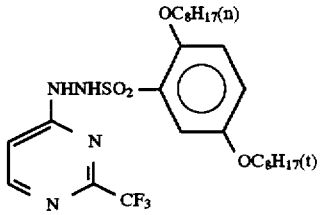
I-67
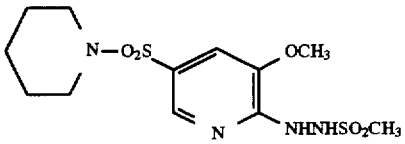
I-68
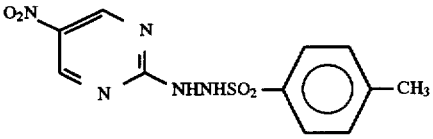
I-69
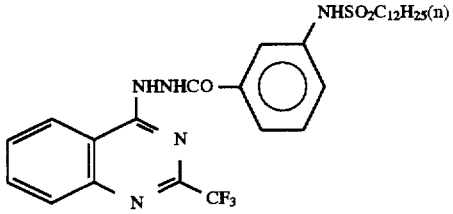
I-70
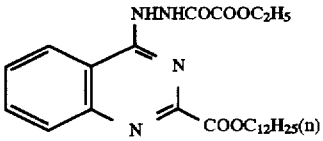
I-71
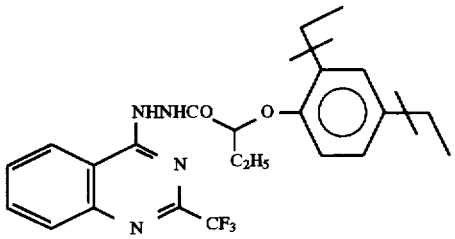
I-72
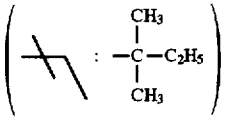
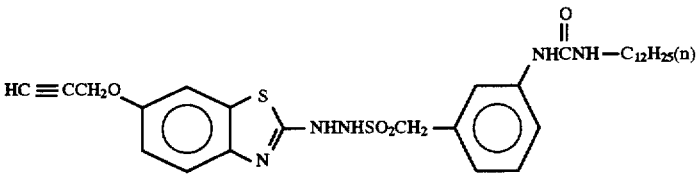
I-73
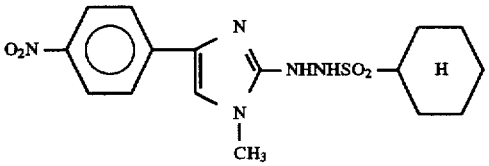
I-74

-continued
I-75
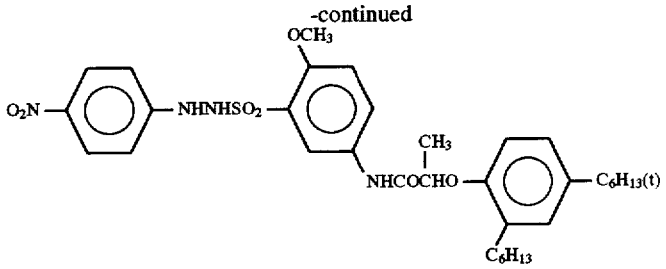
I-76
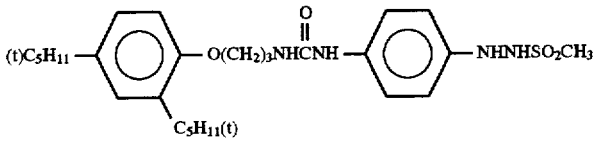
I-77
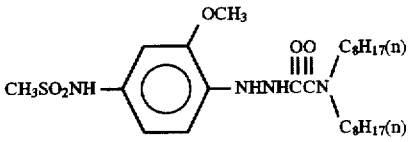
I-78
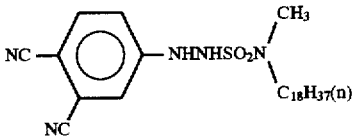
I-79
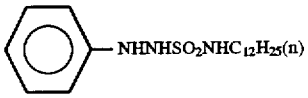
I-80
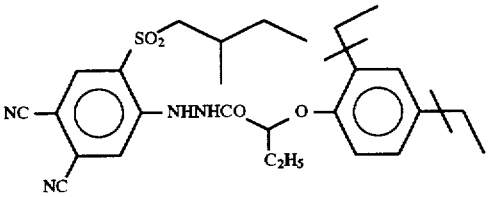
I-81
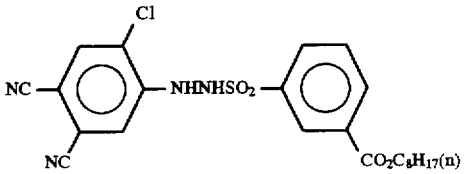
I-82
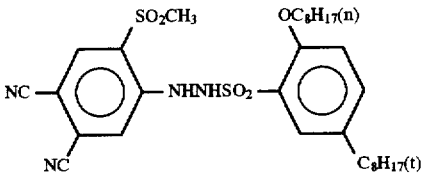
I-83
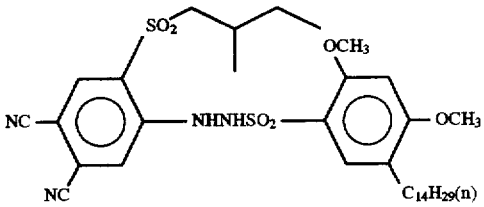
I-84
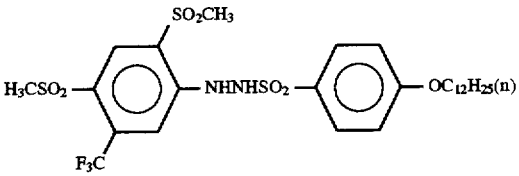
Examples of the couplers which are preferably used in the present invention include the compounds having a structure represented by formula (1), (2), (3), (4), (5), (6), (7), (8), (9), (10), (11) or (12). In general, these compounds are collectively called active methylene, pyrazolone, pyrazoloazole, phenol, naphthol or pyrrolotriazole, and are known in the field concerned.
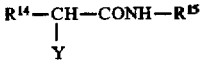
(1)
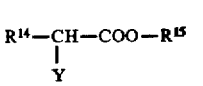
(2)
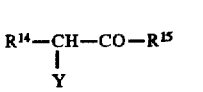
(3)
-continued
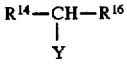
(4)
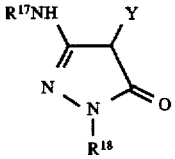
(5)
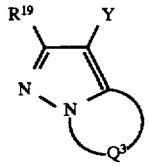
(6)

-continued (7)

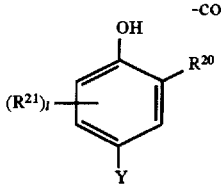

(8)

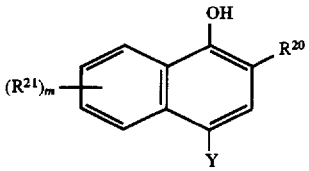

(9)

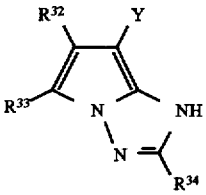

(10)

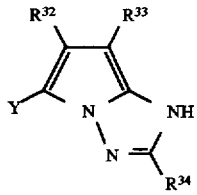

(11)

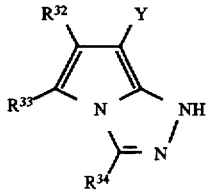

(12)

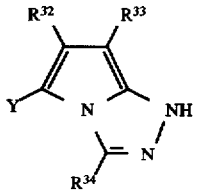

Couplers having a structure of formula (1), (2), (3) or (4) are called an active methylene-base coupler. In the formulae, $R^{14}$ represents an acyl group, an aryl group, a heterocyclic residue, an alkoxycarbonyl group, an aryloxycarbonyl group, a carbamoyl group, a sulfamoyl group, an alkylsulfonyl group or an arylsulfonyl group, each of which may have a substituent, or a cyano group or a nitro group.

In formulae (1) to (3), $R^{15}$ represents an alkyl group, an aryl group or a heterocyclic residue, each of which may have a substituent. In formula (4), $R^{16}$ represents an aryl group or a heterocyclic residue, each of which may have a substituent. Examples of the substituent of $R^{14}$, $R^{15}$ or $R^{16}$ include those described above for $X^1$ to $X^5$.

In formulae (1) to (4), Y represents a hydrogen atom or a group capable of splitting off upon coupling reaction with an oxidation product of the reducing agent for color formation. Examples of Y include a heterocyclic group (a saturated or unsaturated 5-, 6- or 7-membered monocyclic or condensed ring containing as a hetero atom at least one of nitrogen, oxygen and sulfur, e.g., succinimido, maleinimido, phthalimido, diglycolimido, pyrrole, pyrazole, imidazole, 1,2,4-triazole, tetrazole, indole, benzopyrazole, benzimidazole, benzotriazole, imidazolin-2,4-dione, oxazolidin-2,4-dione, thiazolidin-2,4-dione, imidazolidin-2-one, oxazolin-2-one, thiazolin-2-one, benzimidazolin-2-one, benzoxazolin-2-one, benzothiazolin-2-one, 2-pyrrolin-5-one, 2-imidazolin-5-one, indolin-2,3-dione, 2,6-dioxypurine, parabanic acid, 1,2,4-triazolidin-3,5-dione, 2-pyridone, 4-pyridone, 2-pyrimidone, 6-pyridazone, 2-pyrazone, 2-amino-1,3,4-thiazolidine, 2-imino-1,3,4-thiazolidin-4-one), a halogen atom (e.g., chlorine, bromine), an aryloxy group (e.g., phenoxy, 1-naphthoxy), a heterocyclic oxy group (e.g., pyridyloxy, pyrazolyloxy), an acyloxy group (e.g., acetoxy, benzoyloxy), an alkoxy group (e.g., methoxy, dodecyloxy), a carbamoyloxy group (e.g., N,N-diethylcarbamoyloxy, morpholinocarbonyloxy), an aryloxycarbonyloxy group (e.g., phenoxycarbonyloxy), an alkoxycarbonyloxy group (e.g., methoxycarbonyloxy, ethoxycarbonyloxy), an arylthio group (e.g., phenylthio, naphthylthio), a heterocyclic thio group (e.g., tetrazolylthio, 1,3,4-thiadiazolylthio, 1,3,4-oxadiazolylthio, benzimidazolylthio), an alkylthio group (e.g., methylthio, octylthio, hexadecylthio), an alkylsulfonyloxy group (e.g., methanesulfonyloxy), an arylsulfonyloxy group (e.g., benzenesufonyloxy, toluenesulfonyloxy), a carbonamido group (e.g., acetamido, trifluoroacetamido), a sulfonamido group (e.g., methanesulfonamido, benzenesulfonamido), an alkylsulfonyl group (e.g., methanesulfonyl), an arylsulfonyl group (e.g., benzenesulfonyl), an alkylsulfinyl group (e.g., methanesulfinyl), an arylsulfinyl group (e.g., benzenesulfinyl), an arylazo group (e.g., phenylazo, naphthylazo) and a carbamoylamino group (e.g., N-methylcarbamoylamino).

Y may be substituted by a substituent and examples of the substituent of Y include those described for $X^1$ to $X^5$.

Y is preferably a halogen atom, an aryloxy group, a heterocyclic oxy group, an acyloxy group, an aryloxycabonyloxy group, an alkoxycarbonyloxy group or a carbamoyloxy group.

In formulae (1) to (4), $R^{14}$ and $R^{15}$ or $R^{14}$ and $R^{16}$ may be combined with each other to form a ring.

Couplers having a structure of formula (5) are called a 5-pyrazolone-base coupler. In the formula, $R^{17}$ represents an alkyl group, an aryl group, an acyl group or a carbamoyl group and $R^{18}$ represents a phenyl group or a phenyl group substituted by one or more halogen atoms, alkyl groups, cyano groups, alkoxy groups, alkoxycarbonyl groups or acylamino groups.

Among the 5-pyrazolone-base couplers represented by formula (5), preferred are those where $R^{17}$ is an aryl group or an acyl group and $R^{18}$ is a phenyl group substituted by one or more halogen atoms.

More specifically stated about these preferred groups, $R^{17}$ is an aryl group such as a phenyl group, a 2-chlorophenyl group, a 2-methoxyphenyl group, a 2-chloro-5-tetradecanamidophenyl group, a 2-chloro-5-(3-octadecenyl-1-succinimido)phenyl group, a 2-chloro-5-octadecylsulfonamidophenyl group and a 2-chloro-5-[2-(4-hydroxy-3-t-butylphenoxy)tetradecanamido]phenyl, or an acyl group such as an acetyl group, a 2-(2,4-di-t-pentylphenoxy)butanoyl group, a benzoyl group and a 3-(2,4-di-t-amylphenoxyacetamido)benzoyl group. These groups each may further have a substituent and examples thereof include an organic substituent linked through a carbon atom, an oxygen atom, a nitrogen atom or a sulfur atom, and a halogen atom. Y has the same meaning as defined above.

$R^{18}$ is preferably a substituted phenyl group such as a 2,4,6-trichlorophenyl group, a 2,5-dichlorophenyl group and a 2-chlorophenyl group.

Couplers having a structure of formula (6) are called a pyrazoloazole-base coupler. In the formula, $R^{19}$ represents a hydrogen atom or a substituent, $Q^3$ represents a non-metallic atom group necessary for forming a 5-membered azole ring containing from 2 to 4 nitrogen atoms. The azole ring may have a substituent (including a condensed ring).

Among the pyrazoloazole-base couplers represented by formula (6), preferred in view of spectral absorption characteristics of the colored dye are imidazo[1,2-b]pyrazoles described in U.S. Pat. No. 4,500,630, pyrazolo[1,5-b]-1,2,4-triazoles described in U.S. Pat. No. 4,500,654 and pyrazolo[5,1-c]-1,2,4-triazoles described in U.S. Pat. No. 3,725,067.

The substituent represented by $R^{19}$ and the substituent of the azole ring represented by $Q^3$ are described in detail, for example, in U.S. Pat. No. 4,540,654, from column 2, line 41 to column 8, line 27. Preferred are a pyrazoloazole coupler having a branched alkyl group directly bonded to the 2-, 3- or 6-position of the pyrazolotriazole group described in JP-A-61-65245 (the term "JP-A" as used herein means an "unexamined published Japanese patent application"), a pyrazoloazole coupler containing a sulfonamido group in the molecule described in JP-A-61-65245, a pyrazoloazole coupler having an alkoxyphenylsulfonamido ballast group described in JP-A-61-147254, a pyrazolotriazole coupler having an alkoxy group or an aryloxy group at the 6-position described in JP-A-62-209457 and JP-A-63-307453, and a pyrazolotriazole coupler having a carbonamido group in the molecule described in JP-A-2-201443. Y has the same meaning as described above.

Couplers having a structure of formula (7) or (8) are called a phenol-base coupler or a naphthol-base coupler, respectively. In the formulae, $R^{20}$ represents a hydrogen atom or a group selected from $—CONR^{22}R^{23}$, $—SO_2NR^{22}R^{23}$, $—NHCOR^{22}$, $—NHCONR^{22}R^{23}$ and $—NHSO_2NR^{22}R^{23}$ (wherein $R^{22}$ and $R^{23}$ each represents a hydrogen atom or a substituent). In formulae (7) and (8), $R^{21}$ represents a substituent, l represents 0 or an integer of 1 or 2, and m represents 0 or an integer of from 1 to 4. When l or m is 2 or greater, the $R^{21}$ groups may be the same or different. Examples of the substituent represented by $R^{21}$, $R^{22}$ or $R^{23}$ include those described above for $X^1$ to $X^5$ in formula (II) or (IV). Y has the same meaning as described above.

Preferred examples of the phenol-base coupler represented by formula (7) include 2-acylamino-5-alkylphenol-base couplers described in U.S. Pat. Nos. 2,369,929, 2,801,171, 2,772,162, 2,895,826 and 3,772,002, 2,5-diacylaminophenol-base couplers described in U.S. Pat. Nos. 2,772,162, 3,758,308, 4,126,396, 4,334,011 and 4,327,173, West German Patent Application (OLS) No. 3,329,729 and JP-A-59-166956, and 2-phenylureido-5-acylaminophenol-base couplers described in U.S. Pat. Nos. 3,446,622, 4,333,999, 4,451,559 and 4,427,767. Y is the same as described above.

Preferred examples of the naphthol coupler represented by formula (8) include 2-carbamoyl-1-naphthol-base couplers described in U.S. Pat. Nos. 2,474,293, 4,052,212, 4,146,396, 4,282,233 and 4,296,200, and 2-carbamoyl-5-amido-1-naphtholbase couplers described in U.S. Pat. No. 4,690,889. Y is the same as described above.

Couplers having a structure of formula (9), (10), (11) or (12) are called pyrrolotriazole. In the formulae, $R^{32}$, $R^{33}$ and $R^{34}$ each represents a hydrogen atom or a substituent and Y has the same meaning as defined above. Examples of the substituent represented by $R^{32}$, $R^{33}$ or $R^{34}$ include those described above for $X^1$ to $X^5$. Preferred examples of the pyrrotriazole-base couplers represented by formulae (9) to (12) include couplers where at least one of $R^{32}$ and $R^{33}$ is an electron-withdrawing group, described in EP-A-488248, EP-A-491197 and European Patent 545,300. Y is the same as described above.

In addition, couplers having a structure such as a condensed ring phenol, an imidazole, a pyrrole, a 3-hydroxypyridine, an active methylene other than those described above, an active methine, a 5,5-condensed heterocyclic ring or a 5,6-condensed heterocyclic ring, may be used.

The condensed ring phenol-base coupler include the couplers described in U.S. Pat. Nos. 4,327,173, 4,564,586 and 4,904,575.

The imidazole-base coupler include the couplers described in U.S. Pat. Nos. 4,818,672 and 5,051,347.

The 3-hydroxypyridine-base coupler include the couplers described in JP-A-1-315736.

The active methylene- and active methine-base couplers include the couplers described in U.S. Pat. Nos. 5,104,783 and 5,162,196.

The 5,5-condensed heterocyclic ring-base coupler include the pyrrolopyrazole-base couplers described in U.S. Pat. No. 5,164,289 and the pyrroloimidazole-base couplers described in JP-A-4-174429.

The 5,6-condensed heterocyclic ring-base coupler include the pyrazolopyrimidine-base couplers described in U.S. Pat. No. 4,950,585, the pyrrolotriazine-base couplers described in JP-A-4-204730, and the couplers described in European Patent 556,700.

In addition to the above-described couplers, couplers described in West German Patents 3,819,051A and 3,823,049, U.S. Pat. Nos. 4,840,883, 5,024,930, 5,051,347 and 4,481,268, EP-A-304856, European Patent 329,036, EP-A-354549, EP-A-374781, EP-A-379110, EP-A-386930, JP-A-63-141055, JP-A-64-32260, JP-A-64-32261, JP-A-2-297547, JP-A-2-44340, JP-A-2-110555, JP-A-3-7938, JP-A-3-160440, JP-A-3-172839, JP-A-4-172447, JP-A-4-179949, JP-A-4-182645, JP-A-4-184437, JP-A-4-188138, JP-A-4-188139, JP-A-4-194847, JP-A-4-204532, JP-A-4-204731 and JP-A-4-204732 can be used in the present invention.

Specific examples of the couplers which can be used in the present invention are set froth below, however, the present invention is by no means limited thereto.

(C-1)
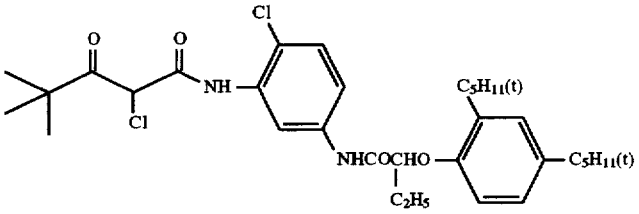
(C-2)
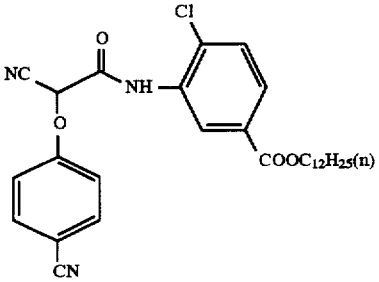
(C-3)
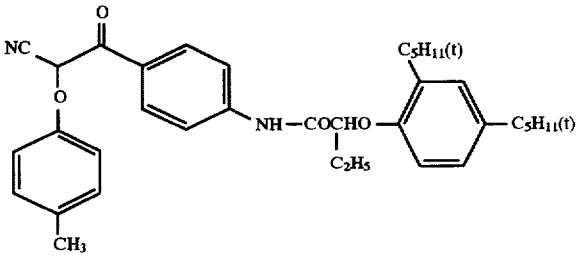
(C-4)
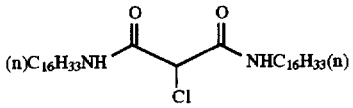
(C-5)
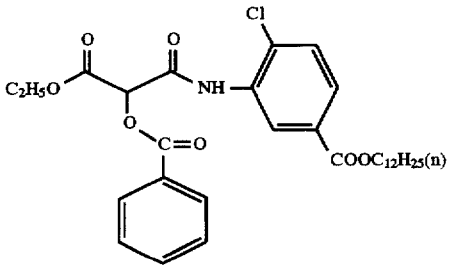
(C-6)
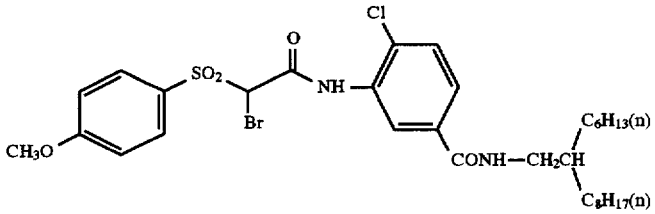
(C-7)
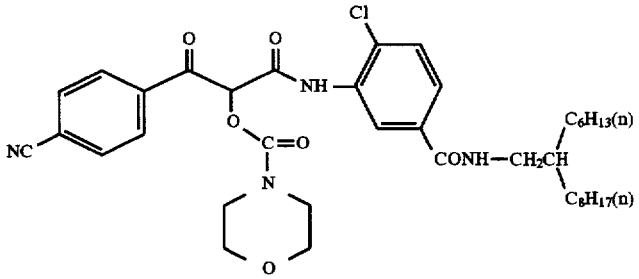

-continued
(C-8)
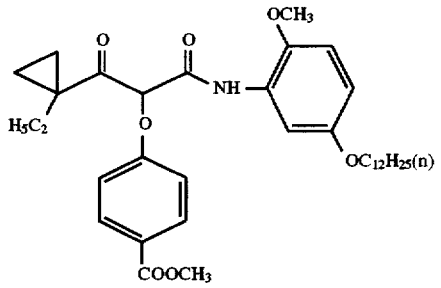
(C-9)
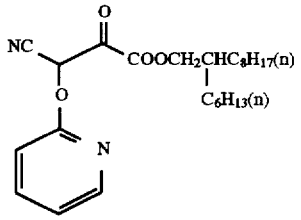
(C-10)
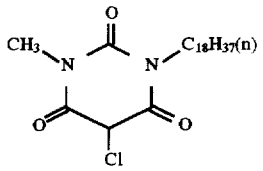
(C-11)
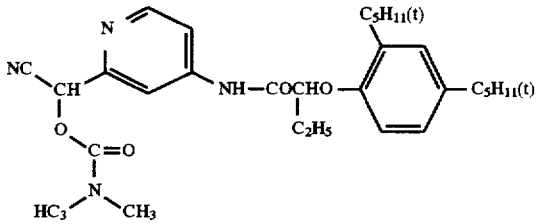
(C-12)
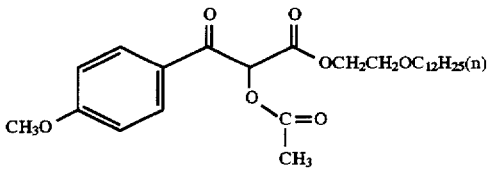
(C-13)
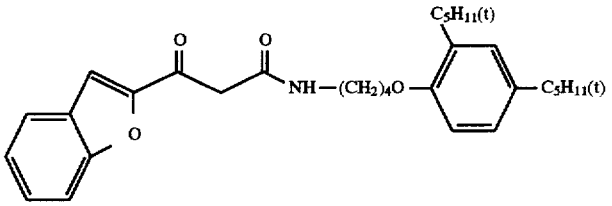
(C-14)
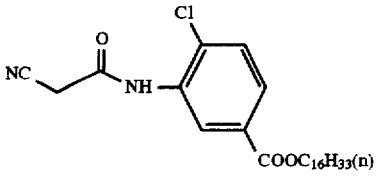

-continued
(C-15)
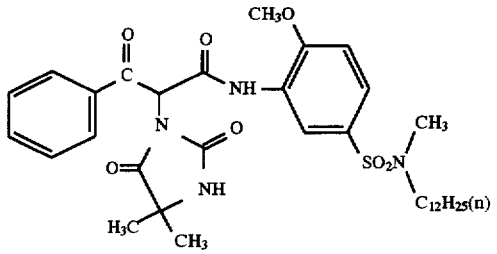
(C-16)
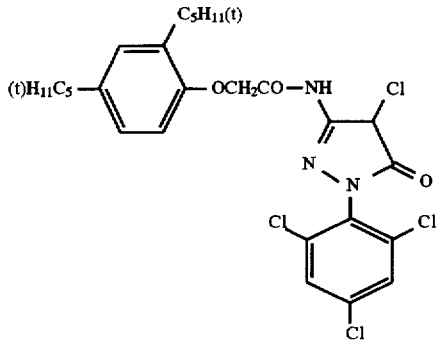
(C-17)
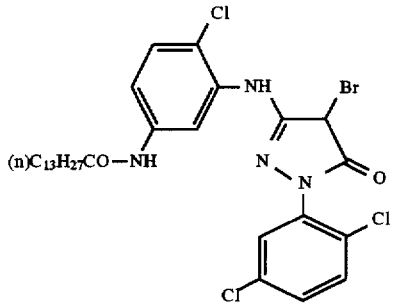
(C-18)
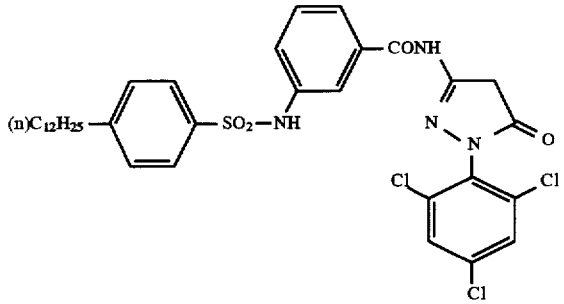
(C-19)
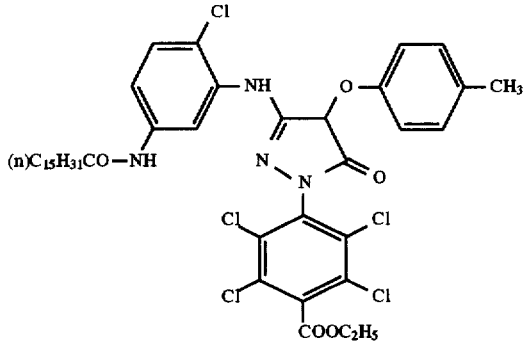

-continued
(C-20)
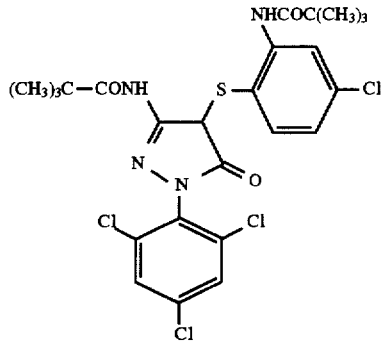
(C-21)
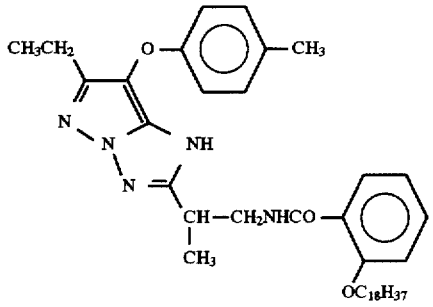
(C-22)
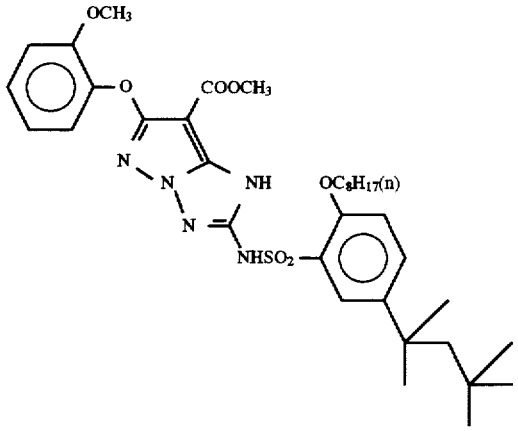
(C-23)
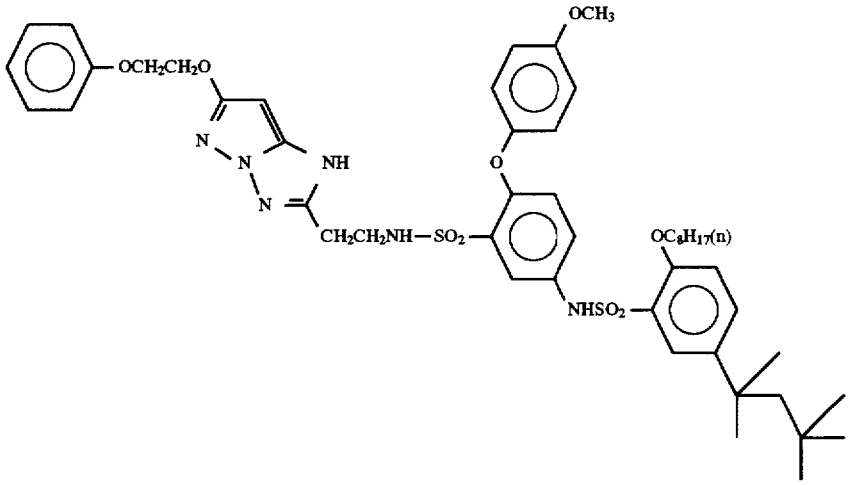

-continued
(C-24)
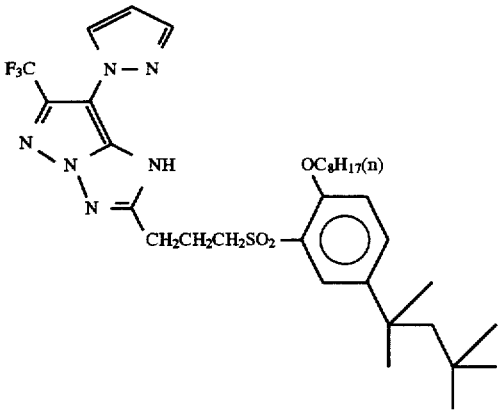
(C-25)
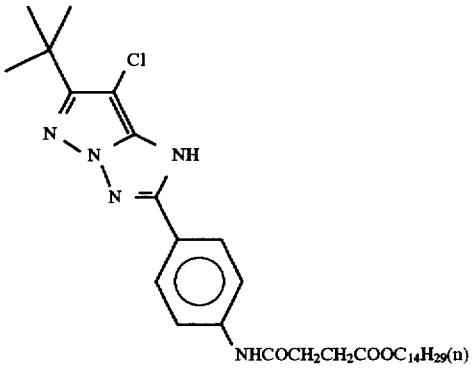
(C-26)
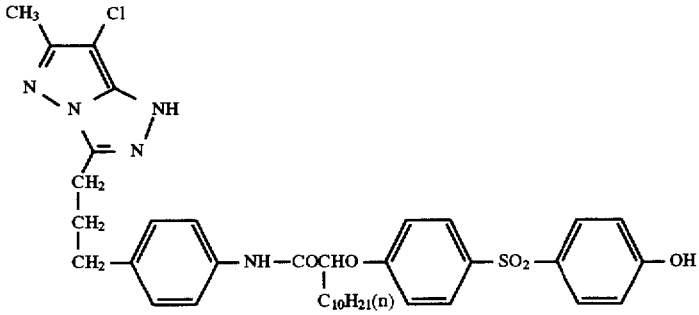

-continued
(C-27)
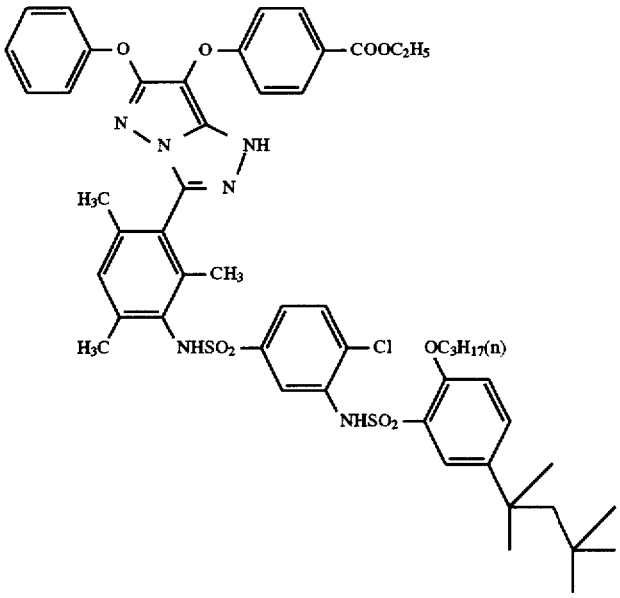
(C-28)
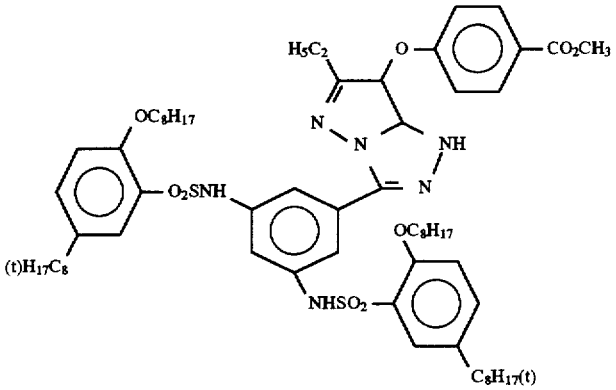
(C-29)
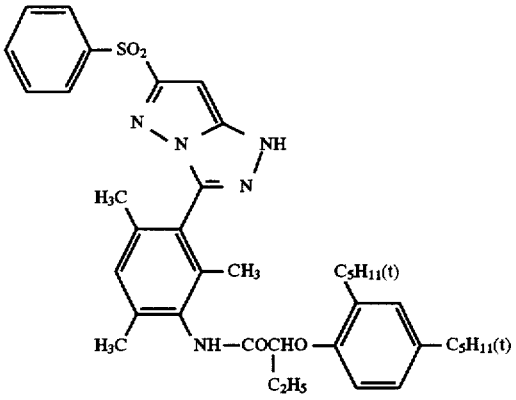

-continued
(C-30)
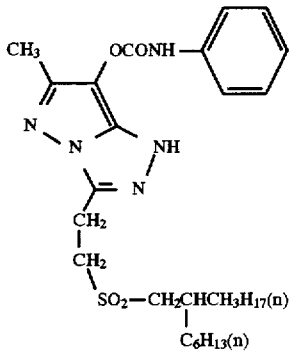
(C-31)
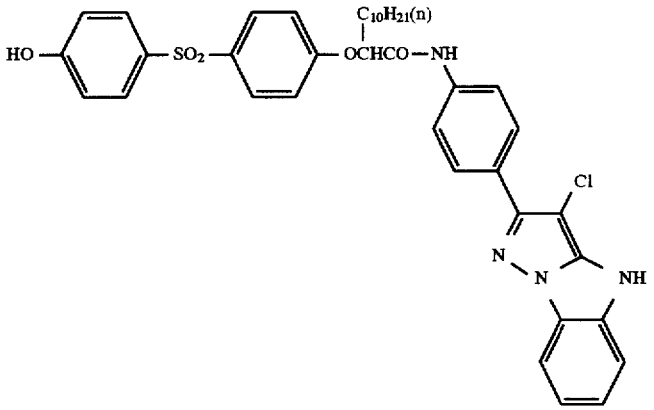
(C-32)
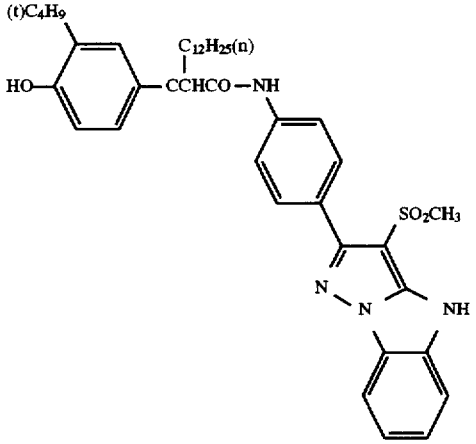
(C-33)
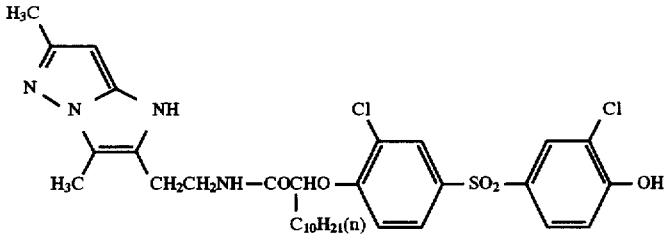

-continued
(C-34)
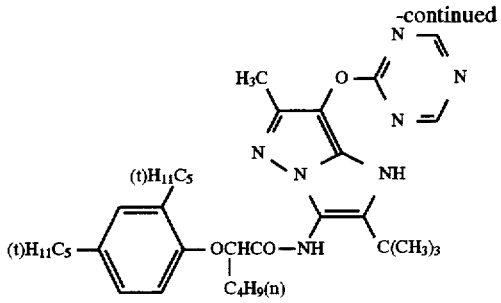
(C-35)
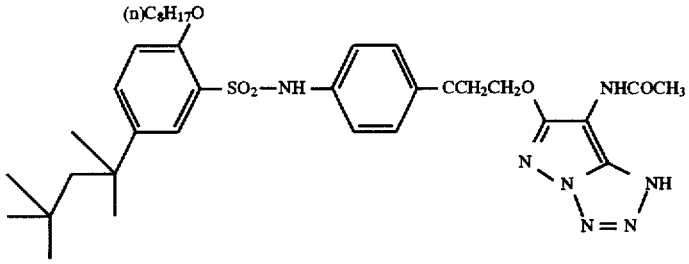
(C-36)
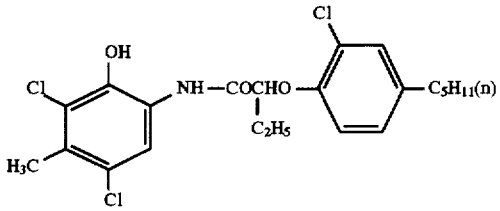
(C-37)
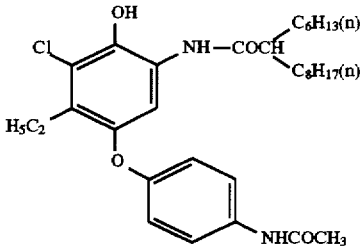
(C-38)
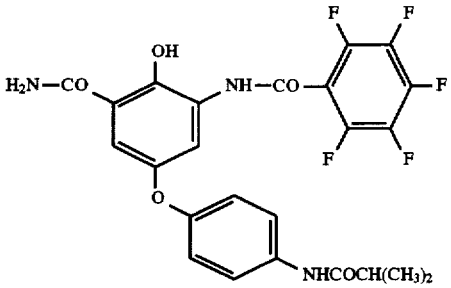
(C-39)
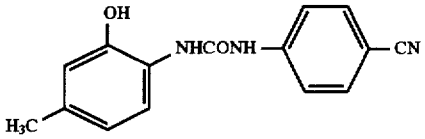
(C-40)
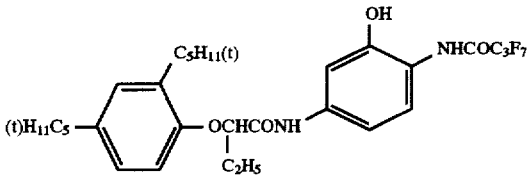

-continued
(C-41)
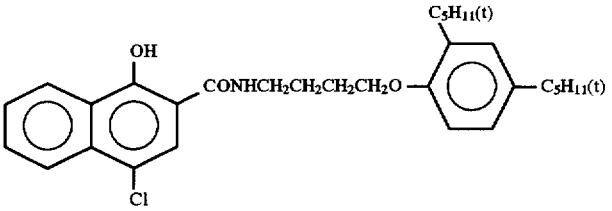
(C-42)
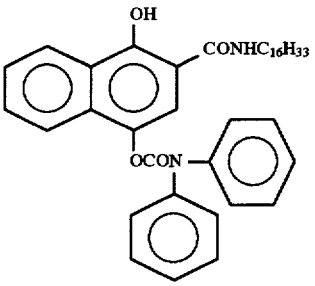
(C-43)
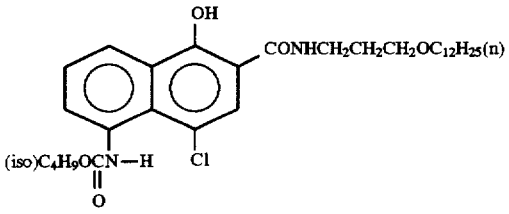
(C-44)
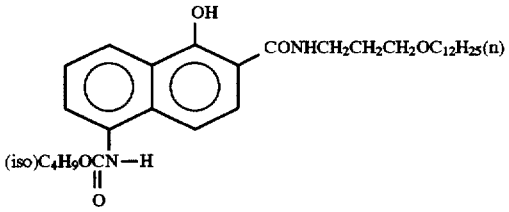
(C-45)
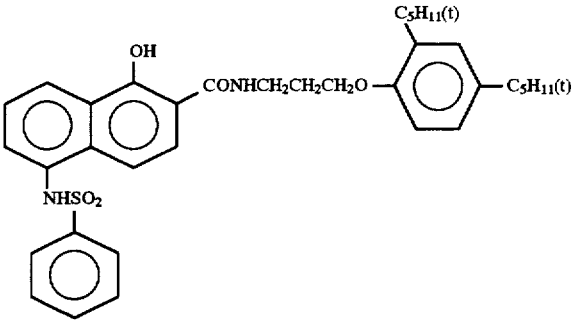

-continued
(C-46)
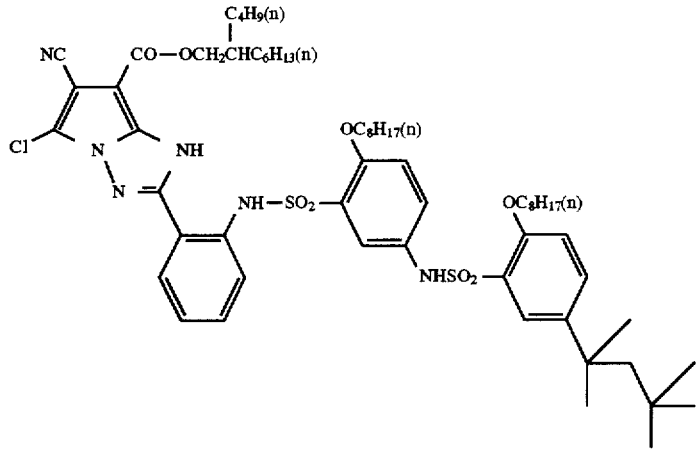
(C-47)
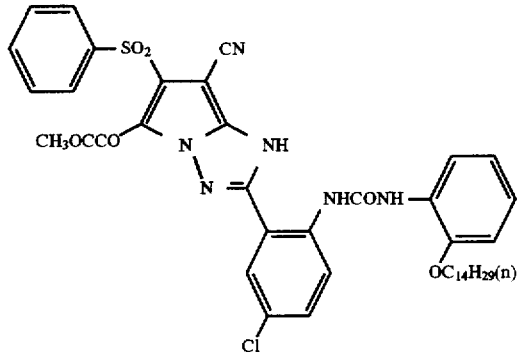
(C-48)
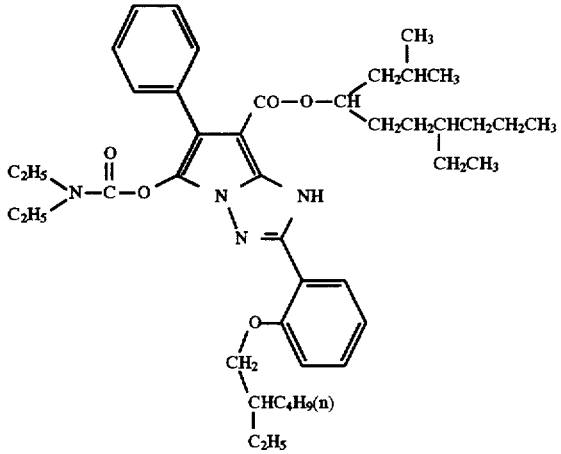
(C-49)
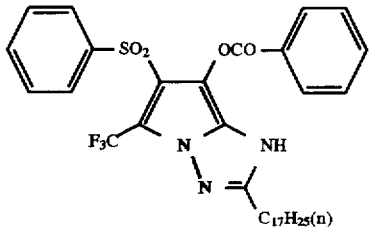

-continued
(C-50)
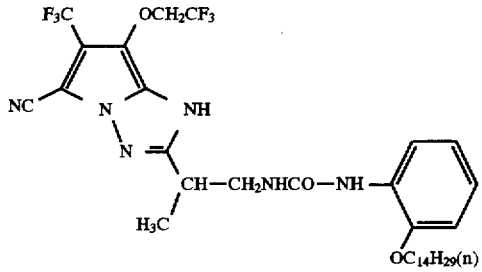
(C-51)
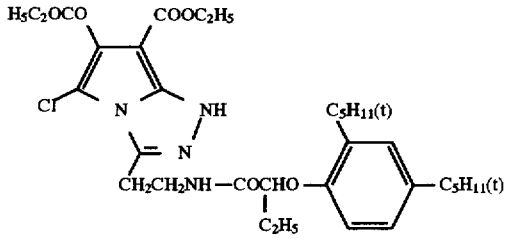
(C-52)
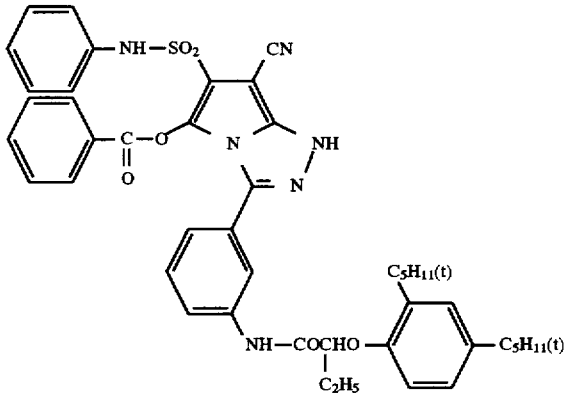
(C-53)
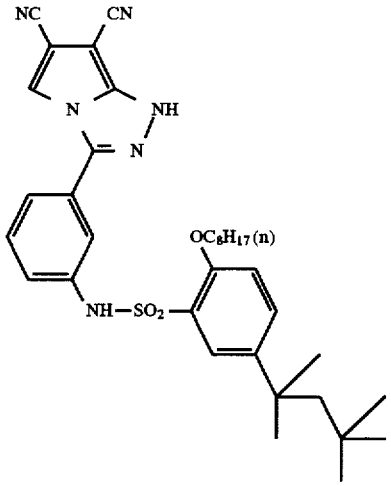

-continued
(C-54)
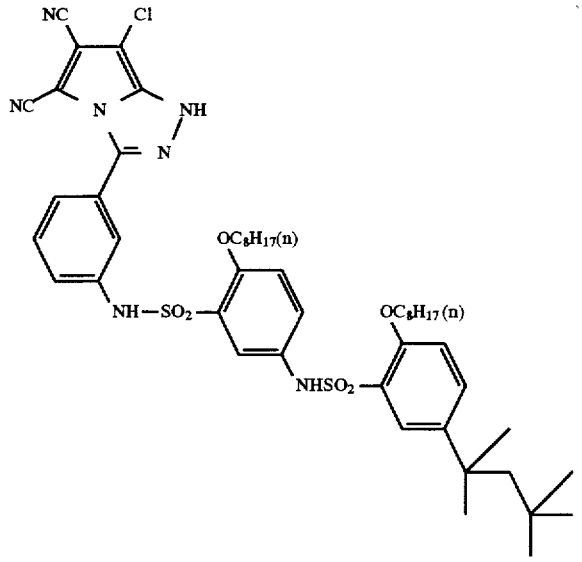
(C-55)
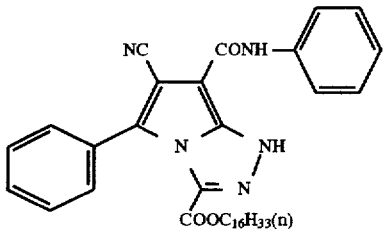
(C-56)
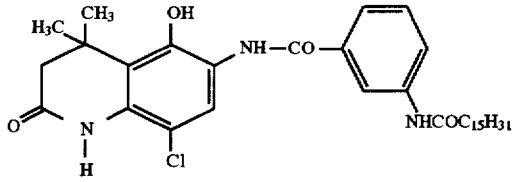
(C-57)
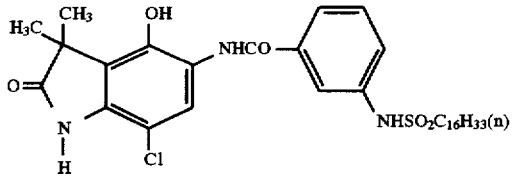
(C-58)
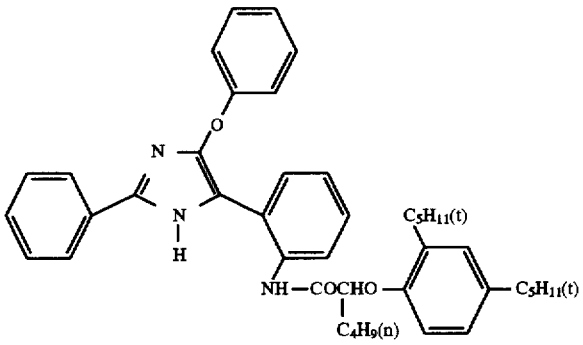

-continued
(C-59)
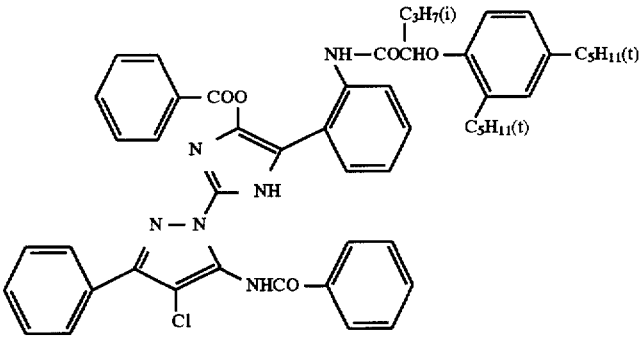
(C-60)
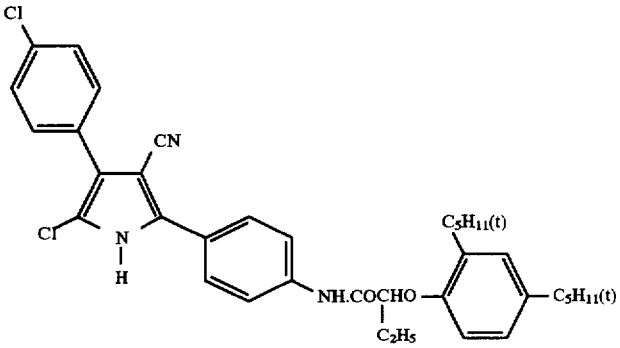
(C-61)
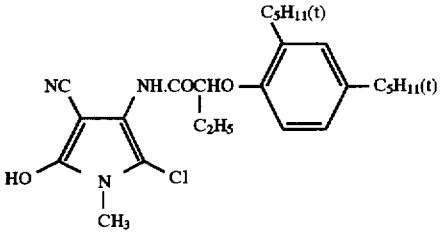
(C-62)
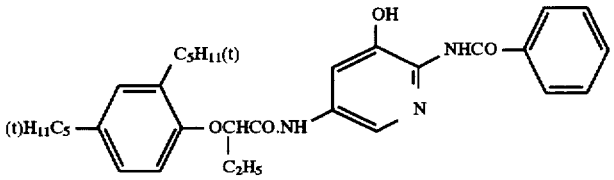
(C-63)
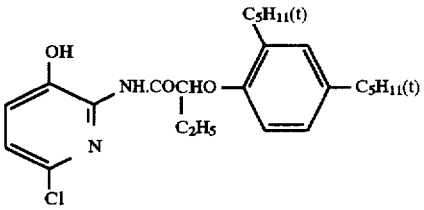
(C-64)
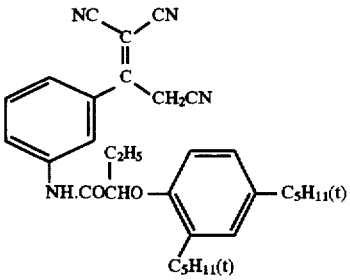

-continued
(C-65)
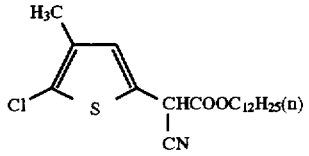
(C-66)
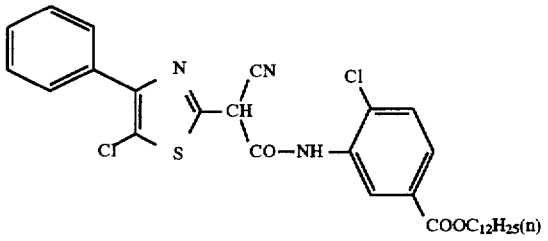
(C-67)
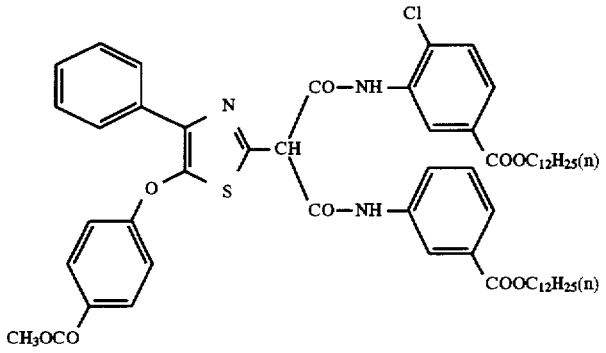
(C-68)
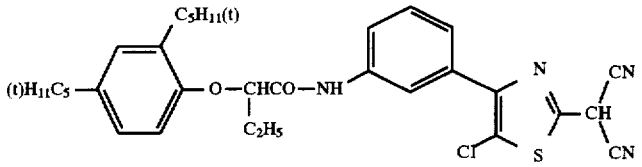
(C-69)
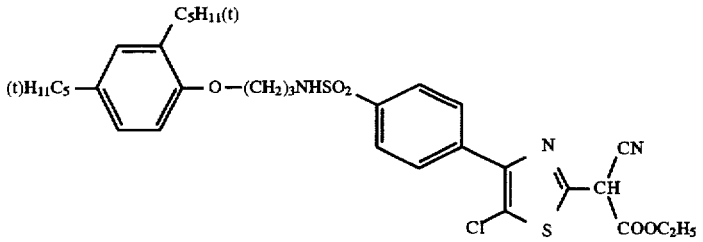
(C-70)
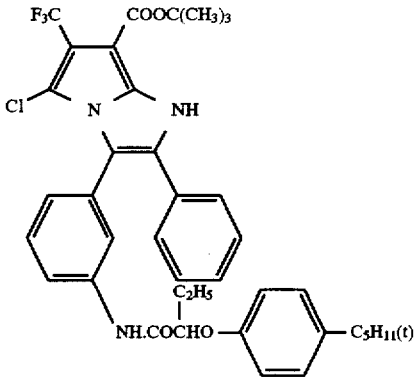

-continued
(C-71)
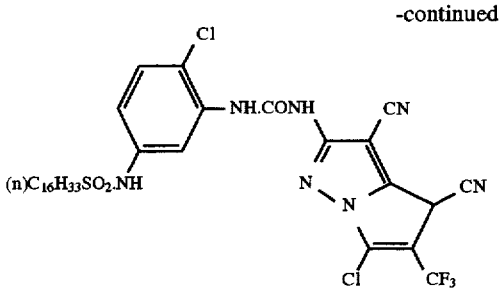
(C-72)
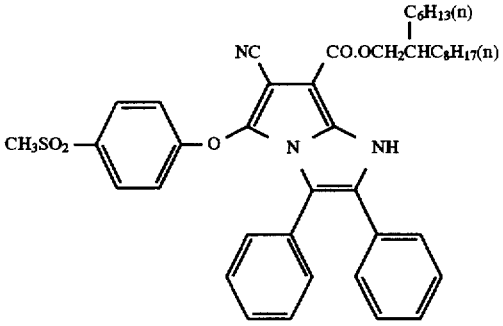
(C-73)
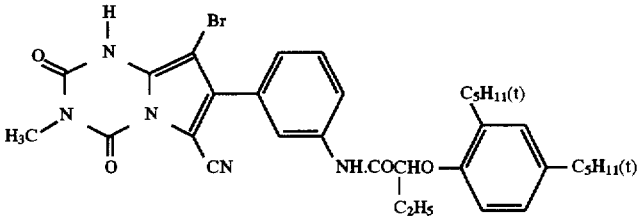
(C-74)
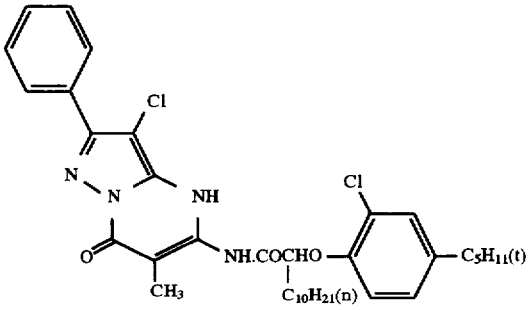
(C-75)
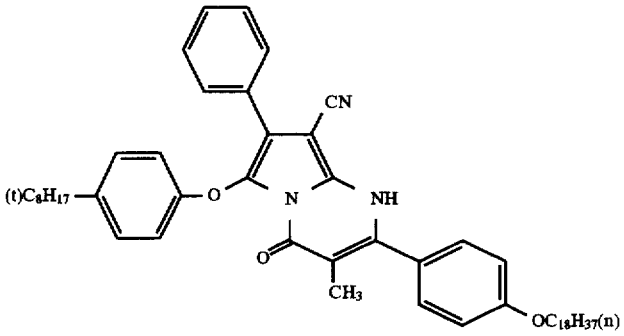
(C-76)
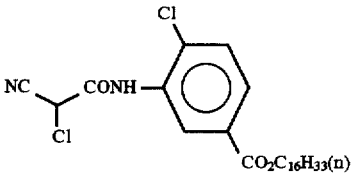

-continued (C-77)

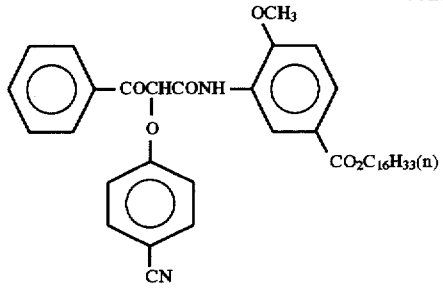

(C-78)

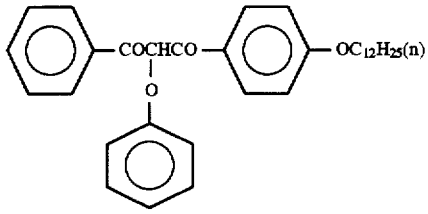

(C-79)

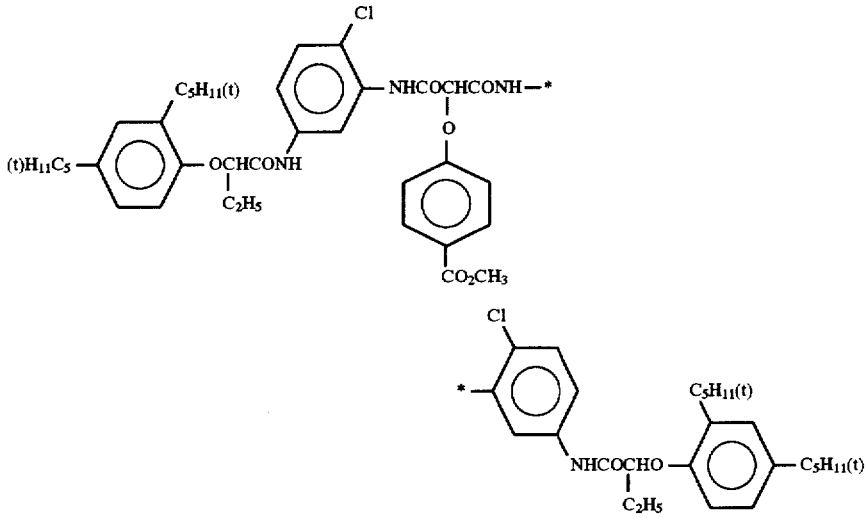

(C-80)

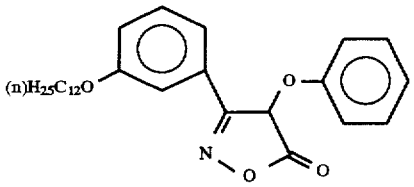

The reducing agent for color formation according to the present invention is preferably used, in order to obtain satisfactory color density, in an amount of from 0.01 to 10 mmol/$m^2$, more preferably from 0.05 to 5 mmol/$m^2$, still more preferably from 0.1 to 1 mmol/$m^2$, per one color forming layer. Within this range, satisfactory color density is advantageously obtained.

The amount of the coupler used in the color forming layer where the reducing agent for color formation according to the present invention is used, is preferably, as a molar ratio to the reducing agent for color formation, from 0.05 to 20 times, more preferably from 0.1 to 10 times, still more preferably from 0.2 to 5 times. Within this range, satisfactory color density is advantageously obtained.

The color light-sensitive material of the present invention fundamentally comprises a support having coated thereon at least one photographic constituent layer comprising a hydrophilic colloid layer, and any one of the photographic constituent layer contains a light-sensitive silver halide, a dye forming coupler and a reducing agent for color formation.

In the most representative embodiment, the dye forming coupler and the reducing agent for color formation used in the present invention are added to the same layer, however, if they are in the state capable of reaction, they may be separately added to different layers. These components are preferably added to a silver halide emulsion layer of the light-sensitive material or a layer adjacent thereto, more preferably added to a silver halide emulsion layer.

The water-insoluble polymer for use in the present invention include those described in International Patent Publication WO88/00723 and JP-A-63-44658.

Among these, particularly preferred in the present invention are vinyl polymers and polyester polymers each having —(C=O)— bond in the repeating unit.

With respect to the vinyl monomer which is preferably used in synthesis of the vinyl polymer for use in the present invention, two or more kinds of monomers can be used as a comonomer to each other depending on various purposes (for example, to improve solubility). Also, in order to control the color forming property or solubility, a monomer having an acid group may be used as a comonomer within the range of not rendering the copolymer water-soluble. Further, a monomer having two or more crosslinkable, ethylenically unsaturated components may be used. Preferred examples of this monomer include those described in JP-A-60-151636.

A hydrophilic monomer (a monomer which becomes water-soluble when formed into a homopolymer) may be used as the vinyl monomer for use in the present invention. However, when the hydrophilic monomer is used as a comonomer and is copolymerized with the other monomer to form a copolymer, the proportion of the hydrophilic monomer in the copolymer is not particularly retricted as long as the copolymer is not rendered water-soluble, however, it is preferably 40 mol % or less, more preferably 20 mol % or less, still more preferably 10 mol % or less. Further, when the hydrophilic comonomer copolymerized with the monomer for use in the present invention has an acid group, in view of the image storability, the comonomer having an acid group is usually contained in the copolymer at a proportion of 20 mol % or less, preferably 10 mol % or less, and most preferably, the above-described comonomer is not contained at all.

The monomer for use in synthesis of the polymer is preferably a methacrylate-base monomer, an acrylamide-base monomer or a methacrylamide-base monomer, more preferably an acrylamide-base monomer or a methacrylamide-base monomer.

The methacrylate-base, acrylamide-base or methacrylamide-base polymer which can be used in the present invention, has a number average molecular weight of preferably from 5,000 to 150,000, more preferably from 10,000 to 100,000.

It is also preferred that the polymer for use in the present invention comprises only a styrene monomer, an α-methylstyrene monomer, a β-methylstyrene monomer or a monomer having a substituent on the benzene ring thereof, however, in this case, the number average molecular weight of the polymer is preferably from 500 to 5,000.

The polyester-base polymer for use in the present invention includes a polyester-base resin obtained by condensing a polyhydric alcohol with a polybasic acid, and a polyester-base resin obtained by ring-opening polymerization.

In preparing the former polyester, effective polyhydric alcohols are glycols and polyalkyl glycol each having a structure of HO—$R_1$—OH (wherein $R_1$ represents a hydrocarbon chain having from 2 to 12 carbon atoms, preferably, an aliphatic hydrocarbon chain), and effective polybasic acids have a structure of HOOC—$R_2$—COOH (wherein $R_2$ represents a mere bond or a hydrocarbon chain having from 1 to 12 carbon atoms). Preferred examples of the polyhydric alcohol and the polybasic acid which are preferably used in the present invention, include those described in JP-A-6-250331.

The monomer used in preparing the latter polyester is preferably a 4-, 5-, 6-, 7-, 8- or 9-membered ring lactone and examples thereof include β-propiolactone, ε-caprolactone and dimethylpropiolactone. The polyester polymer may use, similarly to the vinyl polymer, two or more kinds of polyhydric alcohols, polybasic alcohols or lactone monomers depending upon various purposes.

Also in the case of the polyester-base polymer, a hydrophilic monomer (as described above, a monomer which becomes water-soluble when formed into a homopolymer) can be used as a comonomer, similarly to the vinyl polymer. In this case, the hydrophilic monomer is preferably contained in the copolymer at a proportion as described above with respect to the vinyl polymer.

The term "water-insoluble polymer" as used in the present invention means a polymer having a solubility in 100 g of distilled water (25° C.), of 3 g or less, preferably 1 g or less.

Specific examples of the polymer for use in the present invention are partly set forth below, however, the present invention is by no means limited thereto. In the following specific examples, the copolymerization ratio in respective copolymers is molar ratio.

P-1) Polymethacrylate
P-2) Polyethyl methacrylate
P-3) Polyisopropyl methacrylate
P-4) Polymethyl chloroacrylate
P-5) Poly(2-tert-butylphenyl acrylate)
P-6) Poly(4-tert-butylphenyl acrylate)
P-7) Ethyl methacrylate/n-butyl acrylate copolymer (70:30)
P-8) Methyl methacrylate/acryl nitrile copolymer (65:35)
P-9) Methyl methacrylate/styrene copolymer (90:10)
P-10) N-tert-butyl methacrylamide/methyl methacrylate/acrylic acid copolymer (60:30:10)
P-11) Methyl methacrylate/styrene/vinylsulfonamide copolymer (70:20:10)
P-12) Methyl methacrylate/cyclohexyl methacrylate copolymer (50:50)
P-13) Methyl methacrylate/acrylic acid copolymer (95:5)
P-14) Methyl methacrylate/n-butyl methacrylate copolymer (65:35)
P-15) Methyl methacrylate/N-vinyl-2-pyrrolidone copolymer (90:10)
P-16) Poly(N-sec-butylacrylamide)
P-17) Poly(N-tert-butylacrylamide)
P-18) Polycyclohexyl methacrylate/methyl methacrylate copolymer (60:40)
P-19) n-Butyl methacrylate/methyl methacrylate/acrylamide copolymer (20:70:10)
P-20) Diacetonacrylamide/methyl methacrylate copolymer (20:80)
P-21) N-tert-Butylacrylamide/methyl methacrylate copolymer (40:60)
P-22) Poly(N-n-butylacrylamide)
P-23) tert-Butyl methacrylate/N-tert-butylacrylamide copolymer (50:50)
P-24) tert-Butyl methacrylate/methyl methacrylate copolymer (70:30)
P-25) Poly(N-tert-butylmethacrylamide)
P-26) N-tert-Butylacrylamide/methyl methacrylate copolymer (60:40)
P-51) Poly(2-cyanomethylphenyl methacrylate)
P-52) Poly(4-cyanophenyl methacrylate)
P-53) Poly(cyclohexyl methacrylate)
P-54) Poly(2-hydroxypropyl methacrylate)
P-55) Poly(4-methoxycarbonylphenyl methacrylate)
P-56) Poly(3,5-dimethyladamantyl methacrylate)
P-57) Poly(phenyl methacrylate)
P-58) Poly(4-butoxycarbonylphenylmethacrylamide)
P-59) Poly(4-carboxyphenylmethacrylamide)
P-60) Poly(4-ethoxycarbonylphenylmethacrylamide)
P-61) Poly(4-methoxycarbonylphenylmethacrylamide)
P-62) Poly(cyclohexylchloroacrylate)
P-63) Poly(ethylchloroacrylate)
P-64) Poly(isobutylchloroacrylate)

P-65) Poly(isopropylchloroacrylate)
P-66) Poly(phenylacrylamide)
P-67) Poly(cyclohexylacrylamide)
P-68) Poly(phenylmethacrylamide)
P-69) Poly(cyclohexylmethacrylamide)
P-70) Poly(butylene adipate)
P-71) Polystyrene
P-72) Poly(α-methylstyrene)
P-73) Poly(β-methylstyrene)
P-74) Poly(4-chlorostyrene)
P-75) Poly(4-methoxystyrene)
P-27) Methyl methacrylate/acrylonitrile copolymer (70:30)
P-28) Methyl methacrylate/styrene copolymer (75:25)
P-29) Methyl methacrylate/hexyl methacrylate copolymer (70:30)
P-30) Poly(4-biphenyl acrylate)
P-31) Poly(2-chlorophenyl acrylate)
P-32) Poly(4-chlorophenyl acrylate)
P-33) Poly(pentachlorophenyl acrylate)
P-34) Poly(4-ethoxycarbonylphenyl acrylate)
P-35) Poly(4-methoxycarbonylphenyl acrylate)
P-36) Poly(4-cyanophenyl acrylate)
P-37) Poly(4-methoxyphenyl acrylate)
P-38) Poly(3,5-dimethyladamantyl acrylate)
P-39) Poly(3-dimethylaminophenyl acrylate)
P-40) Poly(2-naphthyl acrylate)
P-41) Poly(phenyl acrylate)
P-42) Poly(N,N-dibutylacrylamide)
P-43) Poly(isohexylacrylamide)
P-44) Poly(isooctylacrylamide)
P-45) Poly(N-methyl-N-phenylacrylamide)
P-46) Poly(adamantyl methacrylate)
P-47) Poly(sec-butyl methacrylate)
P-48) N-tert-Butylacrylamide/acrylic acid copolymer (97:3)
P-49) Poly(2-chloroethyl methacrylate)
P-50) Poly(2-cyanoethyl methacrylate)
P-76) Poly(4-methylstyrene)
P-77) Poly(2,4-dimethylstyrene)
P-78) Poly(4-isopropylstyrene)
P-79) Poly(4-t-butylstyrene)
P-80) Poly(3,4-dichlorostyrene)

The water-insoluble polymer for use in the present invention may be used in any photographic constituent layer of the light-sensitive material so as to prevent stains, however, in view of stabilization of the reducing agent for color formation, it is preferably added to a layer which contains the reducing agent for color formation. Further, in view of stabilization of a dye formed from a reducing agent for color formation and a dye forming coupler, the polymer is preferably added to a layer where the dye produced is fixed.

The method for dispersing a coupler or a reducing agent for color formation using the water-insoluble polymer includes the following methods. In the case when the polymer is a loadable latex, the compound to be dispersed is dissolved in a water-miscible organic solvent and the solution is mixed with the loadable latex to impregnate the compound into the surface of the polymer, thereby obtaining a dispersion (the preparation method is described in detail in U.S. Pat. No. 4,203,716). The polymer is preferably insoluble in water and at the same time soluble in an organic solvent, and in this case, the compound and the water-insoluble and organic solvent-soluble polymer are dissolved in an organic solvent and the solution is emulsion dispersed in a hydrophilic binder such as an aqueous gelatin solution (if desired, using a surface active agent) by a dispersion means such as a stirrer, a homogenizer, a colloid mill, a flow jet mixer or an ultrasonic apparatus (this is described in detail in U.S. Pat. No. 4,857,449 and International Patent Publication WO88/00723).

Furthermore, a combination of a polymer with additives, obtained by suspension polymerizing, solution polymerizing or bulk polymerizing a monomer component of the polymer in the presence of photographic additives, may be dispersed in a hydrophilic binder, whereby the polymer is introduced into the photographic constituent layer (the method is described in detail in JP-A-60-107642).

In the present invention, the amount of the water-insoluble and organic solvent-soluble polymer used in the silver halide color light-sensitive material is, in terms of a weight ratio to the couplers contained in the light-sensitive material, preferably from 0.01 to 2.0, more preferably from 0.1 to 2.0, still more preferably from 0.2 to 1.5. Within this range, the object of the present invention can be advantageously obtained.

Examples of the organic solvent in which the water-insoluble polymer can be dissolved, include ethyl acetate, butyl acetate, methyl ethyl ketone and toluene.

In dissolving the water-insoluble polymer in the above-described low boiling point organic solvent, a high boiling point organic solvent which will be described below, is preferably used so as to increase the coloring property, control the color hue of the dye produced by oxidation coupling, or improve fastness of the image.

In addition, the reducing agent for color formation for use in the present invention and the coupler can be introduced into the light-sensitive material by various known dispersion methods, and preferred is an oil-in-water dispersion method of dissolving them in a high boiling point organic solvent (if desired, using a low boiling point organic solvent in combination), emulsion dispersing the solution in an aqueous gelatin solution and adding the dispersion to a silver halide emulsion. The high boiling point organic solvent which can be used in the present invention, is a water-miscible compound having a melting point of 100° C. or lower, preferably 80° C. or lower, and a boiling point of 140° C. or higher, preferably 160° C. or higher, more preferably 170° C. or higher, and the compound can be used if it is a good solvent of the reducing agent for color formation and the coupler. This high boiling point organic solvent is described in detail in JP-A-62-215272, from page 137, right lower column to page 144, right upper column. In the present invention, when the high boiling point organic solvent is used, the high boiling point organic solvent may be used in any amount, however, the ratio of high boiling point organic solvent/reducing agent for color formation is preferably, in terms of a weight ratio to the reducing agent for color formation, 20 or less, more preferably from 0.02 to 5, still more preferably from 0.2 to 4.

The average particle size of lipophilic fine particles containing the reducing agent for color formation for use in the present invention is not particularly limited, however, in view of the color forming property, it is preferably from 0.05 to 0.3 μm, more preferably from 0.05 to 0.2 μm.

In general, in order to achieve reduction of the average particle size of lipophilic fine particles, the kind of the surface active agent is selected, the amount of the surface active agent used is increased, the viscosity of the hydrophilic colloid solution is elevated, the viscosity of the lipophilic organic layer is reduced, for example, by using a low boiling point organic solvent in combination, the shear force is intensified, for example, the revolution number of the stirring blade of an emulsification apparatus is increased, or the emulsification time is prolonged.

The particle size of a lipophilic fine particle can be measured by an apparatus, for example, Nanosizer manufactured by British Coulter Company.

In the present invention, in the case where the dye produced from the reducing agent for color formation and the dye forming coupler is a diffusible dye, a mordant is preferably added to the light-sensitive material. When the present invention is applied to such a case, color formation dispenses with dipping in an alkali and therefore, the image stability after processing is outstandingly improved. The mordant may be used in any layer, however, when it is added to a layer where the reducing agent for color formation for use in the present invention is contained, stability of the reducing agent for color formation is worsened and therefore, the mordant is preferably used in a layer where the reducing agent for color formation for use in the present invention is not contained. The dye produced from the reducing agent for color formation and the coupler diffuses in a gelatin layer swelled during processing to dye the mordant. Accordingly, in order to obtain good sharpness, the diffusion distance is preferably short. To this effect, the layer where the mordant is added, is preferably a layer adjacent to the layer where the reducing agent for color formation is contained.

The dye produced from the reducing agent for color formation for use in the present invention and the coupler for use in the present invention is a water-soluble dye and therefore, the dye may flow out into the processing solution. Accordingly, in order to prevent this, the layer where the mordant is added, is preferably positioned on the side opposite to the support from the layer where the reducing agent for color formation is contained. However, when a barrier layer is provided on the side opposite to the support from the layer where the mordant is added as described in JP-A-7-168335, the layer where the mordant is added, may be preferably provided on the same side as the support from the layer where the reducing agent for color formation is contained.

The mordant for use in the present invention may be added to a plurality of layers and in particular, when a plurality of layers contain the reducing agent for color formation, the mordant may be preferably added to respective adjacent layers.

The coupler of forming a diffusible dye may be any coupler as long as the diffusible dye formed upon coupling with the reducing agent for color formation for use in the present invention can reach the mordant, however, the diffusible dye formed preferably has one or more dissociation groups having a pKa (acid dissociation constant) of 12 or less, more preferably one or more dissociation groups having a pKa of 8 or less, still more preferably a dissociation group having a pKa of 6 or less. The diffusible dye formed preferably has a molecular weight of from 200 to 2,000, and (the molecular weight of the dye formed/the number of dissociation groups having a pKa of 12 or less) is preferably from 100 to 2,000, more preferably from 100 to 1,000. The pKa used herein is measured using a solvent of dimethylformamide:water =1:1.

The coupler of forming a diffusible dye makes coupling with the reducing agent for color formation for use in the present invention to form a diffusible dye preferably having a solubility such that the dye is dissolved in an alkali solution having a pH of 11 at up to 25° C., in a concentration of $1\times10^{-6}$ mol/l or more, more preferably $1\times10^{-5}$ mol/l or more, still more preferably $1\times10^{-4}$mol/l. Further, the coupler of forming a diffusible dye makes coupling with the reducing agent for color formation for use in the present invention to form a diffusible dye preferably having a diffusion constant measured when the dye is dissolved at a concentration of $10^{-4}$ mol/l in an alkali solution having a pH of 11 at 25° C., of $1\times10^{-8}$ $m^2/s^{-1}$ or more, more preferably $1\times10^{-7}$ $m/s^{-1}$ or more, still more preferably $1\times10^{-6}$ $m^2/s^{-1}$ or more.

The mordant which can be used in the present invention may be freely selected from commonly used mordants, and among these, a polymer mordant is preferred. The term "polymer mordant" as used herein includes a polymer having a tertiary amino group, a polymer having a nitrogen-containing heterocyclic moiety and a polymer containing a quaternary cation group thereof.

Specific examples of the homopolymer or copolymer containing a vinyl monomer unit having a tertiary imidazole group include the mordants described in U.S. Pat. Nos. 4,282,305, 4,115,124 and 3,148,061, JP-A-60-118834, JP-A-60-122941, JP-A-62-244043 and JP-A-62-244036, and those described below.

Specific preferred examples of the homopolymer or copolymer containing a vinyl monomer unit having a quaternary imidazolium salt include the mordants described in British Patents 2,056,101, 2,093,041 and 1,594,961, U.S. Pat. Nos. 4,124,386, 4,115,124 and 4,450,224, and JP-A-48-28325, and those described below.

Specific preferred examples of the homopolymer or copolymer containing a vinyl monomer unit having a quaternary ammonium salt include the mordants described in U.S. Pat. Nos. 3,709,690, 3,898,088 and 3,958,995, JP-A-60-57836, JP-A-60-60643, JP-A-60-122940, JP-A-60-122942 and JP-A-60-235134, and those described below.

Other examples include vinylpyridine polymers and vinylpyridinium cation polymers disclosed in U.S. Pat. Nos. 2,548,564, 2,484,430, 3,148,161 and 3,756,814; polymer mordants crosslinkable with gelatin or the like disclosed in U.S. Pat. Nos. 3,625,694, 3,859,096 and 4,128,538, and British Patent 1,277,453; aqueous sol type mordants disclosed in U.S. Pat. Nos. 3,958,995, 2,721,852 and 2,798,063, JP-A-54-115228, JP-A-54-145529 and JP-A-54-26027; water-insoluble mordants disclosed in U.S. Pat. No. 3,898,088; reactive mordants capable of covalent bonding with a dye disclosed in U.S. Pat. No. 4,168,976 (corresponding to JP-A-54-137333); and the mordants disclosed in U.S. Pat. Nos. 3,709,690, 3,788,855, 3,642,482, 3,488,706, 3,557,066 and 3,271,147, JP-A-50-71332, JP-A-53-30328, JP-A-52-155528, JP-A-53-125 and JP-A-53-1024.

Still other examples include the mordants described in U.S. Pat. Nos. 2,675,316 and 2,882,156.

The polymer mordant for use in the present invention suitably has a molecular weight of from 1,000 to 1,000,000, preferably from 10,000 to 200,000.

The above-described polymer mordant is usually mixed with a hydrophilic colloid before use. The hydrophilic colloid may be a hydrophilic colloid, a highly hygroscopic polymer or a combination thereof, however, gelatin is most representative. The mixing ratio of the polymer mordant to the hydrophilic colloid and the coating amount of the polymer mordant may be easily selected by one skilled in the art according to the amount of dye to be mordanted, the kind or composition of the polymer mordant or the image formation process used, however, the mordant/hydrophilic colloid ratio is suitably from 20/80 to 80/20 (by weight), and the coating amount of the mordant is suitably from 0.2 to 15 $g/m^2$, preferably from 0.5 to 8 $g/m^2$.

In the present invention, an auxiliary developing agent or a precursor thereof is preferably used in the light-sensitive material, and these compounds are described below.

The auxiliary developing agent for use in the present invention is a compound having an action of accelerating transfer of electrons from the reducing agent for color formation to silver halide during development of silver halide grains, preferably a compound capable of developing exposed silver halide grains and oxidizing the reducing agent for color formation by the oxidation product obtained (hereinafter referred to as "cross-oxidation").

The auxiliary developing agent for use in the present invention is preferably a pyrazolidone, a dihydroxybenzene, a reductone or an aminophenol, more preferably a pyrazolidone. These compounds are preferably lower in the diffusibility in a hydrophilic colloid layer, and, for example, the solubility (25° C.) thereof in water is preferably 0.1% or less, more preferably 0.05% or less, particularly preferably 0.01% or less.

The precursor of the auxiliary developing agent for use in the present invention is a compound which may be stably present in the light-sensitive material, however, once processed with a processing solution, swiftly releases the above-described auxiliary developing agent, and also in case of using this compound, the diffusibility thereof in a hydrophilic colloid layer is preferably lower. For example, the solubility (25° C.) thereof in water is preferably 0.1% or less, more preferably 0.05% or less, still more preferably 0.01% or less. The auxiliary developing agent released from the precursor is not particularly restricted on its solubility, however, the auxiliary developing agent itself is preferably lower in the solubility.

The precursor of the auxiliary developing agent for use in the present invention is preferably represented by formula (A):

$$A—(L)_n\text{-PUG} \qquad (A)$$

wherein A represents a block group which cleaves the bond to $(L)_n$-PUG upon development, L represents a linking group which cleaves the bond between L and PUG after the cleavage of the bond between L and A, n represents 0 or an integer of from 1 to 3, and PUG represents an auxiliary developing agent.

As the auxiliary developing agent, electron-emitting compounds according to Kendall-Perutz law other than p-phenylenediamines are used, and the above-described pyrazolidones are preferably used.

As the block group represented by A, the following known block groups may be used. More specifically, the block group includes the block groups such as an acyl group and a sulfonyl group described in U.S. Pat. No. 3,311,476, the block groups using a reverse Michael reaction described in JP-A-59-105642, the block groups using quinonemethide or a compound analogous to quinonemethide by the intramolecular electron transfer described in JP-A-2-280140, the block groups using the intramolecular nucleophilic substitution reaction described in JP-A-63-318555 (corresponding to EP-A-0295729), the block groups using the addition reaction of a nucleophilic agent to a conjugated unsaturated bond described in JP-A-4-186344, the block groups using the A-elimination reaction described in JP-A-62-163051, the block groups using the nucleophilic substitution reaction of diarylmethanes described in JP-A-61-188540, the block groups using a Lossen rearrangement reaction described in JP-A-62-187850, the block groups using the reaction of an N-acyl form of thiazolidine-2-thione with an amine described in JP-A-62-147457, and the block groups having two electrophilic groups, which react with a dinucleophile reagent described in International Patent Publication 93/03419.

The group represented by L is a linking group capable of cleaving the bond of $(L)_{n-1}$-PUG after release from the group represented by A upon development, and the group is not particularly limited if it has this function.

Specific examples of the auxiliary developing agent and the precursor thereof are set forth below, but the compounds for use in the present invention are by no means limited to these specific examples.

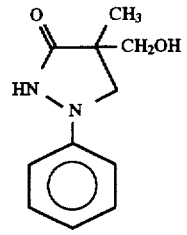

(ETA-1)

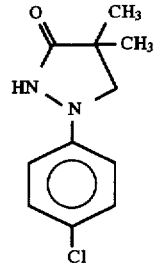

(ETA-2)

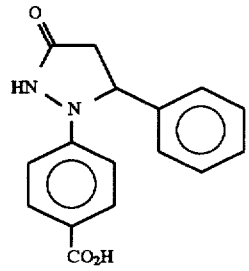

(ETA-3)

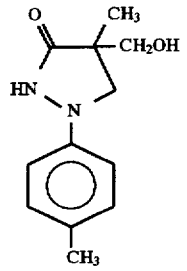

(ETA-4)

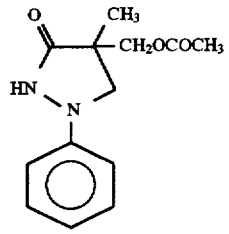

(ETA-5)

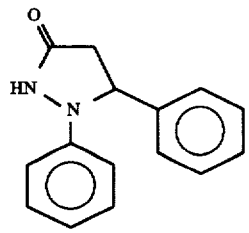

(ETA-6)

-continued
(ETA-7)
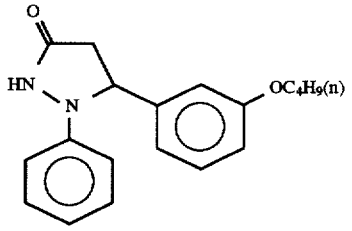
(ETA-8)
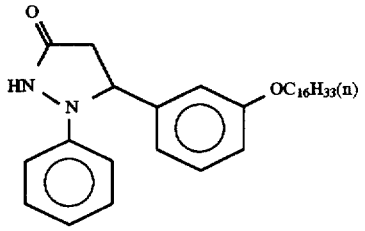
(ETA-9)
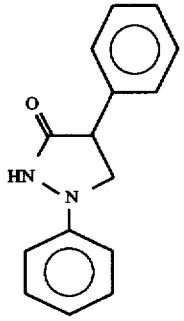
(ETA-10)
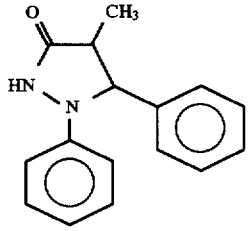
(ETA-11)
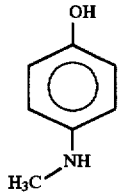
(ETA-12)
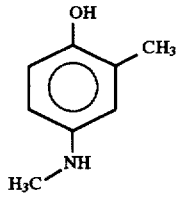
(ETA-13)
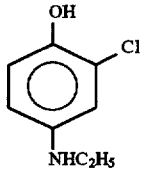
-continued
(ETA-14)
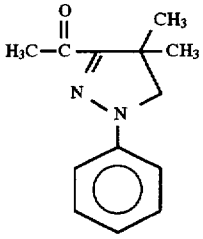
(ETA-15)
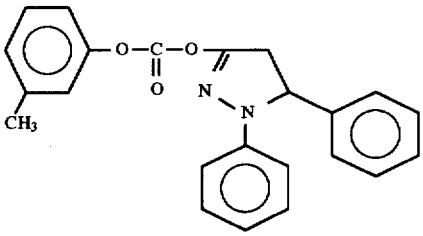
(ETA-16)
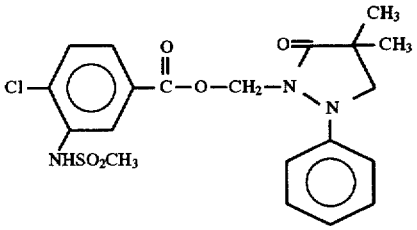
(ETA-17)
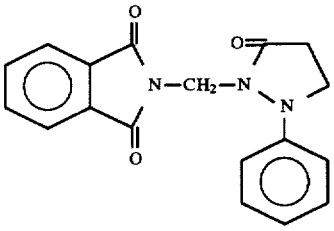
(ETA-18)
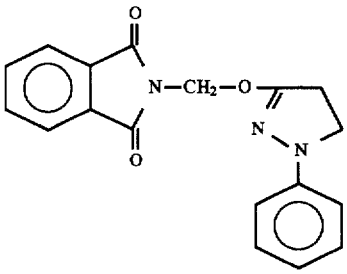
(ETA-19)
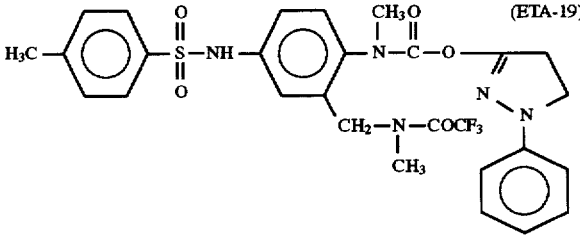

-continued (ETA-20)

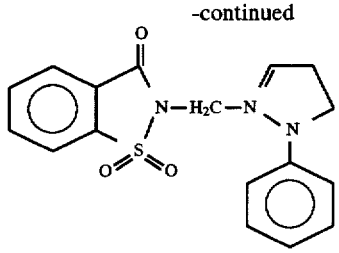

These compounds may be added to any of the light-sensitive layer, the interlayer, the undercoat layer and the protective layer, however, when the auxiliary developing agent is incorporated, it is preferably added to a light-insensitive layer.

The compound may be incorporated into the light-sensitive material by a method where the compound is dissolved in a water-miscible organic solvent such as methanol and then added directly to a hydrophilic colloid layer, a method where the compound is formulated into an aqueous solution or colloid dispersion in the presence of a surface active agent and then added, a method where the compound is dissolved in a substantially water-immiscible solvent or oil, then dispersed in water or hydrophilic colloid and then added, or by a method where the compound is added in the state of a solid fine particle dispersion, and these conventionally known methods may be used individually or in combination. The preparation method of a solid fine particle dispersion is described in detail in JP-A-2-235044, page 20.

The addition amount of the auxiliary developing agent to the light-sensitive material is, based on the reducing agent for color formation, from 1 to 200 mol %, preferably from 5 to 100 mol %, more preferably from 10 to 50 mol %.

The support for use in the present invention may be any transparent or reflective support as long as it is a support on which photographic emulsion layers can be coated, such as glass, paper or plastic film. The plastic film for use in the present invention includes a polyester film such as polyethylene terephthalate, polyethylene naphthalate, cellulose triacetate and cellulose nitrate, a polyamide film, a polycarbonate film and a polystyrene film.

The "reflective support" which can be used in the present invention means a support increased in the reflectivity so as to render the dye image formed on the silver halide emulsion layer sharp, and the reflective support includes a support covered with a hydrophobic resin having dispersed therein a light-reflective substance such as titanium oxide, zinc oxide, calcium carbonate or calcium sulfate, and a hydrophobic resin itself having dispersed therein a light-reflective substance and used as a support. Examples thereof include polyethylene-coated paper, polyester-coated paper, polypropylene-base synthetic paper and a support having provided thereon a reflection layer or using a reflective substance in combination, such as a glass plate, a polyester film (e.g., polyethylene terephthalate, cellulose triacetate, cellulose nitrate), a polyamide film, a polycarbonate film, a polystyrene film and a vinyl chloride resin. As the polyester-coated paper, the polyester-coated paper comprising polyethylene terephthalate as a main component described in European Patent 0507489 is particularly preferred.

The reflective support for use in the present invention is preferably a paper support of which both surfaces are covered with waterproof resin layers, with at least one of the waterproof resin layers containing white pigment fine particles. The white pigment particles are preferably contained at a density of 12 wt % or more, more preferably 14 wt % or more. The light-reflective white pigment is preferably obtained by thoroughly kneading a white pigment in the presence of a surface active agent and further by treating the surface of a pigment particle with di-, tri- or tetra-hydric alcohol.

In the present invention, a support having a surface of second-class diffuse reflection property is preferably used. The second-class diffuse reflection property means a diffuse reflection property obtained when the specular surface is made uneven to have finely divided specular faces directed toward different directions. The unevenness on the surface of second-class diffuse reflection property is preferably such that the three-dimensional average height to the center plane is from 0.1 to 2 μm, preferably from 0.1 to 1.2 μm, and such a support is described in detail in JP-A-2-239244.

In order to obtain colors over a wide range on the chromaticity diagram using three primary colors of yellow, magenta and cyan, at least three silver halide emulsion layers having sensitivity in different spectral regions are used in combination. For example, a three-layer combination consisting of a blue-sensitive layer, a green-sensitive layer and a red-sensitive layer or of a green-sensitive layer, a red-sensitive layer and an infrared-sensitive layer may be coated on the above-described support. Respective light-sensitive layers may be arranged in various orders known for usual color light-sensitive materials. Further, each light-sensitive layer may be divided into two or more layers, if desired.

The light-sensitive material may comprise a photographic constituent layers comprising the above-described light-sensitive layer and various light-insensitive layers such as a protective layer, an undercoat layer, an interlayer, an anti-halation layer and a back layer. Further, various filter dyes may be added to the photographic constituent layer so as to improve the color separation property.

Gelatin is advantageously used as a binder or a protective colloid which can be used in the light-sensitive material of the present invention, however, a hydrophilic colloid other than gelatin may be used alone or in combination with gelatin. The calcium content of gelatin is preferably 800 ppm or less, more preferably 200 ppm or less, and the iron content of gelatin is preferably 5 ppm or less, more preferably 3 ppm or less. Further, an antimold as described in JP-A-63-271247 is preferably added for preventing proliferation of various molds or bacteria in the hydrophilic colloidal layer, which deteriorate an image.

At the time when the light-sensitive material of the present invention is subjected to printer exposure, a band stop filter described in U.S. Pat. No. 4,880,726 is preferably used. By using this filter, color mixing is eliminated and color reproduction is outstandingly improved.

The light-sensitive material of the present invention is used in a print system using a normal negative printer and in addition, it is preferably used in digital scan exposure using a monochromatic high density light such as a gas laser, a light emitting diode, a semiconductor laser or a second harmonic generation (SHG) light source as a combination of a semiconductor laser or a solid state laser using a semiconductor laser as an excitation light source with a nonlinear optical crystal. In order to achieve a compact and cheap system, the semiconductor laser or the second harmonic generation (SHG) light source as a combination of a semiconductor laser or a solid state laser with a nonlinear optical crystal is preferably used. In particular, in order to design a compact and cheap apparatus having a long life and high stability, the semiconductor laser is preferably used and at least one of light sources for exposure is preferably a semiconductor laser.

In using the above-described light source for scan exposure, the spectral sensitivity maximum of the light-sensitive material of the present invention can be freely selected depending upon the wavelength of the light source used for scan exposure. In the case of an SHG light source obtained by combining a solid state laser using a semiconductor laser as an excitation light source or a semiconductor laser with a nonlinear optical crystal, the oscillation wavelength of the laser can be reduced to a half and therefore, blue light and green light can be obtained. Accordingly, the light-sensitive material can have a spectral sensitivity maximum in normal three regions of blue, green and red. When a semiconductor laser is used as a light source for achieving a cheap, highly stable and compact apparatus, it is preferred that at least two layers have a spectral sensitivity maximum at 670 nm or more. This is because the semiconductor laser of Group III-V series, which is available, cheap and stable, has an emission wavelength region in the region of from red to infrared at present. However, on a laboratory level, oscillation of Group II-VI series semiconductor laser in green and blue regions is confirmed and it is well expected that if the production technique of semiconductor lasers is developed, the above-described semiconductor laser could be used cheaply and stably. If so, the necessity that at least two layers must have a spectral sensitivity maximum at 670 nm or more would be diminished.

In the scan exposure, the exposure time of the silver halide in a light-sensitive material is a time period required to expose a certain fine area. The fine area is generally a minimum unit capable of controlling the quantity of light from respective digital data and called a pixel. Accordingly, the exposure time per pixel varies depending on the size of the pixel. The size of the pixel depends on the pixel density which is practically in the range of from 50 to 2,000 dpi. If the exposure time is defined as the time required to expose a pixel in a size such that the pixel density is 400 dpi, the exposure time is preferably $10^{-4}$ second or less, more preferably $10^{-6}$ second or less.

The silver halide grain for use in the present invention is silver bromide, silver chloride, silver iodide, silver chlorobromide, silver chloroiodide, silver iodobromide or silver chloroiodobromide. A silver salt other than these, for example, silver rhodanide, silver sulfide, silver selenide, silver carbonate, silver phosphate or organic acid silver, may be contained as a separate grain or a part of silver halide grains. When rapid development and desilvering (e.g., bleaching, fixing, bleach-fixing) are desired, a so-called high silver chloride grain having a silver chloride content of 90 mol % or more is preferred. Further, when the development is appropriately suppressed, silver iodide is preferably contained. The preferred silver iodide content varies depending upon the light-sensitive material as an objective.

The high silver chloride emulsion for use in the present invention preferably has a structure such that a silver bromide localized phase in the layer or non-layer form is present in the inside and/or on the surface of a silver halide grain. The halogen composition of the above-described localized phase preferably has a silver bromide content of at least 10 mol %, more preferably exceeding 20 mol %. The silver bromide content in the silver bromide localized phase can be analyzed using an X-ray diffraction method (described, for example, in Nippon Kagaku-kai (compiler), *Shin Jikken Kagaku Koza 6, Kozo Kaiseki* (New Experiment and Chemistry Lecture 6, Analysis of Structure), Maruzen). The localized phase may be present in the inside of a grain, or at edges, corners or on planes of a grain surface. One preferred example is a localized phase epitaxially grown at corners of a grain.

Also, it is effective to further increase the silver chloride content of the silver halide emulsion so as to reduce the replenishing amount of development processing solution. If the case is so, an almost pure silver chloride emulsion having a silver chloride content of from 98 to 100 mol % is also preferably used.

The silver halide emulsion for use in the present invention preferably has a distribution or a structure with respect to the halogen composition in the grain. Typical examples thereof are disclosed in JP-B-43-13162 (the term "JP-B" as used herein means an "examined Japanese patent publication"), JP-A-61-215540, JP-A-60-222845, JP-A-60-143331, JP-A-61-75337 and JP-A-60-222844.

In order to let the inside of a grain have a structure, not only the wrapped structure as described above but also a so-called junction structure may be formed in the grain. Examples thereof are described in JP-A-59-133540, JP-A-58-108526, EP-A-199290, JP-B-58-24772 and JP-A-59-16254.

In the case of the junction structure, a silver halide and a silver halide can of course be combined but a silver salt compound not having a rock-salt structure, such as silver rhodanide and silver carbonate, can be combined with silver halide to provide a junction structure.

In the case of a silver iodobromide grain or the like having a structure described above, the silver iodide content of the core part is preferably higher than that of the shell part. On the contrary, in some cases, it is preferred that the silver iodide content of the core part is low and that of the shell part is high. Similarly, in the case of a grain having a junction structure, the host crystal may have a high silver iodide content and the joined crystal may have a relatively low silver iodide content, and the reverse thereof may also be used. The boundary between portions different in the halogen composition of a grain having the above-described structure may be either clear or unclear. Also, it is a preferred embodiment to positively provide a continuous change in the composition.

In the case of a silver halide grain where two or more silver halides are present as a mixed crystal or to form a structure, control of the halogen composition distribution among grains is important. The measuring method of the halogen composition distribution among grains is described in JP-A-60-254032. In particular, an emulsion having a high uniformity such that the coefficient of variation is 20% or less is preferred.

Control of the halogen composition in the vicinity of the grain surface is important. To increase the silver iodide content or silver chloride content in the vicinity of the surface is accompanied by change in the adsorptivity of a dye or in the developing rate and therefore, the control may be selected depending upon the purpose.

The silver halide grain for use in the present invention may be a regular crystal free of twin planes or a crystal described in Nippon Shashin Gakkai (compiler), *Shashin Koqyo no Kiso, Gin-en Shashin Hen* (Primary Study of Photographic Industry, Silver Salt Photograph), p. 163 (Corona Sha) (1979), such as a parallel multiple twin crystal containing two or more parallel twin planes or a non-parallel multiple twin crystal containing two or more non-parallel twin planes, and these crystals may be selected depending upon the purpose. An example of the method of mixing grains having different forms is disclosed in U.S. Pat. No. 4,865,964. In the case of a regular crystal, a cubic grain comprising a (100) face, an octahedral grain comprising a (111) face or a dodecahedral grain comprising a (110) face disclosed in JP-B-55-42737 and JP-A-60-222842 may be used. Further, as reported in *Journal of Imaging Science*, Vol. 30, p. 247 (1986), a (hlm) face grain may also be selected. A grain having two kinds of or a plurality kinds of faces together may also be selected and used depending on the purpose, and examples thereof include a tetradecahedral grain having a (100) face and a (111) face together in one grain, a grain having (100) face and a (110) face together and a grain having a (111) face and a (110) face together.

The value obtained by dividing a circle-corresponding diameter of a projected area by a grain thickness is called an aspect ratio and the form of a tabular grain is defined by the aspect ratio. Tabular grains having an aspect ratio of 1 or more can be used in the present invention. The tabular grain can be prepared according to the methods described in Cleve, *Photography Theory and Practice*, p. 131 (1930), Gutoff, *Photographic Science and Engineering*, Vol. 14, pp. 248–257 (1970), U.S. Pat. Nos. 4,434,226, 4,414,310, 4,433,048 and 4,439,520 and British Patent 2,112,157. Use of a tabular grain is advantageous in that the covering power is elevated or the spectral sensitization efficiency by a sensitizing dye is increased, and U.S. Pat. No. 4,434,226 cited above describes this in detail. The average aspect ratio of 80% or more of the total projected area of grains is preferably from 1 to less than 100, more preferably from 2 to less than 20, particularly preferably from 3 to less than 10. The form of the tabular grain may be selected from a triangle, a hexagon or a circle. A equilateral hexagon consisting of six sides having nearly the same length described in U.S. Pat. No. 4,797,354 is a preferred embodiment.

A circle-corresponding diameter of a projected area is often used as a grain size of a tabular grain, and grains having an average diameter of 0.6 μm or less described in U.S. Pat. No. 4,748,106 are preferred to achieve high image quality. Also, an emulsion having a narrow grain size distribution described in U.S. Pat. No. 4,775,617 is preferred. With respect to the shape of a tabular grain, the grain thickness is preferably reduced to 0.5 μm or less, more preferably 0.3 μm or less, so as to increase the sharpness. An emulsion having high uniformity such that the coefficient of variation of the grain thickness is 30% or less is also preferred. Further, a grain of which grain thickness and face-to-face dimension of the twin planes are prescribed, as described in JP-A-63-163451, is also preferred.

It is preferred to select a grain containing no dislocation line, a grain containing several dislocation lines or a grain containing a large number of dislocation lines depending upon the purpose. Also, a grain containing dislocation lines which are integrated linearly into or distorted toward a specific direction of the crystal orientation may also be selected. The dislocation lines may be integrated throughout the grain or may be integrated into a specific part of the grain, for example, the dislocation lines may be integrated only to a fringe part of the grain. The dislocation lines are preferably integrated not only to a tabular grain but also to a regular crystal grain or an amorphous grain represented by a pebble-like grain.

The silver halide emulsion for use in the present invention may be subjected to treatment for rounding a grain as disclosed in EP-B-96727 and EP-B-64412 or may be subjected to surface modification as disclosed in West German Patent 2,306,447C2 and JP-A-60-221320.

The grain surface generally has a flat structure but in some cases, unevenness is preferably provided thereon with intention. This is described in JP-A-58-106532, JP-A-60-221320 and U.S. Pat. No. 4,643,966.

The grain size of the emulsion for use in the present invention can be verified by a circle-corresponding diameter of a projected area measured using an electron microscope, a sphere-corresponding diameter of the grain volume calculated from the projected area and the grain thickness, or a sphere-corresponding diameter of the volume according to a coulter counter method. In terms of a sphere-corresponding diameter, a grain may be selected over a wide range of from an ultrafine grain having a grain size of 0.01 μm or less to a giant grain having a grain size in excess of 10 μm. Preferably, a grain having a grain size of from 0.1 to 3 μm is used as a light-sensitive silver halide grain.

The emulsion for use in the present invention may be selected from a so-called polydisperse emulsion having a broad grain size distribution and a monodisperse emulsion having a narrow size distribution, depending upon the purpose. As a measure for expressing the size distribution, a coefficient of variation in the circle-corresponding diameter of the projected area of a grain or in the sphere-corresponding diameter of the volume of a grain may be used. In the case of using a monodisperse emulsion, the emulsion used preferably has a coefficient of variation in the size distribution of 25% or less, more preferably 20% or less, still more preferably 15% or less.

In order to satisfy the gradation required for the light-sensitive material, within the emulsion layers having substantially the same spectral sensitivity, two or more kinds of monodisperse silver halide emulsions having different grain sizes may be mixed in the same layer or may be coated as separate layers by superposing one on another. Further, two or more kinds of polydisperse silver halide emulsions or a combination of a monodisperse emulsion and a polydisperse emulsion may be mixed or superposed.

The photographic emulsion for use in the present invention can be prepared according to the methods described in P. Glafkides, *Chimie et Phisique Photographique*, Paul Montel (1967), G. F. Duffin, *Photographic Emulsion Chemistry*, The Focal Press (1966) and V. L. Zelikman et al, *Making and Coating Photographic Emulsion*, The Focal Press (1964). Also, a method of forming grains in the excess of silver ions (so-called reverse mixing process) may be used. A so-called controlled double jet method, which is one system of the double jet method, of keeping constant the pAg of the liquid phase where the silver halide is formed may also be used. According to this method, the silver halide emulsion obtained can have a regular crystal form and a nearly uniform grain size.

In some cases, a method of adding silver halide grains previously precipitated and formed in a reaction vessel for the preparation of an emulsion described in U.S. Pat. Nos. 4,334,012, 4,301,241 and 4,150,994 is preferred. The grain may be used as a seed crystal or may be supplied as a silver halide for growth, and this is effective. Further, in order to modify the surface, it is effective in some cases to add fine grains of various halogen compositions.

A method of converting a majority part or merely a part of the halogen composition of a silver halide grain by halogen conversion is disclosed in U.S. Pat. Nos. 3,477,852 and 4,142,900, European Patents 273429 and 273430 and West German Patent Application (OLS) 3,819,241. In order to effect conversion into a further difficultly soluble silver salt, a soluble halogen solution or silver halide grains may be added.

With respect to the grain growth, in addition to the method of adding a soluble silver salt and a halogen salt at a constant concentration and at a constant flow rate, a method of forming grains by varying the concentration or varying the flow rate as described in British Patent 1,469,480 and U.S. Pat. Nos. 3,650,757 and 4,242,445 is preferred. By increasing the concentration or increasing the flow rate, the amount of silver halide supplied can be varied according to linear function, secondary function or more complicated function of the addition time.

The mixing vessel used on reaction of a soluble silver salt with a soluble halogen salt solution may be selected from those used in the methods described in U.S. Pat. Nos. 2,996,287, 3,342,605, 3,415,650 and 3,785,777 and West German Patent Applications (OLS) 2,556,885 and 2,555,364.

For the purpose of accelerating the ripening, a silver halide solvent is useful. For example, it is known to let an excessive amount of halogen ions be present in a reaction vessel so as to accelerate ripening. Other ripening agent may also be used. The ripening agent may be wholly blended into a dispersion medium in the reaction vessel before adding a silver salt and a halide salt or may be introduced into the reaction vessel together with the addition of a halide salt, a silver salt or a deflocculant.

Examples thereof include ammonia, thiocyanates (e.g., potassium thiocyanate, ammonium thiocyanate), organic thioether compounds (e.g., compounds described in U.S. Pat. Nos. 3,574,628, 3,021,215, 3,057,724, 3,038,805, 4,276,374, 4,297,439, 3,704,130 and 4,782,013, JP-A-57-104926), thione compounds (e.g., tetra-substituted thiourea described in JP-A-53-82408, JP-A-55-77737 and U.S. Pat. No. 4,221,863, compounds described in JP-A-53-144319), mercapto compounds capable of accelerating growth of silver halide grains described in JP-A-57-202531, and amine compounds (e.g., those described in JP-A-54-100717). Gelatin is advantageous as a protective colloid for use in the preparation of the emulsion according to the present invention or as a binder in other hydrophilic colloid layers, however, a hydrophilic colloid other than gelatin may also be used.

Examples thereof include proteins such as gelatin derivatives, graft polymers of gelatin to other polymer, albumin and casein; saccharide derivatives such as cellulose derivatives (e.g., hydroxyethyl cellulose, carboxymethyl cellulose and cellulose sulfate), sodium arginates and starch derivatives; and various synthetic hydrophilic polymer materials such as homopolymers and copolymers of polyvinyl alcohol, polyvinyl alcohol partial acetal, poly-N-vinylpyrrolidone, polyacrylic acid, polymethacrylic acid, polyacrylamide, polyvinyl imidazole or polyvinyl pyrazole.

Thee gelatin may be a lime-processed gelatin, an acid-processed gelatin or an enzyme-processed gelatin as described in *Bull. Soc. Sci. Photo. Japan*, No. 16, p. 30 (1966), and a hydrolysate or enzymolysate of gelatin may also be used. A low molecular weight gelatin described in JP-A-1-158426 is preferably used in the preparation of tabular grains.

The silver halide emulsion is preferably washed with water to remove salts and prepared into a new protective colloid dispersion. The temperature for water washing may be selected depending upon the purpose, but it is preferably from 5° to 50° C. The pH at the time of water washing may be also selected depending upon the purpose, but it is preferably from 2 to 10, more preferably from 3 to 8. The pAg at the time of water washing may also be selected depending upon the purpose, but it is preferably from 5 to 10. The method of water washing may be selected from a noodle water washing method, a dialysis method using a semipermeable membrane, a centrifugal separation method, a coagulation precipitation method and an ion exchange method. The coagulation precipitation method may be selected from a method using a sulfate, a method using an organic solvent, a method using a water-soluble polymer and a method using a gelatin derivative.

It is preferred depending on the purpose to let a metal ion salt be present at the time of preparing a silver halide emulsion, for example, during grain formation, at desilvering, at chemical sensitization or before coating. The metal ion salt is preferably added during grain formation when it is doped to a grain, and between after grain formation and before completion of the chemical sensitization when it is used for modification of the grain surface or as a chemical sensitizer. The metal ion salt may be doped to the entire of a grain, only to the core, shell or epitaxial part of a grain, or only to the substrate grain. Examples of the metal include Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb and Bi. These metals may be added if it is in the form of a salt capable of dissolution during grain formation, such as an ammonium salt, an acetate, a nitrate, a sulfate, a phosphate, a hydroxy salt, a 6-coordinated complex salt or a 4-coordinated complex salt. Examples thereof include $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_3IrCl_6$, $(NH_4)_3RhCl_6$ and $K_4Ru(CN)_6$. The ligand of the coordination compound can be selected from halogen, $H_2O$, cyano, cyanate, thiocyanate, nitrosyl, thionitrosyl, oxo and carbonyl. These metal compounds may be used individually or in combination of two or more.

A method of adding a chalcogen compound during preparation of an emulsion described in U.S. Pat. No. 3,772,031 is also useful in some cases. Other than S, Se and Te, a cyanate, a thiocyanate, a selenocyanate, a carbonate, a phosphate or an acetate may also be present.

The silver halide grain for use in the present invention may be subjected to at least one of sulfur sensitization, selenium sensitization, tellurium sensitization (these three sensitizations are collectively called chalcogen sensitization), noble metal sensitization and reduction sensitization at any step during preparation of a silver halide emulsion. A combination of two or more sensitization methods is preferred. By selecting the step when the chemical sensitization is performed, various types of emulsions may be prepared. The chemical sensitization specks are, in one type, embedded inside the grain, in another type, embedded in the shallow part from the grain surface, and in still another type, formed on the grain surface. In the emulsion for use in the present invention, the site of chemical sensitization specks may be selected according to the purpose.

The chemical sensitization which can be preferably used in the present invention is chalcogen sensitization, noble metal sensitization or a combination thereof, and it may be performed using an active gelatin as described in T. H. James, *The Theory of the Photographic Process*, 4th ed. Macmillan, pp. 67–76 (1977), or using sulfur, selenium, tellurium, gold, platinum, palladium, iridium or a combination of these sensitizers in plurality at a pAg of from 5 to 10, a pH of from 5 to 8 and a temperature of from 30° to 80° C. as described in *Research Disclosure*, Item 12008 (April, 1974), ibid., Item 13452 (June, 1975), ibid., Item 307105 (November, 1989), U.S. Pat. Nos. 2,642,361, 3,297,446, 3,772,031, 3,857,711, 3,901,714, 4,266,018 and 3,904,415 and British Patent 1,315,755.

In the sulfur sensitization, a labile sulfur compound is used and specific examples thereof include thiosulfates (e.g., hypo), thioureas (e.g., diphenylthiourea, triethylthiourea, allylthiourea), rhodanines, mercaptos, thioamides, thiohydantoins, 4-oxo-oxazolidine-2-thiones, disulfides, polysulfides, polythionates, elemental sulfur and known sulfur-containing compounds described in U.S. Pat. Nos. 3,857,711, 4,266,018 and 4,054,457. The sulfur sensitization is used in many cases in combination with noble metal sensitization.

The amount of the sulfur sensitizer used is, based on the silver halide grain, preferably from $1\times10^{-7}$ to $1\times10^{-3}$ mol, more preferably $5\times10^{-7}$ to $1\times10^{-4}$ mol, per mol of silver halide.

In the selenium sensitization, a known labile selenium compound is used, such as selenium compounds described in U.S. Pat. Nos. 3,297,446 and 3,297,447, and specific examples thereof include colloidal metal selenium, selenoureas (e.g., N,N-dimethylselenourea, tetramethylselenourea), selenoketones (e.g., selenoacetone), selenoamides (e.g., selenoacetamide), selenocarboxylic acids and esters, isoselenocyanates, selenides (e.g., diethyl selenide, triphenylphosphine selenide) and selenophosphates (e.g., tri-p-tolylselenophosphate). The selenium sensitization is preferably used in some cases in combination with sulfur sensitization, noble metal sensitization or both of these sensitizations.

The use amount of the selenium sensitizer varies depending on the kind of the selenium compound or the silver halide grain used, or on chemical ripening conditions, but it is usually from $10^{-8}$ to $10^{-4}$ mol, preferably on the order of from $10^{-7}$ to $10^{-5}$ mol, per mol of silver halide.

As the tellurium sensitizer for use in the present invention, the compounds described in Canadian Patent 800,958, British Patents 1,295,462 and 1,396,696, JP-A-4-204640 and JP-A-4-333043 can be used.

In the noble metal sensitization, a noble metal salt such as gold, platinum, palladium or iridium may be used and in particular, gold sensitization, palladium sensitization and a combination use of these two sensitizations are preferred. In the case of gold sensitization, a known compound such as chloroaurate, potassium chloroaurate, potassium aurithiocyanate, gold sulfide or gold selenide may be used. The palladium compound means a palladium divalent salt or tetravalent salt. The preferred palladium compound is represented by $R_2PdX_6$ or $R_2PdX_4$, wherein R represents a hydrogen atom, an alkali metal atom or an ammonium group, and X represents a halogen atom such as chlorine, bromine or iodine.

More specifically, $K_2PdCl_4$, $(NH_4)_2PdCl_6$, $Na_2PdCl_4$, $(NH_4)_2PdCl_4$, $Li_2PdCl_4$, $Na_2PdCl_6$ and $K_2PdBr_4$ are preferred. The gold compound and the palladium compound each is preferably used in combination with a thiocyanate or a selenocyanate.

To the emulsion for use in the present invention, the gold sensitization is preferably applied in combination. The amount of the gold sensitizer is preferably from $1\times10^{-7}$ to $1\times10^{-3}$ mol, more preferably from $^{5\times10-7}$ to $5\times10^{-4}$ mol, per mol of silver halide. The amount of the palladium compound is preferably from $5\times10^{-7}$ to $1\times10^{-3}$ mol per mol of silver halide. The amount of the thiocyanate compound or the selenocyanate compound is preferably from $1\times10^{-6}$ to $5\times10^{-2}$ mol per mol of silver halide.

The silver halide emulsion is preferably subjected to reduction sensitization during grain formation, before or during chemical sensitization after grain formation, or after chemical sensitization.

The reduction sensitization may be performed by any of a method of adding a reduction sensitizer to the silver halide emulsion, a method called silver ripening, o f growing or ripening the emulsion in a low pAg atmosphere at a pAg of from 1 to 7, and a method called high pH ripening, of growing or ripening the emulsion in a high pH atmosphere at a pH of from 8 to 11. Two or more of the above-described methods may also be used in combination.

The reduction sensitizer may be selected from known reduction sensitizers such as a stannous salt, an ascorbic acid and a derivative thereof, amines and polyamines, a hydrazine and a derivative thereof, a formamidinesulfinic acid, a silane compound and a borane compound, and these compounds may be used in combination of two or more. Preferred compounds as the reduction sensitizer are a stannous chloride, an aminoiminomethanesulfinic acid (common name: thiourea dioxide), a dimethylamineborane, an ascorbic acid and a derivative thereof.

The chemical sensitization may also be performed in the presence of a so-called chemical sensitization aid. Useful chemical sensitization aids include compounds known to suppress fogging and at the same time, increase sensitivity during the chemical sensitization, such as azaindene, azapyridazine and azapyrimidine. Examples of the chemical sensitization aid are described in U.S. Pat. Nos. 2,131,038, 3,411,914 and 3,554,757, JP-A-58-126526 and G. F. Duffin, *Photographic Emulsion Chemistry* (cited above), pp. 138–143.

An oxidizing agent for silver is preferably used during production of the emulsion. The oxidizing agent for silver means a compound capable of acting on a metal silver to convert it into a silver ion. In particular, a compound which converts very fine silver grains by-produced during grain formation and chemical sensitization of silver halide grains into silver ions, is useful. The silver ion produced here may be in the form of a difficultly water-soluble silver salt such as silver halide, silver sulfide or silver selenide or in the form of an easily water-soluble silver salt such as silver nitrate. The oxidizing agent for silver may be either an inorganic material or an organic material. Examples of the inorganic oxidizing agent include ozone, a hydrogen peroxide and an adduct thereof (e.g., $NaBO_2.H_2O_2.3H_2O$, $2NaCO_3.3H_2O_2$, $Na_4P_2O_7.2H_2O_2$, $2Na_2SO_4.H_2O_2.2H_2O$ ), a peroxy acid salt (e.g., $K_2S_2O_8$, $K_2C_2O_6$, $K_2P_2O_8$), a peroxy complex compound (e.g., $K_2[Ti(O_2)C_2O_4].3H_2O$, $4K_2SO_4.Ti(O_2)OH.SO_4.2H_2O$ , $Na_3[VO(O_2)(C_2H_4)_2.6H_2O)$, a permanganate (e.g., $KMnO_4$), an oxyacid salt such as a chromate (e.g., $K_2Cr_2O_7$), a halogen element such as iodine and bromine, a perhalogen acid salt (e.g., potassium periodate), a salt of high-valence metal (e.g., potassium hexacyanoferrate) and a thiosulfonate.

Examples of the organic oxidizing agent include quinones such as p-quinone, organic peroxides such as peracetic acid and perbenzoic acid, and active halogen-releasing compounds (e.g., N-bromosuccinimide, chloramine-T, chloramine-B).

The combination use of the above-described reduction sensitization with the oxidizing agent for silver is a preferred embodiment.

Various compounds may be incorporated into the photographic emulsion for use in the present invention so as to prevent fogging during preparation, storage or photographic processing of the light-sensitive material or to stabilize the photographic capacity. More specifically, a large number of compounds known as an antifoggant or a stabilizer may be added, for example, thiazoles such as benzothiazolium salt, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles and mercaptotetrazoles (e.g., 1-phenyl-5-mercaptotetrazole, 1-(5-methylureidophenyl)-5-mercaptotetrazole); mercaptopyrimidines; mercaptotriazines; thioketo compounds such as oxazolinethione; and azaindenes such as triazaindenes, tetrazaindenes (in particular, 4-hydroxy-6-methyl-(1,3,3a,7) tetrazaindenes) and pentazaindenes. For example, those described in U.S. Pat. Nos. 3,954,474 and 3,982,947 and JP-B-52-28660 may be used. One of preferred compounds is the compound described in JP-A-63-212932. The antifoggant and the stabilizer each may be added at various stages depending upon the purpose, such as before grain formation, during grain formation, after grain formation, at water washing, at dispersion after water washing, before chemical sensitization, during chemical sensitization, after chemical sensitization or before coating.

The photographic emulsion for use in the present invention is preferably spectrally sensitized by a methine dye or others. Examples of the dye used include a cyanine dye, a merocyanine dye, a complex cyanine dye, a complex merocyanine dye, a holopolar cyanine dye, a hemicyanine dye, a styryl dye and a hemioxonol dye. Among these, particularly useful are dyes belonging to the cyanine dye, the merocyanine dye and the complex merocyanine dye. To these dyes, any nucleus commonly used for cyanine dyes as a basic heterocyclic nucleus can be applied. Examples thereof include a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus and a pyridine nucleus; a nucleus resulting from fusion of an alicyclic hydrocarbon ring to the above-described nuclei; and a nucleus resulting from fusion of an aromatic hydrocarbon ring to the above-described nuclei, e.g., indolenine nucleus, benzindolenine nucleus, indole nucleus, benzoxazole nucleus, naphthoxazole nucleus, benzothiazole nucleus, naphthothiazole nucleus, benzoselenazole nucleus, benzimidazole nucleus and quinoline nucleus. These nuclei may have a substituent on the carbon atom thereof.

To the merocyanine dye or complex merocyanine dye, a 5-or 6-membered heterocyclic nucleus such as a pyrazolin-5-one nucleus, a thiohydantoin nucleus, a 2-thioxazolidine-2,4-dione nucleus, a thiazolidin-2,4-dione nucleus, a rhodanine nucleus or a thiobarbituric acid nucleus may be applied as a nucleus having a ketomethylene structure.

These sensitizing dyes may be used individually or in combination thereof and the combination of sensitizing dyes is often used for the purpose of supersensitization. Representative examples thereof are described in U.S. Pat. Nos. 2,688,545, 2,977,229, 3,397,060, 3,522,052, 3,527,641, 3,617,293, 3,628,946, 3,666,480, 3,672,898, 3,679,428, 3,703,377, 3,769,301, 3,814,609, 3,837,862 and 4,026,707, British Patents 1,344,281 and 1,507,803, JP-B-43-4936, JP-B-53-12375, JP-A-52-110618 and JP-A-52-109925.

In combination with a sensitizing dye, a dye which itself provides no spectral sensitization effect or a material which absorbs substantially no visible light, but which exhibits supersensitization may be contained in the emulsion.

The time when the spectral sensitizing dye is added to the emulsion may be any stage hitherto known to be useful during preparation of the emulsion. Most commonly, the spectral sensitization is effected between after completion of the chemical sensitization and before coating, but the dye may be added at the same time with a chemical sensitizer to effect spectral sensitization and chemical sensitization simultaneously as described in U.S. Pat. Nos. 3,628,969 and 4,225,666, the spectral sensitization may be effected in advance of chemical sensitization as described in JP-A-58-113928, or the dye may be added before completion of the precipitation and formation of silver halide grains to start spectral sensitization. Further, the above-described compound may be added in parts, namely, a part of the compound may be added in advance of chemical sensitization and the remaining may be added after chemical sensitization, as described in U.S. Pat. No. 4,225,666, and the compound may be added at any time during formation of silver halide grains as in the method described in U.S. Pat. No. 4,183,756.

The addition amount of the compound may be from $4\times10^{-6}$ to $8\times10^{-3}$ mol per mol of silver halide, but in the case of silver halide grains in the size of from 0.2 to 1.2 μm, which is a more preferred embodiment, it is effectively from about $5\times10^{-5}$ to $2\times^{-3}$ mol per mol of silver halide.

The light-sensitive material of the present invention uses various additives as described above but other than those, various additives may be used according to the purpose.

These additives are described in more detail in *Research Disclosure*, Item 17643 (December, 1978), ibid., Item (November, 1979) and ibid., No. 307105 (November, 1989), and the pertinent portions thereof are summarized in the table below

TABLE 1

| Kinds of Additives | RD17643 | RD18716 | RD307105 |
|---|---|---|---|
| 1. Chemical sensitizer | p. 23 | p. 648, right col. | p. 996 |
| 2. Sensitivity increasing agent | | p. 648, right col. | |
| 3. Spectral sensitizer, supersensitizer | pp. 23–24 | p. 648, right col.–p. 649, right col. | p. 996, right col.–p. 998, right col. |
| 4. Whitening agent | p. 24 | | p. 998, right col. |
| 5. Antifoggant, stabilizer | pp. 24–25 | p. 649, right col. | p. 998, right col.–p. 1,000, right col. |
| 6. Light absorbent, filter dye, UV absorbent | pp. 25–26 | p. 649, right col.–p. 650, left col. | p. 1,003, left col.–p. 1,003, right col. |
| 7. Stain inhibitor | p. 25, right col. | p. 650, left to right cols. | |
| 8. Dye image stabilizer | p. 25 | | |
| 9. Hardening agent | p. 26 | p. 651, left col. | p. 1,004, right col.–p. 1,005, left col. |
| 10. Binder | p. 26 | p. 651, left col. | p. 1,003, right col.–p. 1,004, right col. |
| 11. Plasticizer, lubricant | p. 27 | p. 650, right col. | p. 1,006, left col.–p. 1,006, right col. |
| 12. Coating aid, surface active agent | pp. 26–27 | p. 650, right col. | p. 1,005, left col.–p. 1,006, left col. |
| 13. Antistatic agent | p. 27 | p. 650, right col. | p. 1006, right col.–p. 1,007, left col. |

The total coated silver amount of the light-sensitive material of the present invention is preferably, in terms of silver, from 0.003 to 12 g/m$^2$. In the case of a transmissive material such as a color negative film, it is preferably from 1 to 12 g/m$^2$, more preferably from 3 to 10 g/m$^2$. In the case of a reflective material such as a color paper, it is preferably from 0.003 to 1 g/m$^2$ in view of rapid processing and low replenishment and in this case, the addition amount to respective layers is preferably from 0.001 to 0.4 g per one light-sensitive layer. In particular, when the light-sensitive material of the present invention is subjected to intensification processing, the total coated silver amount is preferably from 0.003 to 0.3 g/m$^2$, more preferably from 0.01 to 0.1 g/m$^2$, still more preferably from 0.015 to 0.05 g/m$^2$. In this case, the addition amount is preferably from 0.001 to 0.1 g, preferably from 0.003 to 0.03 g, per one light-sensitive layer.

In the present invention, if the coated silver amount of each light-sensitive layer is less than 0.001 g/m$^2$, dissolution of silver salt proceeds and sufficiently high color density cannot be obtained, and in the case of intensification process, if it exceeds 0.1 g/m$^2$, increase in Dmin or generation of bubbles are caused and viewing is often endurable.

The total gelatin amount of the light-sensitive material of the present invention is from 1.0 to 30 g/m$^2$, preferably from 2.0 to 20 g/m$^2$. In swelling the light-sensitive material of the present invention using an alkali solution having a pH of 12, the time required for reaching a half of the saturation swollen layer thickness (corresponding to 90% of the maximum swollen layer thickness) is preferably 15 seconds or less, more preferably 10 seconds or less. The swelling ratio [(maximum swollen layer thickness—layer thickness)/layer thickness×100] is preferably from 50 to 300%, more preferably from 100 to 200%.

The processing materials and the processing method for use in the present invention are described in detail below. In the present invention, the light-sensitive material is processed through development (silver development/cross-oxidation of the self-contained reducing agent), desilvering and water washing or stabilization. In some cases, the light-sensitive material may be subjected to processing for intensifying color formation, such as impartation of alkali, after water washing or stabilization.

In developing the light-sensitive material of the present invention, the developer may use a compound capable of functioning as a developing agent for silver halide and/or having a function such that the oxidation product of the developing agent generated on silver development cross-oxidizes the reducing agent for color formation incorporated into the light-sensitive material. Preferred examples of the compound include pyrazolidones, dihydroxybenzenes, reductones and aminophenols, with pyrazolidones being more preferred.

The pyrazolidones are preferably 1-phenyl-3-pyrazolidones and examples thereof include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-phenyl-5-phenyl-3-pyrazolidone, 1-p-tolyl-4-methyl-4-hydroxymethyl-3-pyrazolidone, 1-p-chlorophenyl-4-methyl-4-hydroxymethyl-3-pyrazolidone, 1-phenyl-2-hydroxymethyl-4,4-dimethyl-3-pyrazolidone, 1-phenyl-2-acetyl-3-pyrazolidone and 1-phenyl-2-hydroxymethyl-5-phenyl-3-pyrazolidone.

Examples of the dihydroxybenzenes include hydroquinone, chlorohydroquinone, bromohydroquinone, isopropylhydroquinone, methylhydroquinone, 2,3-dichlorohydroquinone, 2,5-dichlorohydroquinone, 2,5-dimethylhydroquinone and potassium hydroquinone monosulfonate.

The reductones are preferably an ascorbic acid and a derivative thereof, and examples thereof include the compounds described in JP-A-6-148822, pp. 3-10. In particular, sodium L-ascorbate and sodium erythorbate are preferred.

Examples of the p-aminophenols include N-methyl-p-aminophenol, N-(β-hydroxyethyl)-p-aminophenol, N-(4-hydroxyphenyl)glycine and 2-methyl-p-aminophenol.

These compounds are usually used individually, however, they are preferably used in combination of two or more thereof for the purpose of increasing the development and the cross-oxidation activity.

The amount of the above-described compound used in the developer is generally from $2.5\times10^{-4}$ to 0.2 mol/l, preferably from 0.0025 to 0.1 mol/l, more preferably from 0.001 to 0.05 mol/l.

Examples of the preservative used in the developer include sodium sulfite, potassium sulfite, lithium sulfite, ammonium sulfite, sodium bisulfite, potassium metabisulfite, sodium formaldehyde bisulfite and hydroxylamine sulfate, and the amount of the compound used is usually 0.1 mol/l or less, preferably from 0.001 to 0.02 mol/l. In the case of using a high silver chloride emulsion in the light-sensitive material, the amount of the compound used is usually 0.001 mol/l or less, and preferably, the compound is not used at all.

In the present invention, an organic preservative such as diehylhydroxylamine and dialkylhydroxylamines described in JP-A-4-97355, is preferably contained in place of the above-described hydroxylamine or sulfite ion.

The developer may contain halogen ions such as chlorine ion, bromine ion or iodine ion.

The halide may be added directly to the developer or may be eluted from the light-sensitive material into the developer during the development processing.

The developer for use in the present invention preferably has a pH of from 8 to 13, more preferably from 9 to 12.

In order to keep the above-described pH, various buffer solutions are preferably used. Examples thereof include carbonate, phosphate, tetraborate and hydroxybenzoate.

The amount of the buffer agent to the developer is preferably 0.05 mol/l or more, more preferably from 0.1 to 0.4 mol/l.

In addition, the developer may contain various chelating agents as a precipitation inhibitor of calcium or magnesium or for improving stability of the developer.

The addition amount of the chelating agent may suffice if it is an amount sufficiently high to conceal metal ions in the developer and it is, for example, approximately from 0.1 to 10 g/l.

In the present invention, a freely selected antifoggant may be added, if desired. The antifoggant includes alkali metal halides such as sodium chloride, potassium bromide and potassium iodide, and nitrogen-containing heterocyclic compounds.

The addition amount of the nitrogen-containing heterocyclic compound is from $1\times10^{-5}$ to $1\times10^{-2}$ mol/l, preferably from $2.5\times10^{-5}$ to $1\times10^{-3}$ mol/l.

To the developer, an optional development accelerator may be added, if desired.

The developer preferably contains a brightening agent. In particular, 4,4'-diamino-2,2'-disulfostilbene-base compounds are preferably used.

The processing temperature of the developer for use in the present invention is from 20° to 50° C., preferably from 30° to 45° C. The processing time is from 5 seconds to 2 minutes, preferably from 10 seconds to 1 minute. The replenishing amount is preferably smaller but it is usually from 15 to 600 ml, preferably from 25 to 200 ml, more preferably from 35 to 100 ml, per m$^2$ of the light-sensitive material.

The development is followed by desilvering. The desilvering may comprise fixing or may comprise bleaching and fixing. When it comprises bleaching and fixing, the bleaching and the fixing may be performed separately or may be performed simultaneously (bleach-fixing). Further, processing in a bleach-fixing bath consisting of two continuous tanks, processing of performing fixing before bleach-fixing, or processing of performing bleaching after bleach-fixing may be freely selected depending upon the purpose.

In some cases, it is preferred to perform stabilization after development without effecting desilvering, to stabilize the silver salt or the dye image.

Also, an image reinforcing processing (intensification) may be performed after development, using peroxides, halogenous acids, iodoso compounds and cobalt(III) complex compounds described in West German Patent Applications (OLS) 1,813,920, 2,044,993 and 2,735,262, JP-A-48-9728, JP-A-49-84240, JP-A-49-102314, JP-A-51-53826, JP-A-52-13336 and JP-A-52-73731. In order to further intensify the image reinforcement, the above-described oxidizing agent for image reinforcement may be added to the developer to effect the development and the image intensification at the same time in a single bath. In particular, hydrogen peroxide is preferred because of its high amplification factor. The above-described image intensification method is a preferred processing method in view of environmental conservation because the silver amount of the light-sensitive material can be greatly reduced to dispense with bleaching and at the same time, to involve no discharge of silver (or silver salt), for example, at stabilization.

Examples of the bleaching agent for use in the bleaching solution or the bleach-fixing solution include compounds of a polyvalent metal such as iron(III), cobalt(III), chromium (IV) and copper(II), peracids, quinones and nitro compounds. Among these, an aminopolycarboxylic acid ferrate such as ethylenediaminetetraacetato ferrate complex salt and 1,3-diaminopropanetetraacetato ferrate complex salt, hydrogen peroxide and persulfate are preferred in view of rapid processing and prevention of environmental pollution.

The bleaching solution or the bleach-fixing solution using the aminopolycarboxylic acid ferrate complex salt is used at a pH of from 3 to 8, preferably from 5 to 7. The bleaching solution using persulfate or hydrogen peroxide is used at a pH of from 4 to 11, preferably from 5 to 10.

The bleaching solution, the bleach-fixing solution or a prebath thereof may use a bleaching accelerator, if desired.

The bleaching solution, the bleach-fixing solution or the fixing solution may use conventionally known rehalogenating agents or additives such as a pH buffer and a metal corrosion inhibitor. In particular, the solutions each preferably contains an organic acid having an acid dissociation constant (pKa) of from 2 to 7 to prevent bleaching stains.

Example s of the fixing agent for use in the fixing solution or in the bleach-fixing solution include thiosulfates, thiocyanates, thioureas, a large quantity of iodide salts, and nitrogen-containing heterocyclic compounds having a sulfide group, mesoionic compounds and thioether-base compounds described in JP-A-4-365037, pp. 11-21, JP-A-5-66540, pp. 1,088-1,092.

As the preservative of the fixing solution or the bleach-fixing solution, sulfites, bisulfites, carbonyl bisulfite adducts and sulfinic acid compounds described in EP-A-294769 are preferred.

Furthermore, the fixing solution or the bleach-fixing solution may contain various brightening agents, defoaming agents, surface active agents, polyvinylpyrrolidones or methanols.

The processing temperature in desilvering is from 20° to 50° C., preferably from 30° to 45° C. The processing time is from 5 seconds to 2 minutes, preferably from 10 seconds to 1 minute. The replenishing amount is preferably smaller, but it is usually from 15 to 600 ml, preferably from 25 to 200 ml, more preferably from 35 to 100 ml, per $m^2$ of the light-sensitive material. A processing free of replenishment but only with compensation for the evaporation loss by water is also preferred.

The light-sensitive material of the present invention is usually subjected to water washing after desilvering. When stabilization is performed, the water washing may be omitted. In the stabilization, any of known methods described in JP-A-57-8543, JP-A-58-14834, JP-A-60-220345, JP-A-58-127926, JP-A-58-127837 and JP-A-58-140741 can be used. Water washing-stabilization as represented by the processing of a color light-sensitive material for photographing may also be performed, where the stabilization bath containing a dye stabilizer and a surface active agent is used as the final bath.

The water-washing solution and the stabilizing solution may contain a sulfite; a hard water softening agent such as inorganic phosphoric acid, polyaminocarboxylic acid and organic aminophosphonic acid; a metal salt such as Mg salt, Al salt and Bi salt; a surface active agent; a hardening agent; a pH buffer; a brightening agent; and a silver salt forming agent such as nitrogen-containing heterocyclic compound.

Examples of the dye stabilizer for the stabilizing solution include aldehydes such as formalin and glutaraldehyde, N-methylol compounds, hexamethylenetetramine and aldehyde-sulfurous acid adducts.

The pH of the washing water or stabilizing solution is from 4 to 9, preferably from 5 to 8. The processing temperature is generally from 15° to 45° C., preferably from 25° to 40° C. The processing time is from 5 seconds to 2 minutes, preferably from 10 to 40 seconds.

The overflow solution accompanying replenishment of the above-described washing water and/or stabilizing solution can be re-used in other steps such as desilvering.

The amount of washing water and/or stabilizing solution may be selected over a wide range depending upon various conditions but the replenishing amount is preferably from 15 to 360 ml, more preferably from 25 to 120 ml, per $m^2$ of the light-sensitive material. In order to reduce the replenishing water amount, it is preferred to use a plurality of tanks in a countercurrent system.

In the present invention, water resulting from treating the overflow solution or solution inside tanks with a reverse osmosis membrane may be used for saving water. For example, the treatment with a reverse osmosis membrane is preferably applied to water in the second or subsequent tanks for water washing and/or stabilization in a multi-stage countercurrent system.

In the present invention, the stirring is preferably intensified as highly as possible. Specific examples of the method for intensifying stirring include a method of colliding a jet stream of a processing solution against the emulsion surface of the light-sensitive material described in JP-A-62-183460 and JP-A-62-183461, a method of increasing the stirring effect by using a rotary means described in JP-A-62-183461, a method of increasing the stirring effect by causing turbulence on the emulsion surface while moving the light-sensitive material with the emulsion surface being brought into contact with a wiper blade provided in the solution, and a method of increasing the circulative flow rate of the entire processing solutions. Such a means for intensifying the stirring is effective in any of the developer, the bleaching solution, the fixing solution, the bleach-fixing solution, the stabilizing solution and the washing water. These methods are advantageous in that the supply of effective components in the solution to the light-sensitive material or the diffusion of unnecessary components of the light-sensitive material is accelerated.

The present invention exhibits superior capacity whatever state the solution open ratio [contact area with air ($cm^2$)/solution volume ($cm^3$)] of any bath is in, however, in view of stability of solution components, the solution open ratio is preferably from 0 to 0.1 $cm^{-1}$ and in the case of a continuous processing, it is in practice preferably from 0.001 to 0.05 $cm^{-1}$, more preferably from 0.002 to 0.03 $cm^{-1}$.

The automatic developing machine used for the light-sensitive material of the present invention preferably comprises a transportation means of a light-sensitive material described in JP-A-60-191257, JP-A-60-191258 and JP-A-60-191259. The transportation means can extremely decrease the amount of a processing solution carried over from a previous bath to the post bath and provides a great effect in preventing deterioration in capacity of the processing solution. Such an effect is particularly useful in reducing the processing time or decreasing the replenishing amount of the processing solution, in each step. Further, in order to reduce the processing time, the crossover time (airing time) is preferably shortened and, for example, a method described in JP-A-4-86659, FIG. 4, 5 or 6 and JP-A-5-66540, FIG. 4 or 5 is preferably used, where a light-sensitive material is transferred through blades having a shielding effect.

In the case when each processing solution is concentrated due to evaporation during continuous processing, it is preferred to correct the concentration by adding water.

The processing time in a step as used in the present invention means the time period required from initiation of the processing of a light-sensitive material in a certain step until initiation of the processing in the next step. The practical processing time in an automatic developing machine is usually determined by the linear velocity and the volume of a processing bath, and in the present invention, the linear velocity is from 500 to 4,000 mm/min as a standard. In the case of a small-size developing machine, the linear velocity is preferably from 500 to 2,500 mm/min.

The total processing time, in other words, the processing time from development to drying is preferably 360 seconds or less, more preferably 120 seconds or less, still more preferably from 30 to 90 seconds. The processing time as used herein means the time period since the light-sensitive material is dipped in a developer until it comes out from the drying zone of a processor.

In the processing applied to the present invention, various additives are used and they are described in greater detail in *Research Disclosure*, Item 36544 (September, 1994). The pertinent portions thereof are summarized in the table below.

| Kind of Processing Agents | Page |
|---|---|
| Developing agent | 536 |
| Preservative of developing agent | 537, left column |
| Antifoggant | 537 |
| Chelating agent | 537, right column |
| Buffer | 537, right column |
| Surface active agent | 538, left column and 539, left column |
| Bleaching agent | 538 |
| Bleaching accelerator | 538, right column to 539, left column |
| Chelating agent for bleaching | 539, left column |
| Rehalogenating agent | 539, left column |
| Fixing agent | 539, right column |
| Preservative of fixing agent | 539, right column |
| Chelating agent for fixing agent | 540, left column |
| Surface active agent for stabilization | 540, left |
| Scum inhibitor for stabilization | 540, right |
| Chelating agent for stabilization | 540, right |
| Antiseptic, antimold | 540, right |
| Dye image stabilizer | 540, right |

The technique for saving water, which is applied to the present invention, is described in detail in *Research Disclosure*, Item 36544 (September, 1994), page 540, right column to page 541, left column.

The present invention will be described in greater detail with reference to the following examples but the present invention should not be construed as being limited thereto.

EXAMPLE 1

The surface of a paper support having laminated on both surfaces thereof with polyethylene was subjected to corona discharge treatment, a gelatin subbing layer containing sodium dodecylbenzenesulfonate was provided thereon, and two kinds of photographic constituent layers were coated thereon to prepare Photographic Printing Paper (100) having a two-layer structure described below. The coating solutions were prepared as follows.

Coating Solution for First Layer

In ethyl acetate, 17 g of Coupler (C-76), 20 g of Reducing Agent (I-16) for color formation and 80 g of Solvent (Solv-1) were dissolved, and the resulting solution was emulsion-dispersed in 400 g of a 16% aqueous gelatin solution containing a 10% sodium dodecylbenzenesulfonate and a citric acid to prepare Emulsion Dispersion A. Separately, Silver Chlorobromide Emulsion A (cubic; a 3:7 mixture (by silver mol) of Large Size Emulsion A having an average grain size of 0.88 μm and Small Size Emulsion A having an average grain size of 0.70 μm; these emulsions having a coefficient of variation in the grain size distribution of 0.08 and 0.10, respectively; the emulsion of each size containing 0.3 mol % of silver bromide localized on a part of the grain surface comprising a substrate of silver chloride) was prepared. To this emulsion, Blue Sensitizing Dyes A, B and C shown below were added each in an amount, for Large Size Emulsion A, of $1.4\times10^{-4}$ mol, and for Small Size Emulsion A, of $1.7\times10^{-4}$ mol, per mol of silver halide. The resulting emulsion was subjected to optimal chemical ripening by adding a sulfur sensitizer and a gold sensitizer. Emulsion Dispersion A and Silver Chlorobromide Emulsion A were mixed and dissolved to prepare a coating solution for the first layer having the following composition. The emulsion coated amount is a coated amount calculated in terms of silver.

A coating solution for the second layer was prepared in the same manner as the coating solution for the first layer. In each layer, 1-oxy-3,5-dichloro-s-triazine sodium salt was added as a gelatin hardening agent.

Further, Cpd-2, Cpd-3, Cpd-4 and Cpd-5 were added to each layer to have a total coverage of 15.0 mg/m$^2$, 60.0 mg/m$^2$, 50.0 mg/m$^2$ and 10.0 mg/m$^2$, respectively.

Sensitizing Dye A

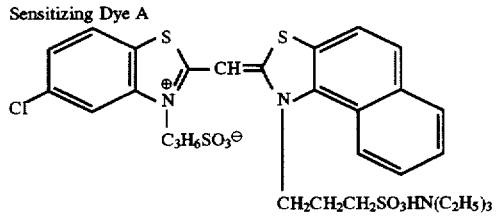

Sensitizing Dye B

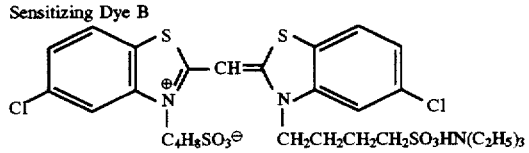

Sensitizing Dye C

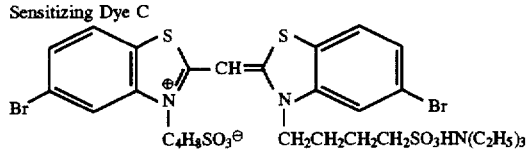

Further, 1-(5-methylureidophenyl)-5-mercaptotetrazole was added to the first layer in an amount of $3.0\times10^{-3}$ mol per mol of silver halide.

(Layer Structure)

The composition of each layer is shown below. The numerals show the coated amount ($g/m^2$). In the case of silver halide emulsions, it is a coated amount in terms of silver.

| | |
|---|---|
| Support | |
| Polyethylene laminated paper [Polyethylene on the first layer side contained a white pigment ($TiO_2$, 15 wt %) and a bluish dye (ultramarine).] | |
| First Layer | |
| Silver Chlorobromide Emulsion A described above | 0.20 |
| Gelatin | 1.50 |
| Yellow Coupler (C-76) | 0.17 |
| Reducing Agent (I-16) for color formation | 0.20 |
| Solvent (Solv-1) | 0.80 |
| Second Layer (Protective Layer) | |
| Gelatin | 1.01 |
| Acryl-modified copolymer of polyvinyl alcohol (modification degree: 17%) | 0.04 |
| Liquid paraffin | 0.02 |
| Surface Active Agent (Cpd-1) | 0.01 |

Samples (101) to (137) were prepared thoroughly in the same manner as Sample (100) except that the yellow coupler and the reducing agent for color formation in the coating solution for the first layer were replaced by an equimolar amount of the yellow coupler and the reducing agent for color formation shown in Tables a-1 and a-2, respectively, and that the polymer shown in Tables a-1 and a-2 was further added in an amount of 50 wt % of Solvent (Solv-1), dissolved in the solvent together with the compounds and co-emulsified.

Samples (200) to (237) were prepared thoroughly in the same manner as Sample (100) except that Silver Chlorobromide Emulsion A in the coating solution for the first layer was replaced by an equal amount in terms of silver of Silver Chlorobromide Emulsion B shown below, that the coupler and the reducing agent for color formation were replaced by an equimolar amount of the magenta coupler and the reducing agent for color formation shown in Tables b-1 and b-2, respectively, and that the polymer shown in Tables b-1 and b-2 was further added in an amount of 50 wt % of Solvent (Solv-1) and co-emulsified in the same manner as above.

Silver Chlorobromide Emulsion B

Cubic; a 1:3 (by Ag mol) mixture of Large Size Emulsion B having an average grain size of 0.55 μm and Small Size Emulsion B having an average grain size of 0.39 μm; the emulsions having a coefficient of variation in the grain size distribution of 0.10 and 0.08, respectively; and the emulsion of each size containing 0.8 mol % of AgBr localized on a part of the grain surface comprising a substrate of silver chloride.

In Silver Chlorobromide Emulsion B, the following spectral sensitizing dyes were used for respective size emulsions.

Sensitizing Dye D

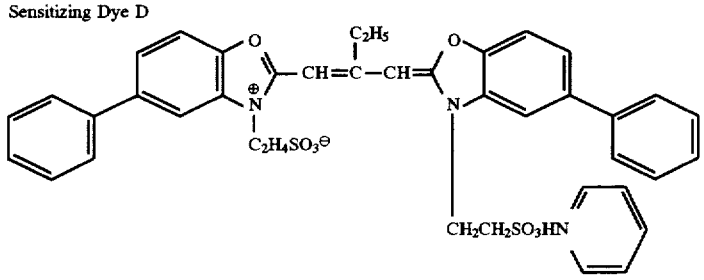

Sensitizing Dye E

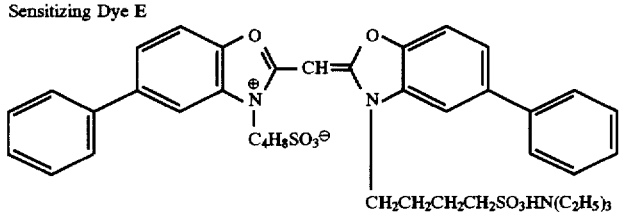

Sensitizing Dye F

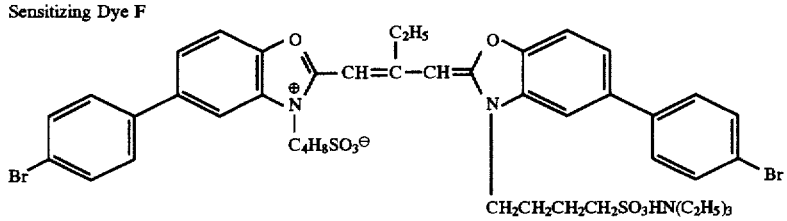

(Sensitizing Dye D was added in an amount, for the large size grain, of $3.0\times10^{-4}$ mol and for the small size emulsion, of $3.6\times10^{-4}$ mol, per mol of silver halide; Sensitizing Dye E was added in an amount, for the large size grain, of $4.0\times10^{-5}$ mol and for the small size emulsion, of $7.0\times10^{-5}$ mol, per mol of silver halide; and Sensitizing Dye F was added in an amount, for the large size grain, of $2.0\times10^{-4}$ mol and for the small size emulsion, of $2.8\times10^{-4}$ mol, per mol of silver halide.)

Samples (300) to (337) were prepared thoroughly in the same manner as Sample (100) except that Silver Chlorobromide Emulsion A in the coating solution for the first layer was replaced by an equal amount in terms of silver of Silver Chlorobromide Emulsion C shown below, that the coupler and the reducing agent for color formation were replaced by an equimolar amount of the cyan coupler and the reducing agent for color formation shown in Tables c-1 and c-2, respectively, and that the polymer shown in Tables c-1 and c-2 was further added in an amount of 50 wt % of Solvent (Solv-1) and co-emulsified in the same manner as above.

Silver Chlorobromide Emulsion C

Cubic; a 1:4 (by Ag mol) mixture of Large Size Emulsion C having an average grain size of 0.5 μm and a small size emulsion having an average grain size of 0.41 μm; the emulsions having a coefficient of variation in the grain size distribution of 0.09 and 0.11, respectively; and the emulsion of each size containing 0.8 mol % of AgBr localized on a part of the grain surface comprising a substrate of silver chloride.

In Silver Chlorobromide Emulsion C, the following spectral sensitizing dyes were used for respective size emulsions.

Sensitizing Dye G

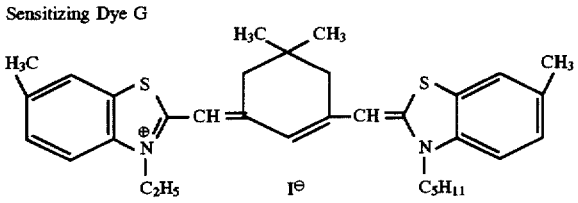

Sensitizing Dye H

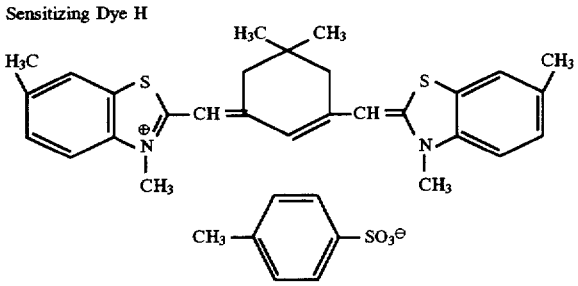

(Each sensitizing dye was added in an amount, for the large size emulsion, of $5.0\times10^{-5}$ mol and for the small size emulsion, of $8.0\times10^{-5}$ mol per mol of silver halide.)

Surface Active Agent (Cpd-1)
A 7:3 mixture (by weight) of:

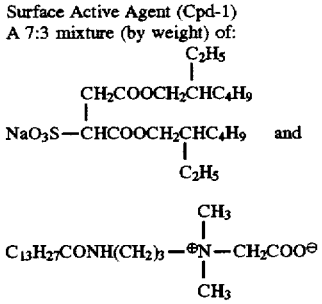

Antiseptic (Cpd-2)

-continued

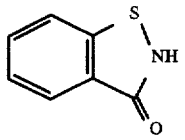

Antiseptic (Cpd-3)

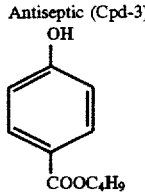

Antiseptic (Cpd-4)
A 1:1:1:1 mixture of a, b, c and d.

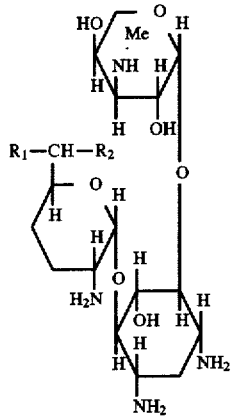

| | $R_1$ | $R_2$ |
|---|---|---|
| a | —Me | —NHMe |
| b | —Me | —$NH_2$ |
| c | —H | —$NH_2$ |
| d | —H | —NHMe |

Antiseptic (Cpd-5)

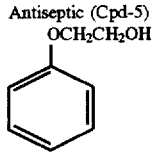

Solvent (Solv-1)

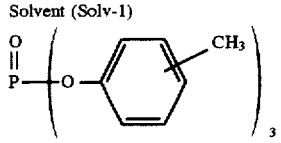

The thus prepared samples were immediately subjected to gradation exposure using Model FWH Sensitometer (color temperature of light source: 3,200° K) manufactured by Fuji Photo Film Co., Ltd., through a blue filter for sensitometry in the case of Samples (100) to (137), through a green filter for sensitometry in the case of Samples (200) to (237), and through a red filter for sensitometry in the case of Samples (300) to (337).

After the exposure, samples were processed through the following processing steps using the processing solutions described below.

| Processing Step | Temperature (°C.) | Time (sec.) |
|---|---|---|
| Development | 40 | 20 |
| Bleach fixing | 40 | 45 |
| Rinsing | room temperature | 45 |
| Alkali treatment | room temperature | 30 |

-continued

| | |
|---|---|
| Developer | |
| Water | 600 ml |
| Potassium phosphate | 40 g |
| Disodium-N,N-bis(sulfonatoethyl)-hydroxylainine | 10 g |
| KCl | 5 g |
| Hydroxyethylidene-1,1-diphosphonic acid (30%) | 4 ml |
| 1-Phenyl-4-methyl-4-hydroxymethyl-3-pyrazolidone | 1 g |
| Water to make | 1,000 ml |
| pH (at 25° C., with potassium hydroxide) | 12 |
| Bleach-Fixing Solution | |
| Water | 600 ml |
| Ammonium thiosulfate (700 g/l) | 93 ml |
| Ammonium sulfite | 40 g |
| Ammonium ethylenediaminetetraacetato ferrate | 55 g |
| Ethylenediaminetetraacetic acid | 2 g |
| Nitric acid (67%) | 30 g |
| Water to make | 1,000 ml |
| pH (at 25° C., with acetic acid and aqueous solution) | 5.8 |
| Rinsing Solution | |
| Chlorinated sodium isocyanurate | 0.02 g |
| Deionized water (electric conductivity: 5 μS/cm or less) | 1,000 ml |
| pH | 6.5 |
| Alkali Treating Solution | |
| Water | 800 ml |
| Potassium carbonate | 30 g |
| Water to make | 1,000 ml |
| pH (with 1N sulfuric acid or 1N potassium hydroxide) | 10 |

After the processing, samples were measured on the maximum color density area (Dmax), in the case of Samples (100) to (137), with blue light, in the case of Samples (200) to (237), with green light, and in the case of Samples (300) to (337), with red light. The results obtained are shown in Tables a-1 and a-2, Tables b-1 and b-2, and Tables c-1 and c-2, respectively.

Further, each of unprocessed samples was allowed to stand at a temperature of 80° C. and a humidity of 70% for one week and then, subjected to bleach-fixing, rinsing and alkali treatment at the same temperature in the same processing time using the same formulation as above.

After the processing, samples were measured on the density (Dmin), in the case of Samples (100) to (137), with blue light, in the case of Samples (200) to (237), with green light, and in the case of Samples (300) to (337), with red light. The results obtained are shown in Tables a-1 and a-2, Tables b-1 and b-2, and Tables c-1 and c-2, respectively.

TABLE a-1

| Sample No. | Reducing Agent for Color Formation | Coupler | Polymer | Dmax | Dmin | Remarks |
|---|---|---|---|---|---|---|
| 100 | I-16 | C-76 | — | 1.88 | 0.38 | Comparison |
| 101 | " | " | P-17 | 1.93 | 0.23 | Invention |
| 102 | " | " | P-1 | 1.92 | 0.24 | " |
| 103 | " | " | P-68 | 1.91 | 0.24 | " |
| 104 | " | " | P-26 | 1.92 | 0.24 | " |
| 105 | " | " | P-72 | 1.88 | 0.26 | " |
| 106 | I-1 | C-77 | — | 1.65 | 0.40 | Comparison |
| 107 | " | " | P-17 | 1.70 | 0.24 | Invention |

TABLE a-1-continued

| Sample No. | Reducing Agent for Color Formation | Coupler | Polymer | Dmax | Dmin | Remarks |
|---|---|---|---|---|---|---|
| 108 | " | " | P-1 | 1.68 | 0.25 | " |
| 109 | " | " | P-68 | 1.67 | 0.25 | " |
| 110 | " | " | P-26 | 1.67 | 0.25 | " |
| 111 | " | " | P-72 | 1.65 | 0.26 | " |
| 112 | I-24 | C-76 | — | 1.91 | 0.44 | Comparison |
| 113 | " | " | P-17 | 1.94 | 0.26 | Invention |
| 114 | " | " | P-1 | 1.92 | 0.27 | " |
| 115 | " | " | P-72 | 1.91 | 0.29 | " |
| 116 | I-32 | C-21 | — | 2.01 | 0.37 | Comparison |
| 117 | " | " | P-17 | 2.06 | 0.21 | Invention |
| 118 | " | " | P-68 | 2.05 | 0.22 | " |
| 119 | " | " | P-72 | 2.01 | 0.23 | " |
| 120 | I-27 | " | — | 1.93 | 0.35 | Comparison |

TABLE a-2

| Sample No. | Reducing Agent for Color Formation | Coupler | Polymer | Dmax | Dmin | Remarks |
|---|---|---|---|---|---|---|
| 121 | I-27 | C-21 | P-17 | 1.97 | 0.20 | Invention |
| 122 | " | " | P-26 | 1.95 | 0.22 | " |
| 123 | " | " | P-72 | 1.93 | 0.24 | " |
| 124 | I-39 | " | — | 1.60 | 0.41 | Comparison |
| 125 | " | " | P-17 | 1.64 | 0.23 | Invention |
| 126 | " | " | P-1 | 1.63 | 0.24 | " |
| 127 | " | " | P-72 | 1.60 | 0.25 | " |
| 128 | I-6 | C-77 | — | 1.61 | 0.39 | Comparison |
| 129 | " | " | P-17 | 1.65 | 0.23 | Invention |
| 130 | " | " | P-68 | 1.64 | 0.24 | " |
| 131 | " | " | P-72 | 1.61 | 0.25 | " |
| 132 | I-61 | C-14 | — | 1.85 | 0.45 | Comparison |
| 133 | " | " | P-17 | 1.88 | 0.31 | Invention |
| 134 | " | " | P-1 | 1.87 | 0.33 | " |
| 135 | " | " | P-68 | 1.86 | 0.33 | " |
| 136 | " | " | P-26 | 1.86 | 0.33 | " |
| 137 | " | " | P-72 | 1.85 | 0.35 | " |

TABLE b-1

| Sample No. | Reducing Agent for Color Formation | Coupler | Polymer | Dmax | Dmin | Remarks |
|---|---|---|---|---|---|---|
| 200 | I-16 | C-56 | — | 1.83 | 0.37 | Comparison |
| 201 | " | " | P-17 | 1.88 | 0.21 | Invention |
| 202 | " | " | P-1 | 1.86 | 0.22 | " |
| 203 | " | " | P-68 | 1.86 | 0.22 | " |
| 204 | " | " | P-26 | 1.86 | 0.23 | " |
| 205 | " | " | P-72 | 1.83 | 0.24 | " |
| 206 | I-1 | C-28 | — | 2.34 | 0.45 | Comparison |
| 207 | " | " | P-17 | 2.38 | 0.27 | Invention |
| 208 | " | " | P-1 | 2.36 | 0.28 | " |
| 209 | " | " | P-68 | 2.36 | 0.28 | " |
| 210 | " | " | P-26 | 2.36 | 0.26 | " |
| 211 | " | " | P-72 | 2.34 | 0.30 | " |
| 212 | I-24 | C-56 | — | 1.85 | 0.38 | Comparison |
| 213 | " | " | P-17 | 1.89 | 0.23 | Invention |
| 214 | " | " | P-1 | 1.87 | 0.25 | " |
| 215 | " | " | P-72 | 1.86 | 0.26 | " |
| 216 | I-32 | " | — | 1.95 | 0.38 | Comparison |
| 217 | " | " | P-17 | 2.00 | 0.24 | Invention |
| 218 | " | " | P-68 | 1.98 | 0.25 | " |
| 219 | " | " | P-72 | 1.95 | 0.26 | " |
| 220 | I-27 | " | — | 1.82 | 0.37 | Comparison |

TABLE b-2

| Sample No. | Reducing Agent for Color Formation | Coupler | Polymer | Dmax | Dmin | Remarks |
|---|---|---|---|---|---|---|
| 221 | I-27 | C-56 | P-17 | 1.85 | 0.21 | Invention |
| 222 | " | " | P-26 | 1.84 | 0.23 | " |
| 223 | " | " | P-72 | 1.82 | 0.24 | " |
| 224 | I-39 | " | — | 1.58 | 0.40 | Comparison |
| 225 | " | " | P-17 | 1.61 | 0.25 | Invention |
| 226 | " | " | P-1 | 1.60 | 0.26 | " |
| 227 | " | " | P-72 | 1.58 | 0.27 | " |
| 228 | I-6 | C-28 | — | 2.32 | 0.45 | Comparison |
| 229 | " | " | P-17 | 2.36 | 0.27 | Invention |
| 230 | " | " | P-68 | 2.35 | 0.27 | " |
| 231 | " | " | P-72 | 2.32 | 0.29 | " |
| 232 | I-61 | C-40 | — | 1.42 | 0.45 | Comparison |
| 233 | " | " | P-17 | 1.44 | 0.32 | Invention |
| 234 | " | " | P-1 | 1.44 | 0.34 | " |
| 235 | " | " | P-68 | 1.43 | 0.34 | " |
| 236 | " | " | P-26 | 1.43 | 0.34 | " |
| 237 | " | " | P-72 | 1.42 | 0.35 | " |

TABLE c-1

| Sample No. | Reducing Agent for Color Formation | Coupler | Polymer | Dmax | Dmin | Remarks |
|---|---|---|---|---|---|---|
| 300 | I-16 | C-43 | — | 1.46 | 0.36 | Comparison |
| 301 | " | " | P-17 | 1.50 | 0.18 | Invention |
| 302 | " | " | P-1 | 1.49 | 0.20 | " |
| 303 | " | " | P-68 | 1.49 | 0.20 | " |
| 304 | " | " | P-26 | 1.48 | 0.20 | " |
| 305 | " | " | P-72 | 1.46 | 0.22 | " |
| 306 | I-1 | C-42 | — | 1.49 | 0.44 | Comparison |
| 307 | " | " | P-17 | 1.55 | 0.20 | Invention |
| 308 | " | " | P-1 | 1.54 | 0.22 | " |
| 309 | " | " | P-68 | 1.54 | 0.22 | " |
| 310 | " | " | P-26 | 1.53 | 0.22 | " |
| 311 | " | " | P-72 | 1.49 | 0.23 | " |
| 312 | I-24 | C-43 | — | 1.55 | 0.40 | Comparison |
| 313 | " | " | P-17 | 1.60 | 0.20 | Invention |
| 314 | " | " | P-1 | 1.58 | 0.21 | " |
| 315 | " | " | P-72 | 1.55 | 0.23 | " |
| 316 | I-32 | C-69 | — | 1.71 | 0.41 | Comparison |
| 317 | " | " | P-17 | 1.74 | 0.21 | Invention |
| 318 | " | " | P-68 | 1.73 | 0.22 | " |
| 319 | " | " | P-72 | 1.71 | 0.23 | " |
| 320 | I-27 | " | — | 1.64 | 0.39 | Comparison |

TABLE c-2

| Sample No. | Reducing Agent for Color Formation | Coupler | Polymer | Dmax | Dmin | Remarks |
|---|---|---|---|---|---|---|
| 321 | I-27 | C-69 | P-17 | 1.68 | 0.19 | Invention |
| 322 | " | " | P-26 | 1.67 | 0.20 | " |
| 323 | " | " | P-72 | 1.64 | 0.22 | " |
| 324 | I-39 | " | — | 1.42 | 0.39 | Comparison |
| 325 | " | " | P-17 | 1.44 | 0.21 | Invention |
| 326 | " | " | P-1 | 1.43 | 0.22 | " |
| 327 | " | " | P-72 | 1.42 | 0.23 | " |
| 328 | I-6 | C-42 | — | 1.48 | 0.39 | Comparison |
| 329 | " | " | P-17 | 1.52 | 0.21 | Invention |
| 330 | " | " | P-68 | 1.51 | 0.22 | " |
| 331 | " | " | P-72 | 1.48 | 0.24 | " |
| 332 | I-61 | C-44 | — | 1.41 | 0.45 | Comparison |
| 333 | " | " | P-17 | 1.43 | 0.33 | Invention |
| 334 | " | " | P-1 | 1.42 | 0.34 | " |
| 335 | " | " | P-68 | 1.42 | 0.34 | " |

TABLE c-2-continued

| Sample No. | Reducing Agent for Color Formation | Coupler | Polymer | Dmax | Dmin | Remarks |
|---|---|---|---|---|---|---|
| 336 | " | " | P-26 | 1.42 | 0.34 | " |
| 337 | " | " | P-72 | 1.41 | 0.35 | " |

As is clearly seen from the results in Tables a-1 to c-2, when the reducing agent for color formation was used, the processed light-sensitive material (Samples 100, 106, 112, 116, 120, 124, 128 and 132) underwent increase of stains at the unexposed area upon storage for a long period of time at a high temperature and a high humidity, however, this increase of strains could be suppressed by using the water-insoluble polymer according to the present invention. It is also seen that when the water-insoluble polymer according to the present invention was used, the color density was not reduced.

Further, in the similar experiment under irradiation of light, stains could be suppressed by using the compound according to the present invention.

EXAMPLE 2

The surface of a paper support having laminated on both surfaces thereof with polyethylene was subjected to corona discharge treatment, a gelatin subbing layer containing sodium dodecylbenzenesulfonate was provided thereon, and three kinds of photographic constituent layers were coated thereon to prepare Photographic Color Printing Paper (400) having a three-layer structure described below. The coating solutions were prepared as follows.

Coating Solution for Second Layer

In ethyl acetate, 17 g of Yellow Coupler (C-76), 20 g of Reducing Agent (I-16) for color formation and 80 g of Solvent (Solv-2) were dissolved, and the resulting solution was emulsion-dispersed in a 16% aqueous gelatin solution containing a 10% sodium dodecylbenzenesulfonate and a citric acid to prepare Emulsion Dispersion D. Emulsion Dispersion D and Silver Chlorobromide Emulsion A used in Example 1 were mixed and dissolved to prepare a coating solution for the second layer having the following composition. The emulsion coated amount is a coated amount calculated in terms of silver.

The coating solutions for the first and third layers were prepared in the same manner as the coating solution for the second layer. In each layer, 1-oxy-3,5-dichloro-s-triazine sodium salt was used as a gelatin hardening agent.

Further, Cpd-2, Cpd-3, Cpd-4 and Cpd-5 used in Example 1 were added to each layer to have a total coverage of 15.0 mg/m$^2$, 60.0 mg/m$^2$, 50.0 mg/m$^2$ and 10.0 mg/m$^2$, respectively.

In the silver chlorobromide emulsion of the second layer, Blue Sensitizing Dyes A, B and C used in Example 1 were used in the same amount as used in Example 1.

Further, 1-(5-methylureidophenyl)-5-mercaptotetrazole was added to the second layer in an amount of $3.0\times10^{-3}$ mol per mol of silver halide.

(Layer Structure)

The composition of each layer is shown below. The numerals show the coated amount (g/m$^2$). In the case of silver halide emulsions, it is a coated amount in terms of silver.

| | |
|---|---|
| Support | |
| Polyethylene laminated paper | |
| [Polyethylene on the first layer side contained a white pigment ($TiO_2$, 15 wt %) and a bluish dye (ultramarine).] | |
| First Layer | |
| Gelatin | 1.12 |
| 1,5-Diphenyl-3-pyrazolidone (ETA-6 described above) (in the state of fine particle solid dispersion) | 0.02 |
| Second Layer | |
| Silver Chlorobromide Emulsion A described above | 0.20 |
| Gelatin | 1.50 |
| Yellow Coupler (C-76) | 0.17 |
| Reducing Agent (I-16) for color formation | 0.20 |
| Solvent (Solv-2) | 0.80 |
| Third Layer (Protective Layer) | |
| Gelatin | 1.01 |
| Acryl-modified copolymer of polyvinyl alcohol (modification degree: 17%) | 0.04 |
| Liquid paraffin | 0.02 |
| Surface Active Agent (Cpd-1) used in Example 1 | 0.01 |
| Solvent (Solve-2) | |
| O<br>\|\|<br>$P(C_8H_{17})_3$ | |

Samples (401) to (413) were prepared thoroughly in the same manner as Sample (400) except that the yellow coupler and the reducing agent for color formation in the second layer were replaced by an equimolar amount of the yellow coupler and the reducing agent for color formation shown in Table d, respectively, and that the polymer shown in Table d was further added in an amount of 50 wt % of Solvent (Solv-2) and co-emulsified in the same manner as above.

Samples (500) to (513) were prepared thoroughly in the same manner as Sample (400) except that Silver Chlorobromide Emulsion A in the coating solution for the second layer was replaced by an equal amount in terms of silver of Silver Chlorobromide Emulsion B used in Example 1, that the coupler and the reducing agent for color formation were replaced by an equimolar amount of the magenta coupler and the reducing agent for color formation shown in Table e, respectively, and that the polymer shown in Table e was further added in an amount of 50 wt % of Solvent (Solv-2) and co-emulsified in the same manner as above. In Silver Chlorobromide Emulsion B, Green Sensitizing Dyes D, E and F used in Example 1 were used in the same amount as used in Example 1.

Samples (600) to (613) were prepared thoroughly in the same manner as Sample (400) except that Silver Chlorobromide Emulsion A in the coating solution for the second layer was replaced by an equal amount in terms of silver of Silver Chlorobromide Emulsion C used in Example 1, that the coupler and the reducing agent for color formation were replaced by an equimolar amount of the cyan coupler and the reducing agent for color formation shown in Table f, respectively, and that the polymer shown in Table f was further added in an amount of 50 wt % of Solvent (Solv-2) and co-emulsified in the same manner as above. In Silver Chlorobromide Emulsion C, Red Sensitizing Dyes G and H used in Example 1 were used in the same amount as used in Example 1.

The thus prepared samples were immediately subjected to gradation exposure using Model FWH Sensitometer (color temperature of light source: 3,200° K) manufactured by Fuji Photo Film Co., Ltd., through a blue filter for sensitometry in the case of Samples (400) to (413), through a green filter for sensitometry in the case of Samples (500) to (513), and through a red filter for sensitometry in the case of Samples (600) to (613).

After the exposure, samples were processed through the following processing steps using the processing solutions described below.

| Processing Step | Temperature (°C.) | Time (sec.) |
|---|---|---|
| Development | 40 | 20 |
| Bleach-fixing | 40 | 45 |
| Rinsing | room temperature | 45 |

| Developer (alkali activating solution) | |
|---|---|
| Water | 600 ml |
| Potassium phosphate | 40 g |
| KCl | 5 g |
| Hydroxyethylidene-1,1-diphosphonic acid (30%) | 4 ml |
| Water to make | 1,000 ml |
| pH (at 25° C., with potassium hydroxide) | 12 |

The bleach-fixing solution and the rinsing solution were the same as the bleach-fixing solution and the rinsing solution used in Example 1.

After the processing, samples were measured on the maximum color density area, in the case of Samples (400) to (413), with blue light, in the case of Samples (500) to (513), with green light, and in the case of Samples (600) to (613), with red light. The results obtained are shown in Tables d, e and f, respectively.

Further, similarly to Example 1, each of unprocessed samples was stored at a temperature of 80° C. and a humidity of 70% and then, processed in the same manner as in Example 1. After the processing, samples were measured on the density (Dmin), in the case of Samples (400) to (413), with blue light, in the case of Samples (500) to (513), with green light, and in the case of Samples (600) to (613), with red light. The results obtained are shown in Tables d, e and f, respectively.

TABLE d

| Sample No. | Reducing Agent for Color Formation | Coupler | Polymer | Dmax | Dmin | Remarks |
|---|---|---|---|---|---|---|
| 400 | I-16 | C-76 | — | 2.13 | 0.38 | Comparison |
| 401 | " | " | P-17 | 2.18 | 0.23 | Invention |
| 402 | " | " | P-1 | 2.17 | 0.24 | " |
| 403 | " | " | P-68 | 2.17 | 0.24 | " |
| 404 | " | " | P-26 | 2.16 | 0.24 | " |
| 405 | " | " | P-72 | 2.13 | 0.26 | " |
| 406 | I-1 | C-77 | — | 2.03 | 0.40 | Comparison |
| 407 | " | " | P-17 | 2.08 | 0.24 | Invention |
| 408 | " | " | P-1 | 2.05 | 0.25 | " |
| 409 | " | " | P-72 | 2.03 | 0.26 | " |
| 410 | I-32 | C-21 | — | 2.24 | 0.37 | Comparison |
| 411 | " | " | P-17 | 2.26 | 0.21 | Invention |
| 412 | " | " | P-68 | 2.25 | 0.22 | " |
| 413 | " | " | P-72 | 2.24 | 0.23 | " |

TABLE e

| Sample No. | Reducing Agent for Color Formation | Coupler | Polymer | Dmax | Dmin | Remarks |
|---|---|---|---|---|---|---|
| 500 | I-16 | C-56 | — | 2.15 | 0.37 | Comparison |
| 501 | " | " | P-17 | 2.18 | 0.21 | Invention |
| 502 | " | " | P-1 | 2.17 | 0.22 | " |
| 503 | " | " | P-68 | 2.16 | 0.22 | " |
| 504 | " | " | P-26 | 2.16 | 0.23 | " |
| 505 | " | " | P-72 | 2.15 | 0.24 | " |
| 506 | I-1 | C-28 | — | 2.49 | 0.45 | Comparison |
| 507 | " | " | P-17 | 2.52 | 0.27 | Invention |
| 508 | " | " | P-1 | 2.51 | 0.28 | " |
| 509 | " | " | P-72 | 2.49 | 0.28 | " |
| 510 | I-32 | C-56 | — | 2.18 | 0.38 | Comparison |
| 511 | " | " | P-17 | 2.23 | 0.24 | Invention |
| 512 | " | " | P-68 | 2.20 | 0.25 | " |
| 513 | " | " | P-72 | 2.18 | 0.26 | " |

TABLE f

| Sample No. | Reducing Agent for Color Formation | Coupler | Polymer | Dmax | Dmin | Remarks |
|---|---|---|---|---|---|---|
| 600 | I-16 | C-43 | — | 1.82 | 0.36 | Comparison |
| 601 | " | " | P-17 | 1.86 | 0.18 | Invention |
| 602 | " | " | P-1 | 1.84 | 0.20 | " |
| 603 | " | " | P-68 | 1.83 | 0.20 | " |
| 604 | " | " | P-26 | 1.83 | 0.20 | " |
| 605 | " | " | P-72 | 1.82 | 0.22 | " |
| 606 | I-1 | C-42 | — | 1.92 | 0.44 | Comparison |
| 607 | " | " | P-17 | 1.96 | 0.20 | Invention |
| 608 | " | " | P-1 | 1.93 | 0.22 | " |
| 609 | " | " | P-72 | 1.92 | 0.23 | " |
| 610 | I-32 | C-69 | — | 1.99 | 0.41 | Comparison |
| 611 | " | " | P-17 | 2.03 | 0.21 | Invention |
| 612 | " | " | P-68 | 2.01 | 0.22 | " |
| 613 | " | " | P-72 | 1.99 | 0.23 | " |

As is clearly seen from the results in Tables d, e and f, even when an auxiliary developing agent was incorporated into the light-sensitive material, by using the water-insoluble polymer according to the present invention similarly to Example 1, increase of stains could be suppressed. Further, it is seen that also in this case, the color density was not reduced.

Furthermore, in the similar experiment under irradiation of light, stains could be suppressed by using the compound according to the present invention.

EXAMPLE 3

The surface of a paper support having laminated on both surfaces thereof with polyethylene was subjected to corona discharge treatment, a gelatin subbing layer containing sodium dodecylbenzenesulfonate was provided thereon, and various photographic constituent layers were coated thereon to prepare Photographic Multi-Layer Color Printing Paper (700) having a layer structure described below. The coating solutions were prepared as follows.

Coating Solution for First Layer

In ethyl acetate, 17 g of Coupler (C-76), 20 g of Reducing Agent (I-16) for color formation and 80 g of Solvent (Solv-2) used in Example 2 were dissolved, and the resulting solution was emulsion-dispersed in a 16% aqueous gelatin solution containing a 10% sodium dodecylbenzenesulfonate and a citric acid to prepare Emulsion Dispersion D. Emulsion Dispersion D and Silver Chlorobromide Emulsion A used in Example 1 were mixed and dissolved to prepare a coating solution for the first layer having the following composition. The emulsion coated amount is a coated amount calculated in terms of silver.

The coating solutions for the second to seventh layers were prepared in the same manner as the coating solution for the first layer. In each layer, 1-oxy-3,5-dichloro-s-triazine sodium salt was used as a gelatin hardening agent.

Further, Cpd-2, Cpd-3, Cpd-4 and Cpd-5 used in Example 1 were added to each layer to have a total coverage of 15.0 mg/m$^2$, 60.0 mg/m$^2$, 50.0 mg/m$^2$ and 10.0 mg/m$^2$, respectively.

In the silver chlorobromide emulsion of the first layer, the third layer and the fifth layer, Blue Sensitizing Dyes A, B and C, Green Sensitizing Dyes D, E and F, and Red Sensitizing Dyes G and H, used in Example 1 were used, respectively, in the same amount as used in Example 1.

In the fifth layer (red-sensitive layer), the following compound was further added in an amount of $2.6\times10^{-2}$ mol per mol of silver halide.

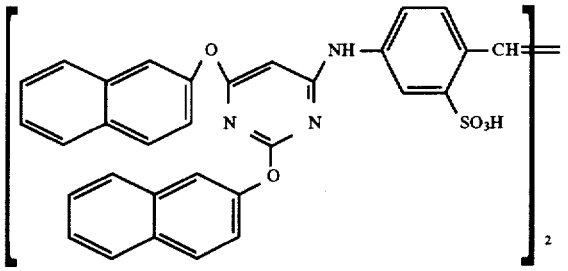

Further, 1-(5-methylureidophenyl)-5-mercaptotetrazole was added to the blue-sensitive emulsion layer, the green-sensitive emulsion layer and the red-sensitive emulsion layer in an amount of $3.5\times10^{-4}$ mol, $3.0\times10^{-3}$ mol and $2.5\times10^{-4}$ mol, per mol of silver halide, respectively.

Furthermore, 4-hydroxy-6-methyl-1,3,3a,7-tetrazaindene was added to the blue-sensitive emulsion layer and the green-sensitive emulsion layer in an amount of $1\times10^{-4}$ mol and $2\times10^{-4}$ mol, per mol of silver halide, respectively.

For the purpose of preventing irradiation, the following dyes (the coated amount is shown in the parenthesis) was added to each emulsion layer.

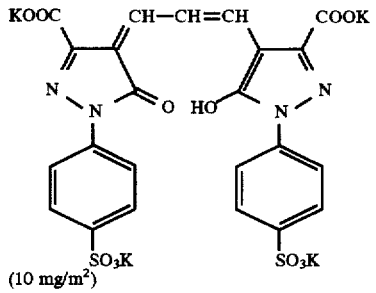

(10 mg/m$^2$)

and

-continued

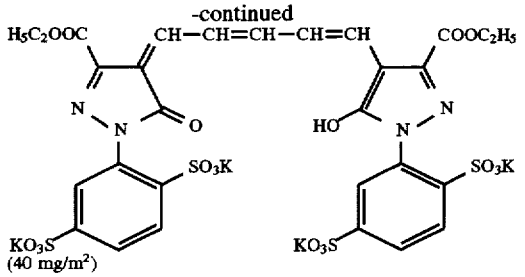

(Layer Structure)

The composition of each layer is shown below. The numerals show the coated amount (g/m $^2$). In the case of silver halide emulsion, it is a coated amount in terms of silver.

| | |
|---|---|
| Support | |
| Polyethylene laminated paper [Polyethylene on the first layer side contained a white pigment ($TiO_2$, 15 wt %) and a bluish dye (ultramarine).] | |
| First Layer (Blue-Sensitive Emulsion Layer) | |
| Silver Chlorobromide Emulsion A described above | 0.20 |
| Gelatin | 1.50 |
| Yellow Coupler (C-76) | 0.17 |
| Reducing Agent (I-16) for color formation | 0.20 |
| Solvent (Solv-2) | 0.80 |
| Second Layer (Color Mixing Preventing Layer) | |
| Gelatin | 1.09 |
| Color Mixing Inhibitor (Cpd-6) | 0.11 |
| Solvent (Solv-1) used in Example 1 | 0.19 |
| Solvent (Solv-3) | 0.07 |
| Solvent (Solv-4) | 0.25 |
| Solvent (Solv-5) | 0.09 |
| 1,5-Diphenyl-3-pyrazolidone (in the state of fine particle solid dispersion) | 0.03 |
| Third Layer (Green-Sensitive Emulsion Layer) | |
| Silver Chlorobromide Emulsion B described above | 0.20 |
| Gelatin | 1.50 |
| Magenta Coupler (C-56) | 0.24 |
| Reducing Agent (I-16) for color formation | 0.20 |
| Solvent (Solv-2) | 0.80 |
| Fourth Layer (Color Mixing Preventing Layer) | |
| Gelatin | 0.77 |
| Color Mixing Inhibitor (Cpd-6) | 0.08 |
| Solvent (Solv-1) | 0.14 |
| Solvent (Solv-3) | 0.05 |
| Solvent (Solv-4) | 0.14 |
| Solvent (Solv-5) | 0.06 |
| 1,5-Diphenyl-3-pyrazolidone (in the state of fine particle solid dispersion) | 0.02 |
| Fifth Layer (Red-Sensitive Emulsion Layer) | |
| Silver Chlorobromide Emulsion C described above | 0.20 |
| Gelatin | 0.15 |
| Cyan Coupler (C-43) | 0.21 |
| Reducing Agent (I-16) for color formation | 0.20 |
| Solvent (Solv-2) | 0.80 |
| Sixth Layer (Ultraviolet Absorbing Layer) | |
| Gelatin | 0.64 |
| Ultraviolet Absorbent (UV-1) | 0.39 |
| Solvent (Solv-6) | 0.05 |
| Seventh Layer (Protective Layer) | |
| Gelatin | 1.01 |
| Acryl-modified copolymer of polyvinyl alcohol (modification degree: 17%) | 0.04 |
| Liquid paraffin | 0.02 |
| Surface Active Agent (Cpd-1) used in Example 1 | 0.01 |

Color Mixing Inhibitor (Cpd-6)

A 1:1:1 (by weight) mixture of (1), (2) and (3):

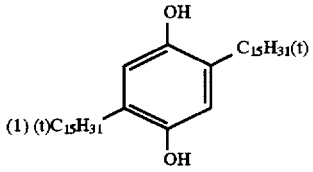

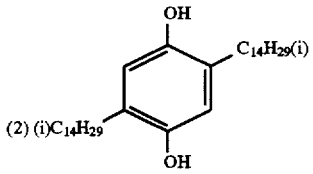

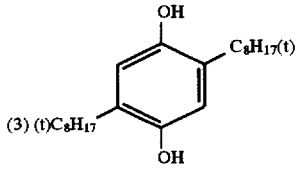

Solvent (Solv-3)

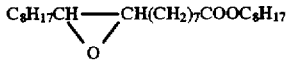

Solvent (Solv-4)

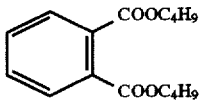

(Solvent (Solv-5)

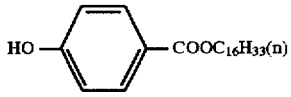

Solvent (Solv-6)

$C_8H_{17}OCO-(CH_2)_8-COOC_8H_{17}$

Ultraviolet Absorbent (UV-1)

A 1:2:2:3:1 (by weight) mixture of (1), (2), (3), (4) and (5):

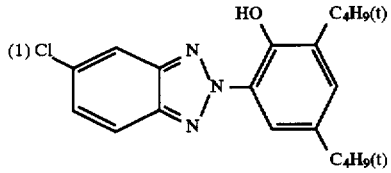

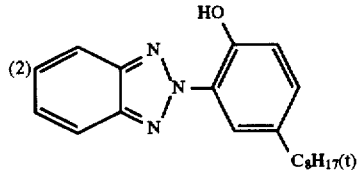

-continued (3)

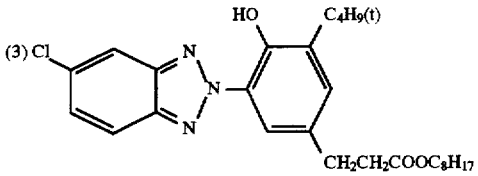

(4)

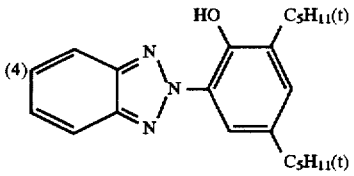

| Processing Step | Temperature (°C.) | Time (sec.) |
|---|---|---|
| Color development | 40 | 30 |
| Bleach-fixing | 40 | 45 |
| Rinsing | room temperature | 90 |

The color developer, the bleach-fixing solution and the rinsing solution were the same as the developer, the bleach-fixing solution and the rinsing solution used in Example 1.

After the processing, samples were measured on the maximum color density area with red light, green light or blue light. The results obtained are shown in Table g.

Further, similarly to Example 1, each of unprocessed samples was stored at a temperature of 80° C. and a humidity of 70% and then, processed in the same manner as in Example 1.

After the processing, samples were measured on the density (Dmin) with blue light, green light or red light. The results obtained are shown in Table g.

TABLE g

| Sample No. | Reducing Agent for Color Formation | Yellow Coupler | Magenta Coupler | Cyan Coupler | Polymer | Yellow Dmax | Yellow Dmin | Magenta Dmax | Magenta Dmin | Cyan Dmax | Cyan Dmin | Remarks |
|---|---|---|---|---|---|---|---|---|---|---|---|---|
| 700 | I-16 | C-76 | C-56 | C-43 | — | 2.21 | 0.52 | 2.26 | 0.50 | 1.95 | 0.46 | Comparison |
| 701 | " | " | " | " | P-17 | 2.24 | 0.26 | 2.29 | 0.24 | 2.00 | 0.24 | Invention |
| 702 | " | " | " | " | P-1 | 2.23 | 0.28 | 2.28 | 0.26 | 1.98 | 0.25 | " |
| 703 | " | " | " | " | P-72 | 2.21 | 0.30 | 2.26 | 0.29 | 1.95 | 0.28 | " |
| 704 | I-1 | C-77 | C-28 | C-42 | — | 2.13 | 0.54 | 2.51 | 0.52 | 2.01 | 0.50 | Comparison |
| 705 | " | " | " | " | P-17 | 2.18 | 0.27 | 2.54 | 0.27 | 2.06 | 0.26 | Invention |
| 706 | I-32 | C-21 | C-56 | C-69 | — | 2.32 | 0.53 | 2.28 | 0.49 | 2.10 | 0.46 | Comparison |
| 707 | " | " | " | " | P-17 | 2.36 | 0.26 | 2.33 | 0.25 | 2.15 | 0.24 | Invention |

-continued (5)

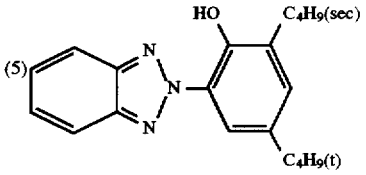

Samples (701) to (707) were prepared thoroughly in the same manner as Sample (700) except that the coupler and the reducing agent for color formation of Sample (700) were replaced by an equimolar amount of the coupler and the reducing agent for color formation shown in Table g, respectively, and that the polymer shown in Table g was further added in an amount of 50 wt % of Solvent (Solv-2) and co-emulsified in the same manner as above.

The thus prepared samples all were immediately subjected to gradation exposure using Model FWH Sensitometer (color temperature of light source: 3,200° K) manufactured by Fuji Photo Film Co., Ltd., through a three color resolution filter for sensitometry.

After the exposure, samples were processed through the following processing steps using the processing solutions described below.

As is clearly seen from the results in Table g, even in the case of a multilayered light-sensitive material where an auxiliary developing agent was incorporated into the light-sensitive material, similarly to Example 1, increase of stains could be suppressed by using the water-insoluble polymer according to the present invention. Further, it is seen that when the polymer according to the present invention was used, the color density was not reduced.

Furthermore, also in the similar experiment under light irradiation, stains could be suppressed by using the compound according to the present invention.

EXAMPLE 4

Sample (800) was prepared thoroughly in the same manner as Sample (700) in Example 3 except that Silver Chlorobromide Emulsions A, B and C in the first, third and fifth layers of Sample (700) were replaced by Silver Chlorobromide Emulsions D, E and F shown below, respectively, and the coated silver amounts of respective emulsions were 0.01 g/m$^2$, 0.01 g/m$^2$ and 0.015 g/m$^2$.

Silver Chlorobromide Emulsion D

Cubic; a 3:7 (by Ag mol) mixture of Large Size Emulsion D having an average grain size of 0.10 μm and Small Size Emulsion D having an average grain size of 0.08 μm; the emulsions having a coefficient of variation in the grain size distribution of 0.08 and 0.10, respectively; and the emulsion of each size containing 0.3 mol % of AgBr localized on a part of the grain surface comprising a substrate of silver chloride. Chemical ripening of this emulsion was optimally performed by adding a sulfur sensitizer and a gold sensitizer.

In Silver Chlorobromide Emulsion D, Blue Sensitizing Dyes A, B and C used in Example 1 were used each in an amount, for Large Size Emulsion D, of $7.0\times10^{-4}$ mol and for Small Size Emulsion D, of $8.5\times10^{-4}$ mol, per mol of silver halide.

Silver Chlorobromide Emulsion E

Cubic; a 1:3 (by Ag mol) mixture of Large Size Emulsion E having an average grain size of 0.10 μm and Small Size Emulsion E having an average grain size of 0.08 μm; the emulsions having a coefficient of variation in the grain size distribution of 0.10 and 0.08, respectively; and the emulsion of each size containing 0.8 mol % of AgBr localized on a part of the grain surface comprising a substrate of silver chloride.

In Silver Chlorobromide Emulsion E, Green Sensitizing Dyes D, E, and F used in Example 1 were used. Sensitizing Dye D was added in an amount, for the large size emulsion, of $1.5\times10^{-3}$ mol and for the small size emulsion, of $1.8\times10^{-3}$ mol, per mol of silver halide. Sensitizing Dye E was added in an amount, for the large size emulsion, of $2.0\times10^{-4}$ mol and for the small size emulsion, of $3.5\times10^{-4}$ mol, per mol of silver halide. Sensitizing Dye F was added in an amount, for the large size emulsion, of $1.0\times10^{-3}$ mol and for the small size emulsion, of $1.4\times10^{-3}$ mol, per mol of silver halide.

Silver Chlorobromide Emulsion F

Cubic; a 1:4 (by Ag mol) mixture of Large Size Emulsion F having an average grain size of 0.10 μm and Small Size Emulsion F having an average grain size of 0.08 μm; the emulsions having a coefficient of variation in the grain size distribution of 0.09 and 0.11, respectively; and the emulsion of each size containing 0.8 mol % of AgBr localized on a part of the grain surface comprising a substrate of silver chloride.

In Silver Chlorobromide Emulsion F, Red Sensitizing Dyes G and H used in Example 1 were used each in an amount, for the large size emulsion, of $2.5\times10^{-4}$ mol and for the small size emulsion, of $4.0\times10^{-4}$ mol, per mol of silver halide.

Samples (801) to (807) were prepared in the same manner as Sample (800) except that the reducing agent for color formation and the coupler of Sample (800) each was replaced by the compound shown below in an equimolar amount, and the water-insoluble polymer according to the present invention was further added to the solvent in each of the first, third and fifth layers in an amount of 50 wt % of the solvent in each layer and co-emulsified together with other additives.

| Sample | Reducing Agent for Color Formation | Yellow Coupler | Magenta Coupler | Cyan Coupler | Water-Insoluble Polymer |
|---|---|---|---|---|---|
| 801 | I-16 | C-76 | C-56 | C-43 | P-17 |
| 802 | I-16 | C-76 | C-56 | C-43 | P-1 |
| 803 | I-16 | C-76 | C-56 | C-43 | P-72 |
| 804 | I-8 | C-77 | C-28 | C-42 | — |
| 805 | I-8 | C-77 | C-28 | C-42 | P-17 |
| 806 | I-32 | C-21 | C-56 | C-69 | — |
| 807 | I-32 | C-21 | C-56 | C-69 | P-17 |

Each sample was exposed in the same manner as in Example 3 and processed with an intensifier which was a 0.3% aqueous solution of hydrogen peroxide having a pH of 12.0 obtained by adding hydrogen peroxide to the developer used in Example 3. Then, even when a light-sensitive material greatly reduced in the silver amount was used, an image having a high maximum density similarly to Example 3 could be obtained. Further, in samples to which the water-insoluble polymer according to the present invention was added, the image exhibited good prevervability, whereby a sharp image reduced in stains even after storage under high temperature and high humidity or light irradiation conditions, could be obtained.

The light-sensitive material of the present invention was verified that it is suitable for the image formation amplified by the intensification processing of a low silver light-sensitive material.

EXAMPLE 5

Using Samples (700) to (707) in Example 3, the same processing and evaluation as in Example 3 were performed except for conducting exposure as follows.

(Exposure)

The light sources used were a YAG solid laser (oscillation wavelength: 946 nm) using a semiconductor laser GaAlAs (oscillation wavelength: 808.5 nm) as an excitation light source and taken out after wavelength conversion by an SHG crystal of $KNbO_3$ to 473 nm, a YVO4 solid laser (oscillation wavelength: 1,064 nm) using a semiconductor laser GaAlAs (oscillation wavelength: 808.7 nm) as an excitation light source and taken out after wavelength conversion by an SHG crystal of KTP to 532 nm, and AlGaInP (oscillation wavelength: about 670 nm; Type No. TOLD9211, manufactured by Toshiba KK). The laser lights each was an apparatus capable of scan exposing in sequence the photographic color printing paper moving in the vertical direction to the scan direction, by means of a rotating polyhedron. Using these apparatuses, the relation D-logE between the density (D) of the light-sensitive material and the luminous energy (E) was obtained by varying the quantity of light. In this case, the laser lights of three wavelengths were modulated in the quantity of light using an external modulator to control the exposure amount. The scan exposure was performed at 400 dpi and the average exposure time per pixel was about $5\times10^{-8}$ second. The semiconductor lasers were kept at a constant temperature using a Peltier element so as to suppress change in the quantity of light due to the temperature.

As a result, the image formed by a high-illuminance digital exposure could also have a high maximum density and when the water-insoluble polymer according to the present invention was used, the image was reduced in stains even after storage under high temperature and high humidity or light irradiation conditions.

According to the present invention, low replenishment and small discharge can be achieved, satins after a long-term storage of the light-sensitive material are reduced, and an image having a high color density can be obtained.

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material comprising a support having thereon at least one photographic constituent layer, wherein any one of said photographic constituent layer contains at least one reducing agent for color formation represented by formula (I):

$$R^{11}—NHNH—X—R^{12} \quad (I)$$

wherein $R^{11}$ represents an aryl group or a heterocyclic group, $R^{12}$ represents an alkyl group, an alkenyl group, an alkynyl group, or an aryl group, and X represents $—SO_2—$, —CO—, —COCO—, —CO—O—, —CON($R^{13}$)—, —COCO—O—, —CCO—N($R^{13}$)— or —$SO_2$—N($R^{13}$)—, wherein $R^{13}$ represents a hydrogen atom or a group described for $R^{12}$, at least one dye forming coupler and at least one water-insoluble polymer.

2. The silver halide color photographic light-sensitive material as claimed in claim 1, wherein the compound represented by formula (I) is represented by formula (II) or (III):

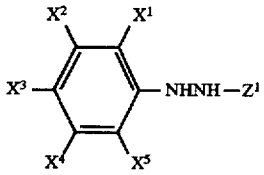

(II)

$R^3$—NHNH—$Z^2$ (III)

wherein $Z^1$ represents an acyl group, a carbamoyl group, an alkoxycarbonyl group or an aryloxycarbonyl group, $Z^2$ represents a carbamoyl group, an alkoxycarbonyl group or an aryloxycarbonyl group, $X^1$, $X^2$, $X^3$, $X^4$ and $X^5$ each represents a hydrogen atom or a substituent, provided that the sum of the Hammett's substituent constant $\sigma_p$ values of $X^1$, $X^3$ and $X^5$ and the Hammett's substituent constant $\sigma_m$ values of $X^2$ and $X^4$ is from 0.80 to 3.80, and $R^3$ represents a heterocyclic group.

3. The silver halide color photographic light-sensitive material as claimed in claim 2, wherein the compounds represented by formulae (II) and (III) are represented by formulae (IV) and (V), respectively:

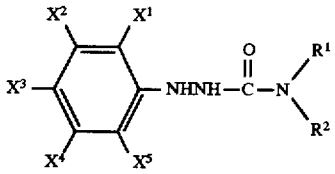

(IV)

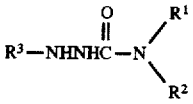

(V)

wherein $R^1$ and $R^2$ each represents a hydrogen atom or a substituent, $X^1$, $X^2$, $X^3$, $X^4$ and $X^5$ each represents a hydrogen atom or a substituent, provided that the sum of the Hammett's substituent constant $\sigma_p$ values of $X^1$, $X^3$ and $X^5$ and the Hammett's substituent constant $\sigma_m$ values of $X^2$ and $X^4$ is from 0.80 to 3.80, and $R^3$ represents a heterocyclic group.

4. The silver halide color photographic light-sensitive material as claimed in claim 3, wherein the compounds represented by formulae (IV) and (V) are represented by formulae (VI) and (VII), respectively:

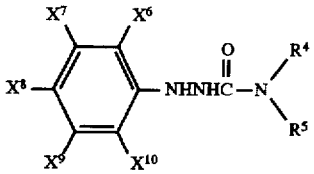

(VI)

-continued

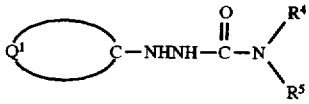

(VII)

wherein $R^4$ and $R^5$ each represents a hydrogen atom or a substituent, $X^6$, $X^7$, $X^8$, $X^9$ and $X^{10}$ each represents a hydrogen atom, a cyano group, a sulfonyl group, a sulfinyl group, a sulfamoyl group, a carbamoyl group, an alkoxycarbonyl group, an aryloxycarbonyl group, an acyl group, a trifluoromethyl group, a halogen atom, an acyloxy group, an acylthio group or a heterocyclic group, provided that the sum of the Hammett's substituent constant $\sigma_p$ values of $X^6$, $X^8$ and $X^{10}$ and the Hammett's substituent constant $\sigma_m$ values of $X^7$ and $X^9$ is from 1.20 to 3.80, and $Q^1$ represents a nonmetallic atom group necessary for forming a nitrogen-containing 5-, 6-, 7- or 8-membered heterocyclic ring together with C.

5. The silver halide color photographic light-sensitive material as claimed in claim 1, wherein the total coated silver amount of all coated layers is, in terms of silver, from 0.003 to 0.3 g/$m^2$.

6. The silver halide color photographic light-sensitive material as claimed in claim 1, which is scan exposed for an exposure time of from $10^{-8}$ to $10^{-4}$ second per one pixel.

7. The silver halide color photographic light-sensitive material as claimed in claim 1, wherein said at least one water-insoluble polymer is selected from the group consisting of vinyl polymers and polyester polymers each having —(C=O)— bond in the repeating unit.

8. The silver halide color photographic light-sensitive material as claimed in claim 1, wherein said at least one water-insoluble polymer is synthesized from a methacrylate-base monomer, an acrylamide-base monomer or a methacrylamide-base monomer.

9. The silver halide color photographic light-sensitive material as claimed in claim 1, wherein said at least one water-insoluble polymer is synthesized from an acrylamide-base monomer or a methacrylamide-base monomer.

10. The silver halide color photographic light-sensitive material as claimed in claim 1, wherein said at least one water-insoluble polymer comprises only a styrene monomer, an α-methylstyrene monomer, a 3-methylstyrene monomer or a monomer having a substituent on the benzene ring thereof.

11. The silver halide color photographic light-sensitive material as claimed in claim 1, wherein said at least one water-insoluble polymer is a polyester-base resin obtained by condensing a polyhydric alcohol with a polybasic acid or a polyester-base resin obtained by ring-opening polymerization.

12. The silver halide color photographic light-sensitive material as claimed in claim 1, wherein said at least one water-insoluble polymer is added to a layer which contains the reducing agent for color formation.

13. The silver halide color photographic light-sensitive material as claimed in claim 1, wherein said at least one water-insoluble polymer is added to a layer where the dye produced is fixed.

14. The silver halide color photographic light-sensitive material as claimed in claim 1, wherein said at least one photographic constituent layer comprises at least one silver halide emulsion layer comprising a silver halide emulsion having a silver chloride content of 90 mol % or more.

15. A method of producing a colored dye image, which comprises developing an exposed silver halide color photographic light-sensitive material comprising a support having thereon at least one photographic constituent layer, wherein any one of said photographic constituent layer contains at least one reducing agent for color formation represented by formula (I):

$$R^{11}—NHNH—X—R^{12} \quad (I)$$

wherein $R^{11}$ represents an aryl group or a heterocyclic group, $R^{12}$ represents an alkyl group, an alkenyl group, an alkynyl group or an aryl group, and X represents —$SO_2$—, —CO—, —COCO—, —CO—O—, —CON($R^{13}$)—, —COCO—O—, —CCO—N($R^{13}$)— or —$SO_2$—N($R^{13}$)—, wherein $R^{13}$ represents a hydrogen atom or a group described for $R^{12}$, at least one dye forming coupler and at least one water-insoluble polymer, whereby the oxidation product of the reducing agent for color formation obtained reacts with the dye-forming coupler to form a dye.

16. The silver halide color photographic light-sensitive material as claimed in claim 1, wherein X in formula (I) represents —CO—, —CON($R^{13}$)—, or —CO—O—.

17. The silver halide color photographic light-sensitive material as claimed in claim 16 wherein X represents —CON($R^{13}$)—.

18. The silver halide color photographic light-sensitive material as claimed in claim 1, wherein said at least one reducing agent for color formation is present in an amount of from 0.1 to 1 mmol/$m^2$ per one said at least one photographic constituent layer.

19. The silver halide color photographic light-sensitive material as claimed in claim 1, wherein said at least one dye forming coupler is present as a molar ratio to the said at least one reducing agent for color formation in an amount of 0.2 to 5 times.

20. The silver halide color photographic light-sensitive material as claimed in claim 1, wherein the said at least one dye forming coupler and said at least one reducing agent for color formation are added in the same said at least one photographic constituent layer.

* * * * *